US005380624A

United States Patent [19]

Yoshida et al.

[11] Patent Number: 5,380,624

[45] Date of Patent: Jan. 10, 1995

[54] PROCESS FOR PROCESSING SILVER HALIDE COLOR PHOTOGRAPHIC MATERIAL

[75] Inventors: Kazuaki Yoshida; Takatoshi Ishikawa; Yoshihiro Fujita; Genichi Furusawa, all of Kanagawa, Japan

[73] Assignee: Fuji Photo Film Co., Ltd., Kanagawa, Japan

[21] Appl. No.: 126,730

[22] Filed: Sep. 27, 1993

Related U.S. Application Data

[63] Continuation of Ser. No. 963,288, Oct. 19, 1992, abandoned, which is a continuation of Ser. No. 632,647, Dec. 26, 1990, abandoned, which is a continuation of Ser. No. 312,279, Feb. 21, 1989, abandoned.

[30] Foreign Application Priority Data

| | | | |
|---|---|---|---|
| Feb. 19, 1988 | [JP] | Japan | 63-36903 |
| Feb. 22, 1988 | [JP] | Japan | 63-39077 |
| Jun. 1, 1988 | [JP] | Japan | 63-134717 |

[51] Int. Cl.[6] ..... G03C 1/34

[52] U.S. Cl. ..... 430/372; 430/357; 430/486; 430/490; 430/607; 430/611; 430/613

[58] Field of Search ..... 430/484, 485, 486, 490, 430/607, 631, 637, 638, 357, 372, 611, 613

[56] References Cited

U.S. PATENT DOCUMENTS

| | | | |
|---|---|---|---|
| 4,224,403 | 9/1980 | Toda et al. | 430/939 |
| 4,490,462 | 12/1984 | Kawaguchi et al. | 430/542 |
| 4,576,909 | 3/1986 | Goto et al. | 430/637 |
| 4,800,153 | 1/1989 | Morimoto et al. | 430/467 |
| 4,820,623 | 4/1989 | Koshimizu et al. | 430/376 |
| 4,837,139 | 6/1989 | Kobayashi et al. | 430/490 |
| 4,873,179 | 10/1989 | Abe et al. | 430/372 |
| 4,876,174 | 10/1989 | Ishikawa et al. | 430/484 |
| 4,897,339 | 1/1990 | Andoh et al. | 430/484 |
| 5,055,381 | 10/1991 | Abe et al. | 430/490 |

FOREIGN PATENT DOCUMENTS

| | | |
|---|---|---|
| 0136924 | 4/1985 | European Pat. Off. . |
| 0211437 | 2/1987 | European Pat. Off. . |
| 0255734 | 2/1988 | European Pat. Off. . |
| 59-142543 | 12/1984 | Japan . |
| 59-228247 | 5/1985 | Japan . |
| 60-119547 | 10/1985 | Japan . |
| 60-263938 | 5/1986 | Japan . |

*Primary Examiner*—Hoa Van Le

*Attorney, Agent, or Firm*—Sughrue, Mion, Zinn, Macpeak & Seas

[57] ABSTRACT

A novel process is provided for processing a silver halide color photographic material with a color developing solution containing at least one aromatic primary amine color developing agent, wherein said silver halide color photographic material contains at least one of anti-bacterial agents represented by the general formulas (I), (II), (III), (IV) and (V) and that the processing is effected while said color developing solution is supplied in an amount of 20 to 120 ml per 1 $m^2$ of said silver halide color photographic material.

16 Claims, No Drawings

PROCESS FOR PROCESSING SILVER HALIDE COLOR PHOTOGRAPHIC MATERIAL

This is a continuation of application No. 07/963288 filed on Oct. 19, 1992, (abandoned), which is a continuation of prior application No. 07/632647 filed on Dec. 26, 1990 (abandoned), which is a continuation of prior application No. 07/312279 filed Feb. 21, 1989 (abandoned).

FIELD OF THE INVENTION

The present invention relates to a process for processing a silver halide color photographic material. More particularly, the present invention relates to a process for processing a silver halide color photographic material with a remarkably small supply amount of a color developing solution.

BACKGROUND OF THE INVENTION

The processing of a silver halide color photographic material essentially consists of color development (preceded by a 1st black-and-white development in the case of color reversal light-sensitive material) and desilvering. The desilvering process consists of a bleaching process and a fixing process or a combined bleaching and fixing process. Other processing steps may be optionally added such as rinsing, stop and pretreatment for acceleration of development.

In color development, exposed silver halide is reduced to silver. At the same time, an aromatic primary amine developing agent thus oxidized reacts with a coupler to form a dye. In this process, halogen ions produced by the decomposition of silver halide elute into the developing solution and are then accumulated therein. On the other hand, the color developing agent is consumed by the reaction with the coupler. Furthermore, other components become affixed to and are carried away by the photographic light-sensitive material. Thus, the concentration of the developing solution is gradually lowered. Therefore, if a large amount of silver halide photographic materials are subjected to continuous processing by means of an automatic developing machine or the like, a means is needed for keeping the concentration of the active ingredients in the color developing solution in a constant range in order to avoid fluctuation in the finish properties due to the fluctuation in the concentration of the color developing solution.

For example, if a consumable component such as a developing agent and a preservative is little susceptible to the effects of being concentrated, its concentration in the supply liquid may be raised. Elutable components having a development inhibiting effect such as halogen may be incorporated in the supply liquid in a lower concentration or may not be incorporated in the supply liquid at all. In order to eliminate the effects of such elutable components, certain kinds of compounds may be incorporated in the supply liquid. The pH value of the processing solution or the concentration of an alkali or chelating agent may properly be adjusted. This is normally accomplished by supplying a liquid for making up for the lack of components and diluting concentrated components. The supply of such a liquid inavoidably produces a large amount of overflow liquid, leaving great economical and environmental problems.

In recent years, it has been keenly desired to reduce the supply amount of a color developing solution for the purpose of expediting development, saving resources and avoiding environmental pollution. However, if the supply amount of a color developing solution is simply reduced, the accumulation of elutes from the light-sensitive material, particularly bromine ion (a strong development inhibitor) or various organic compounds causes problems such as remarkable deterioration in photographic properties, e.g., color density or sensitivity and remarkably low contrast as the continuous processing proceeds. Furthermore, the color developing solution shows a remarkable deterioration which produces a large amount of suspended matter, denying practical use.

Many methods have been heretofore suggested for inhibiting the fluctuation in the photographic properties due to the processing with a small supply amount of a color developing solution. A technique which comprises using various development accelerators and couplers to inhibit the fluctuation in photographic properties due to the processing with a small supply amount of a processing solution is disclosed in JP-A-57-150847, JP-A-58-4145, JP-A-58-120250, JP-A-60-165651, and JP-A-61-269153 (the term "JP-A" as used herein means an "unexamined published Japanese patent application"). However, this technique leaves to be desired in its effects.

JP-A-61-70552 discloses a technique for expediting color development by using a high silver chloride content light-sensitive material and processing with a small supply amount of a color developing solution by using this technique. This technique is considered to be a useful means for reducing the accumulation of bromine ions, strong development inhibitor, to expedite development. However, if a high silver chloride content light-sensitive material is actually used to reduce the supply amount of the developing solution, it little mars rapidity in development but causes a remarkable fluctuation in the photographic properties as the continuous processing proceeds. In particular, the color density and sensitivity are remarkably deteriorated and the contrast becomes low. Furthermore, the deterioration of the color developing solution and the production of a large amount of suspended matter cause buildup on the roller resulting in stains on the light-sensitive material, filter plugging or other problems. Thus, this technique cannot be put into practical use. This technique which comprises simply using a high silver chloride content light-sensitive material to reduce the accumulation of bromine ions does not satisfactorily permit reducing the supply amount of a color developing solution. A noble technique had been desired.

At present, the supply amount of a color developing solution differs somewhat with the type of a light-sensitive material to be processed but is normally in the range of 180 to 1,000 ml per 1 $m^2$ of light-sensitive material. The reason why the supply amount of a color developing solution cannot be reduced to less than the above described range is that the above described critical problems such as remarkable fluctuations in photographic properties, deterioration of the color developing solution and production of suspended matter appear as the continuous processing proceeds. Heretofore, no essential resolutions have been found.

SUMMARY OF THE INVENTION

It is therefore an object of the present invention to provide a continuous developing method which exhibits a smaller fluctuation in photographic properties, particularly maximum density, sensitivity and gradation even if the supply amount of a color developing solution is remarkably reduced.

It is another object of the present invention to provide a development process in which the color developing solution does not exhibit a deterioration even if the supply amount of the color developing solution is remarkably reduced.

It is further object of the present invention to provide a development process which produces no suspended matter even if the supply amount of the color developing solution is remarkably reduced.

These and other objects of the present invention will become more apparent from the following detailed description and examples.

These objects of the present invention are accomplished by a process for processing a silver halide color photographic material with a color developing solution containing at least one aromatic primary amine color developing agent, wherein said silver halide color photographic material contains at least one of anti-bacterial agents represented by the general formulas (I), (II), (III), (IV) and (V) and that the processing is effected while said color developing solution is supplied in an amount of 20 to 120 ml per 1 $m^2$ of said silver halide color photographic material:

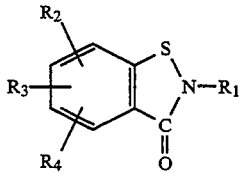

(I)

wherein $R_1$ represents a hydrogen atom, an alkyl group or an alkoxy group; and $R_2$, $R_3$ and $R_4$ each represents a hydrogen atom, a halogen atom, an alkyl group, an alkoxy group, a cyano group or a nitro group,

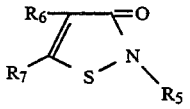

(II)

wherein $R_5$ represents a hydrogen atom, an alkyl group, a cyclic alkyl group, an alkenyl group, an aralkyl group, an aryl group, —$CONHR_8$ group (in which $R_8$ represents an alkyl, aryl, alkylthio, arylthio, alkylsulfonyl, arylsulfonyl, alkylsulfinyl or arylsulfinyl group) or a heterocyclic group; and $R_6$ and $R_7$ each represents a hydrogen atom, a halogen atom, an alkyl group, a cyclic alkyl group, an aryl group, a heterocyclic group, a cyano group, an alkylthio group, an arylthio group, an alkylsulfoxide group, an alkylsulfinyl group or an alkylsulfonyl group,

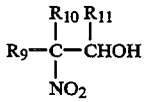

(III)

wherein $R_9$ and $R_{10}$ may be the same or different and each represents a halogen atom, a hydrogen atom, an alkyl group having 1 to 5 carbon atoms or a hydroxymethyl group; and $R_{11}$ represents a hydrogen atom or an alkyl group having 1 to 5 carbon atoms,

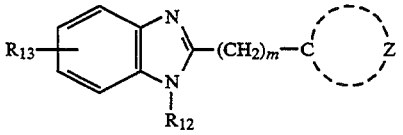

(IV)

wherein $R_{12}$ represents a hydrogen atom, an alkyl group or an aryl group; $R_{13}$ represents a hydrogen atom, an alkyl group, an aryl group, a nitro group, a carboxyl group, a sulfo group, a sulfamoyl group, a hydroxy group, a halogen atom, an alkoxy group or a thiazolyl group; Z represents an atomic group constituting a thiazolyl ring; and m represents 0 or 1,

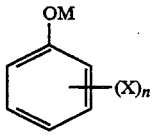

(V)

wherein X represents a halogen atom, an alkyl group, a cycloalkyl group, an aryl group, a carboxyl group, an amino group, a hydroxyl group, a sulfo group, a nitro group or an alkoxycarbonyl group; M represents a hydrogen atom, an alkaline metal atom or an alkyl group; and n represents 0 or an integer 1 to 5, provided that M is not a hydrogen atom when n is 0.

DETAILED DESCRIPTION OF THE INVENTION

In the general formula (I), $R_1$ represents a hydrogen atom, a straight-chain or branched alkyl group preferably having from 1 to 20 carbon atoms (e.g., methyl, ethyl, n-propyl, n-butyl, tert-butyl, n-octyl, tert-octyl, n-nonyl, n-dodecyl, n-tetradecyl, n-heptadecyl, n-hexadecyl, n-octadecyl), or an alkoxy group preferably having 1 to 6 carbon atoms (e.g., methoxy, ethoxy, n-propoxy, iso-propoxy, n-butoxy, iso-butoxy, n-pentoxy, iso-pentoxy). The alkyl group for $R_1$ may be substituted by a sulfo group, a carboxyl group or a halogen atom (e.g., chlorine, bromine, fluorine). $R_2$, $R_3$ and $R_4$ each represents a hydrogen atom, a halogen atom (e.g., chlorine, bromine), a straight-chain or branched alkyl group preferably having 1 to 6 carbon atoms (e.g., methyl, ethyl, iso-propyl, n-propyl, n-butyl, sec-butyl, tert-butyl, n-hexyl), an alkoxy group preferably having 1 to 6 carbon atoms (e.g., methoxy, ethoxy, n-propoxy, iso-propoxy, n-butoxy, iso-butoxy, n-pentoxy, iso-pentoxy), a cyano group or a nitro group..

The alkyl or alkenyl group for $R_5$ in the general formula (II) preferably contains 1 to 36 carbon atoms and more preferably 1 to 18 carbon atoms (e.g., methyl, ethyl, n-propyl, n-butyl, tert-butyl, n-octyl, tert-octyl, n-nonyl, n-dodecyl, n-tetradecyl, n-heptadecyl, n-hexadecyl, n-octadecyl, vinyl, allyl, 1-propenyl, 1-butenyl). The cyclic alkyl group represented by $R_5$ preferably contains 3 to 12 carbon atoms and more preferably 3 to 6 carbon atoms (e.g., cyclopentyl, cyclohexyl). The aralkyl group and the aryl group for $R_5$ preferably contains 7 to 18 carbon atoms and 6 to 12 carbon atoms, respectively (e.g., benzyl, phenethyl, phenyl, naphthyl). In the —$CONHR_8$ group for $R_5$, $R_8$ represents an alkyl group preferably having 1 to 18 carbon atoms (e.g., methyl, ethyl, n-propyl, n-butyl, tert-butyl, n-octyl, tert-octyl, n-nonyl, n-dodecyl, n-tetradecyl, n-heptadecyl, n-hexadecyl, n-octadecyl), an aryl group preferably having 6 to 12 carbon atoms (e.g., phenyl, naphthyl), an alkylthio group preferably having 1 to 3 carbon atoms (e.g., methylthio, ethylthio), an arylthio group preferably having 6 to 12 carbon atoms (e.g., phenylthio), an alkylsulfonyl group preferably having 1 to 18 carbon atoms (e.g., butylsulfonyl, hexylsulfonyl), an arylsulfonyl group preferably having 6 to 12 carbon atoms (e.g., phenyl sulfonyl), an alkylsulfinyl group preferably having 1 to 18 carbon atoms (e.g., butylsulfinyl, hexylsulfinyl), or an arylsulfinyl group preferably having 6 to 12 carbon atoms (e.g., phenylsulfinyl). The heterocyclic group for $R_5$ preferably contains 3 to 12 carbon atoms and one or more heteroatoms (e.g., N, S, O) and those of 5- or 6-membered ring are preferred. These alkyl, alkenyl, cyclic alkyl, aralkyl, aryl and heterocyclic groups may contain substituents. Such substituents may be selected from the group consisting of halogen atom, nitro, cyano, thiocyano, aryl, alkoxy, aryloxy, carboxy, sulfoxy, alkylcarbonyl, arylcarbonyl, alkoxycarbonyl, aryloxycarbonyl, sulfo, acyloxy, sulfamoyl, carbamoyl, acylamino, diacylamino, ureide, thioureide, urethane, thiourethane, sulfonamide, heterocyclic group, arylsulfonyloxy, alkylsulfonyloxy, arylsulfonyl, alkylsulfonyl, arylthio, alkylthio, alkylsulfinyl, arylsulfinyl, alkylamino, dialkylamino, anilino, N-alkylanilino, N-arylanilino, N-acylamino, hydroxy and mercapto groups.

The alkyl group for $R_6$ or $R_7$ in the general formula (II) preferably contains 1 to 18 carbon atoms and more preferably 1 to 9 carbon atoms (e.g., methyl, ethyl, iso-propyl, n-propyl, n-butyl, sec-butyl, tert-butyl, n-hexyl). The cyclic alkyl group for $R_6$ or $R_7$ preferably contains 3 to 12 carbon atoms and more preferably 3 to 6 carbon atoms (e.g., cyclopentyl, cyclohexyl). The halogen atom for $R_6$and $R_7$ is preferably Cl or Br. The aryl or arylthio group for $R_6$ and $R_7$ preferably contains 6 to 12 carbon atoms (e.g., phenyl, naphthyl, phenylthio), and the alkylthio, alkylsulfoxide, alkylsulfinyl or alkylsulfonyl group for $R_6$ and $R_7$ preferably contains 1 to 3 carbon atoms (e.g., methylthio, ethylthio, methylsulfoxide, methylsulfinyl, methylsulfonyl). The heterocyclic group for $R_6$ and $R_7$ are preferably those described for $R_5$. These alkyl, cyclic alkyl and aryl groups may contain substituents. Examples of such substituents include a halogen atom, a nitro group, a sulfo group, an aryl group and a hydroxy group.

The alkyl group for $R_9$, $R_{10}$ or $R_{11}$ in the general formula (III) preferably contains 1 or 2 carbon atoms. The halogen atom for $R_9$ $R_{10}$ or $R_{11}$ are preferably Cl or Br.

In the general formula (IV), $R_{12}$ represents a hydrogen atom, an alkyl group preferably having 1 to 3 carbon atoms (e.g., methyl, ethyl) or an aryl group preferably having 6 to 12 carbon atoms (e.g., phenyl, naphthyl), and $R_{13}$ represents a hydrogen atom, an alkyl group (e.g., methyl, ethyl), an aryl group preferaably having 6 to 12 carbon atoms (e.g., phenyl, naphthyl), a nitro group, a carboxy group, a sulfo group, a sulfamoyl group, a hydroxy group, a halogen atom, an alkoxy group preferably having 1 to 6 carbon atoms exemplified with those described for $R_2$, or a thiazolyl group. $R_{12}$ preferably represents a hydrogen atom, and $R_{13}$ preferably represents an alkyl group having 1 to 3 carbon atoms, an amino group, a nitro group, a sulfo group, a halogen atom or a hydroxy group. The suffix m is preferably 0. The thiazolyl ring represented by Z is preferably

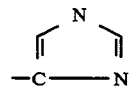

In the general formula (V), X represents a halogen atom, an alkyl group, a cycloalkyl group, an aryl group, a carboxy group, an amino group, a hydroxy group, a sulfo group, a nitro group or an alkoxycarbonyl groups. The halogen atom represented by X is preferably Cl, Br or I. The alkyl group for X is preferably a staight-chain or branched alkyl group having 1 to 8 carbon atoms such as those exemplified for $R_2$. The cycloalkyl group for X is preferably a cycloalkyl group having 4 to 8 carbon atoms (e.g., cyclopentyl, cyclohexyl). The aryl group for X is preferably a phenyl or naphthyl group. The alkoxycarbonyl group for X is preferably an alkoxycarbonyl group having 2 to 6 carbon atoms (e.g., butoxycarbonyl, ethoxycarbonyl, propoxycarbonyl). These substituents may be substituted by an alkyl group of 1 to 4 carbon atoms, a halogen atom, a hydroxyl group, a sulfo group, a nitro group, an amino group, cyano group, carboxyl group or phenyl group.

In the general formula (V), the alkyl group for M preferably contains 1 to 4 carbon atoms (e.g., ethyl, propyl) and the alkaline metal for M is preferably Na or K.

Preferred among the compounds represented by the general formula (V) are compounds represented by the general formulas (V-A), (V-B), (V-C) and (V-D):

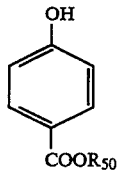

(V-A)

wherein $R_{50}$ represents an alkyl group having 1 to 5 carbon atoms,

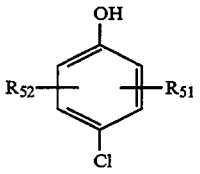

(V-B)

wherein $R_{51}$ and $R_{52}$, which may be the same or different, each represents a hydrogen atom, halogen atom or an alkyl group having 1 to 5 carbon atoms, particularly a chlorine atom or methyl group,

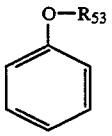

(V-C)

wherein $R_{53}$ represents a hydroxy-substituted alkyl group, preferably containing 1 to 3 carbon atoms such as a 2-hydroxyethyl group,

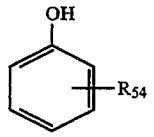

(V-D)

wherein $R_{54}$ represents a cycloalkyl group or an aryl group, particularly a cyclohexyl group or a phenyl group.

As a result of intensive studies, the inventors found a surprising fact that the remarkable fluctuation in the photographic properties and the production of a large amount of suspended matter occurred when the processing is effected with a remarkably small supply amount of a color developing solution are caused by preservatives incorporated in the light-sensitive material to be processed.

The inventors further found that these anti-bacterial agents accelerate the deterioration of the developing solution. It was an unexpected fact that the preservatives incorporated in the light-sensitive material disable the processing of a light-sensitive material when a small supply amount of a color developing solution is used.

It has been known that preservatives may be incorporated in a hydrophilic colloid-containing solution at any step in the preparation of a photographic light-sensitive material in order to inhibit the decomposition of the hydrophilic colloid by bacteria, fungi or yeast. As such preservatives there are commonly known unsubstituted phenol, formaldehyde, paraformaldehyde, glutaraldehyde, methylolchloroaldehyde, benzoic acid, phenyl mercury, mercury phenylpropionate, neomicine, and canamicine. Among these compounds, some compounds such as unsubstituted phenol are widely used in the field of photography.

When a color light-sensitive material comprising such a preservative as unsubstituted phenol is continuously processed with a normal supply amount of a color developing solution, it causes no problems. However, it was found that the above described problems appear only when the supply amount of the color developing solution is considerably reduced to 20 to 120 ml per 1 $m^2$ of light-sensitive material. It can be believed that a remarkably large amount of bacteria and preservatives accumulated due to the processing with a small supply amount of the color developing solution causes inhibition of color development, inhibition of development, acceleration of deterioration of developing agent or ageing which result in the production of suspended matter that essentially causes the above described problems.

However, it is very difficult to exclude preservatives etc. from the components of the photographic light-sensitive material because they are used to inhibit the decomposition of a hydrophilic colloid incorporated in the photographic light-sensitive material by bacteria, fungi and ferment as described above.

As a result of further intensive studies, the inventors found that the use of compounds represented by the general formulas (I), (II), (III), (IV), and (V) provides an excellent preservation effect and enables the remarkable reduction in the fluctuation in the photographic properties due to the continuous processing even when the supply amount of the color developing solution is considerably reduced. Furthermore, it was also found that the use of such compounds gives a reduction in the deterioration of the color developing solution and eliminates the production of suspended matter, enabling a remarkable reduction in the supply amount of the color developing solution. It was a surprising fact that among many known preservatives, compounds represented by the general formulas (I), (II), (III), (IV), and (V) uniquely exhibit such effects.

It has been known that the compounds represented by the general formulas (I), (II), (III), (IV), and (V) may be incorporated in a photographic light-sensitive material as a preservative for the hydrophilic colloid for silver halide photographic material. Examples of the compound of the general formula (I) are described in JP-A-54-27424, JP-A-59-131929, and JP-A-59-142543, and *Research Disclosure* Nos. 17146, and 22875. Examples of the compound of the general formula (II) are described in JP-A-58-166343, JP-A-59-131929, JP-A-59-142543, JP-A-59-226343, JP-A-59-226344, and JP-A-59-228247. Examples of the compound of the general formula (III) are described in JP-A-60-119547, and JP-A-62-231956. Examples of the compound of the general formula (IV) are described in JP-A-60-263938. Examples of the compound of the general formula (V) are described in JP-A-59-22847. The disclosure of each of these references is incorporated herein by reference.

However, these references do not refer to continuous processing at all, not to speak of troubles caused by a remarkable reduction in the supply amount of color developing solution and its resolution. Thus, the technique of the present invention had not been known at all.

Specific typical examples of the compound of general formula (I) will be shown hereinafter, but the present invention should not be construed as being limited thereto.

Exemplary compounds

I-1

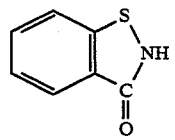

I-2

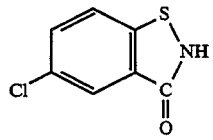

I-3

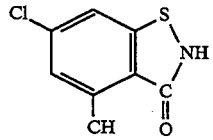

I-4

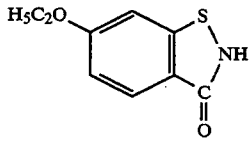

I-5

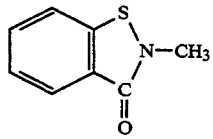

-continued

Exemplary compounds

I-6

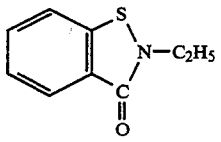

I-7

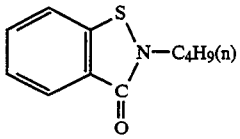

I-8

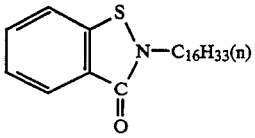

These exemplary compounds are commonly known. Some of these compounds are commercially available from I.C.I. Japan Co., Ltd. and Dainippon Ink And Chemicals, Incorporated.

Specific typical examples of the compounds of general formula (II) will be shown hereinafter, but the present invention should not be construed as being limited thereto.

Exemplary compounds

II-1

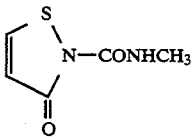

II-2

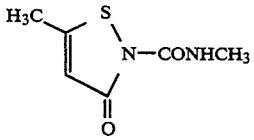

II-3

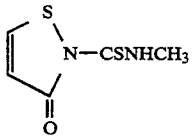

II-4

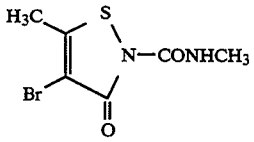

II-5

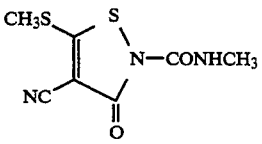

-continued

Exemplary compounds

II-6

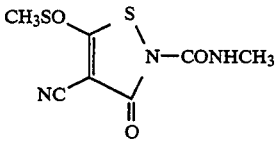

II-7

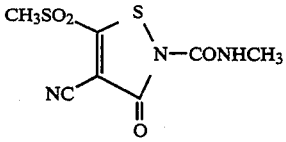

II-8

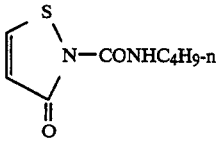

II-9

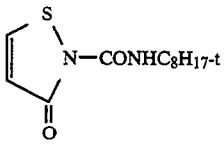

II-10

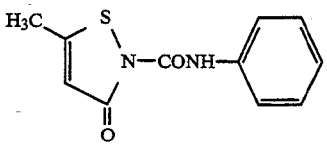

II-11

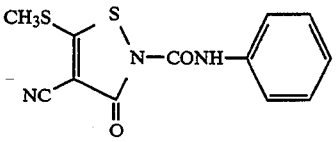

II-12

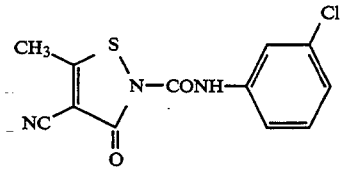

II-13

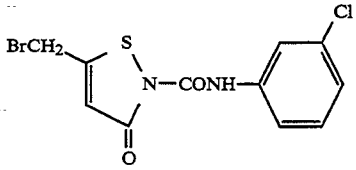

II-14

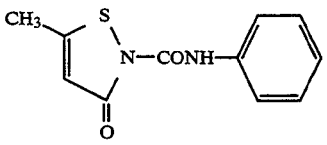

II-15

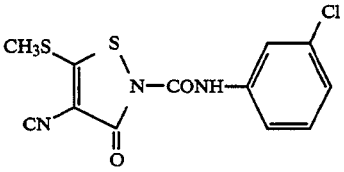

-continued
Exemplary compounds
II-16
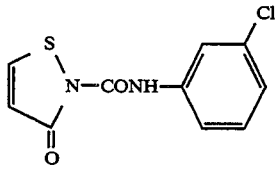
II-17
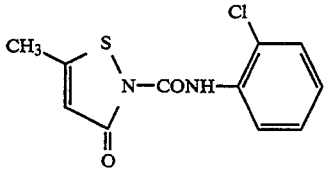
II-18
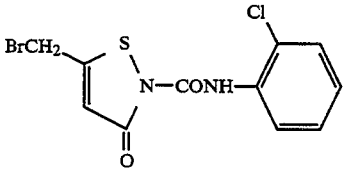
II-19
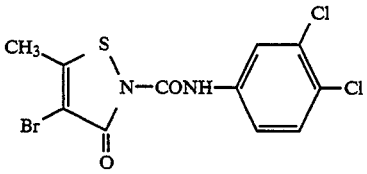
II-20
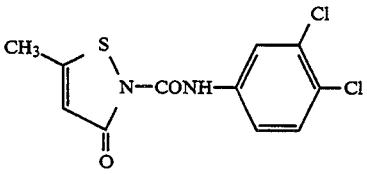
II-21
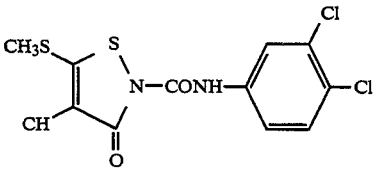
II-22
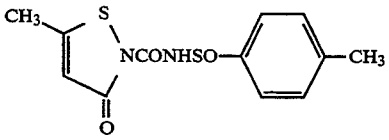
II-23
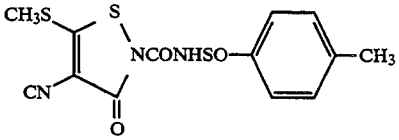
II-24
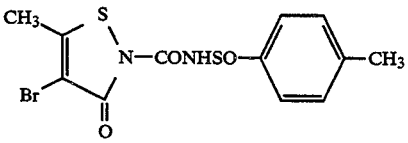
-continued
Exemplary compounds
II-25
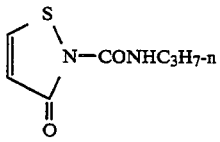
II-26
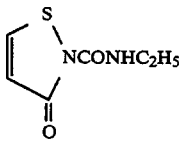
II-27
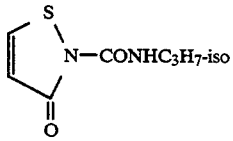
II-28
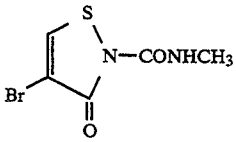
II-29
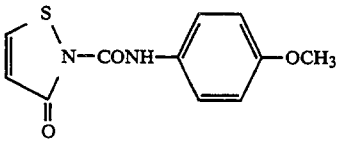
II-30
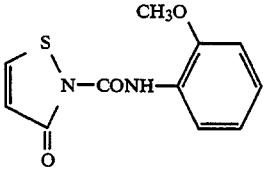
II-31
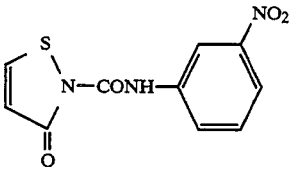
II-32
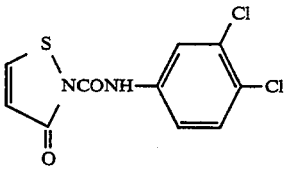
II-33
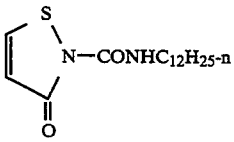
II-34
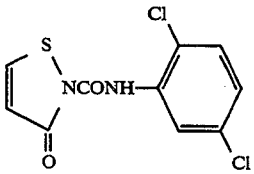

-continued
Exemplary compounds
II-35
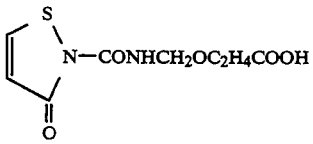
II-36
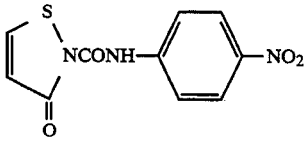
II-37
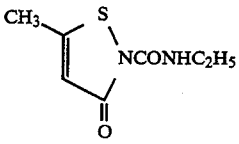
II-38
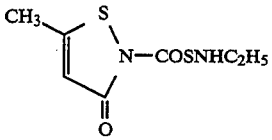
II-39
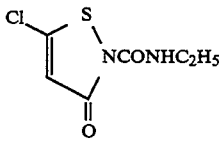
II-40
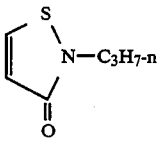
II-41
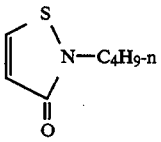
II-42
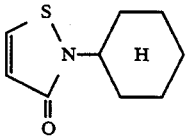
II-43
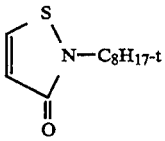
II-44
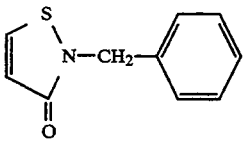
-continued
Exemplary compounds
II-45
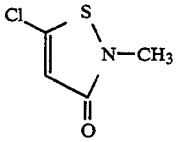
II-46
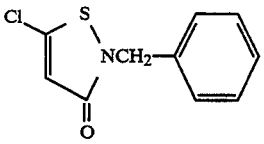
II-47
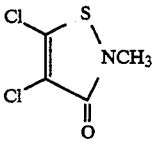
II-48
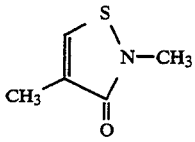
II-49
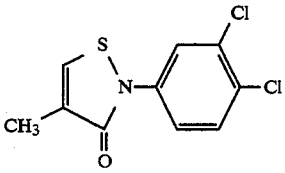
II-50
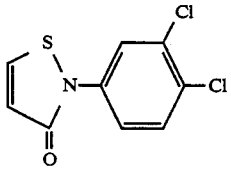
II-51
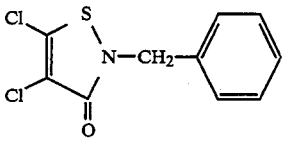
II-52
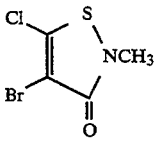
II-53
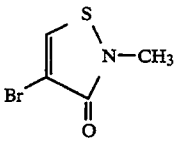
II-54
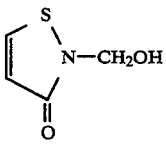

-continued
Exemplary compounds
II-55
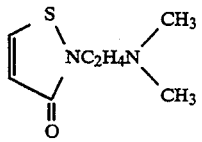
II-56
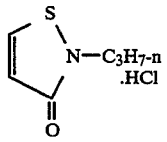
II-57
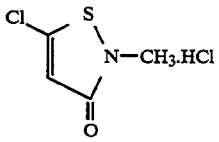
II-58
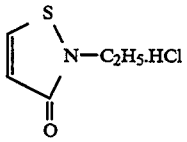
II-59
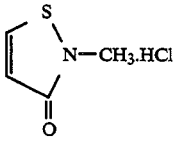
II-60
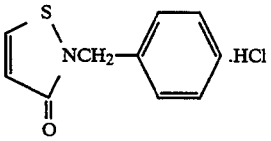
II-61
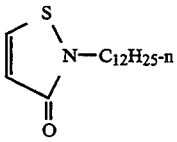
II-62
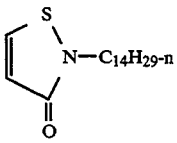
II-63
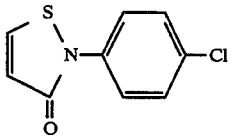
II-64
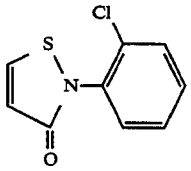
-continued
Exemplary compounds
II-65
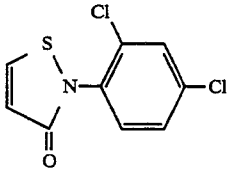
II-66
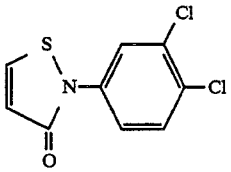
II-67
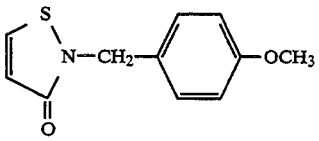
II-68
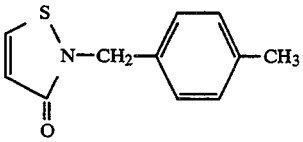
II-69
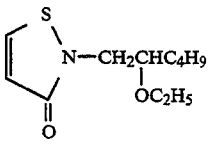
II-70
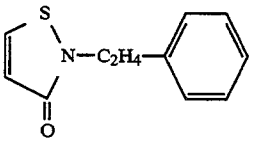
II-71
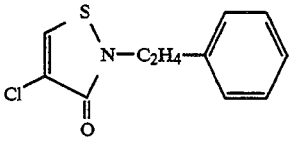
II-72
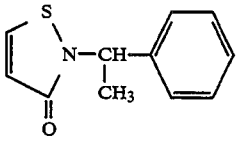
II-73
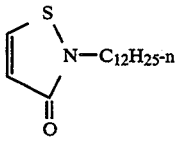
II-74
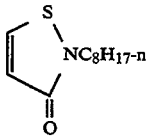

-continued

Exemplary compounds

II-75

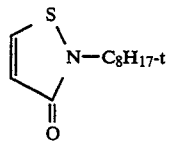

II-76

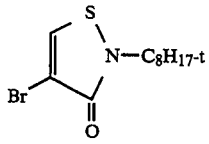

II-77

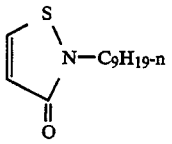

II-78

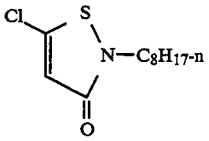

II-79

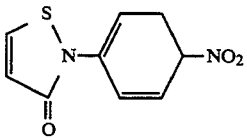

II-80

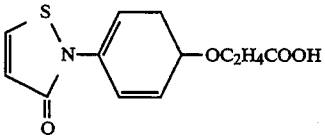

II-81

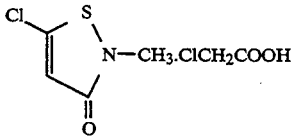

II-82

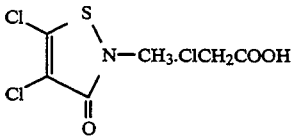

II-83

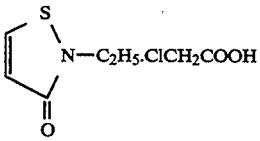

II-84

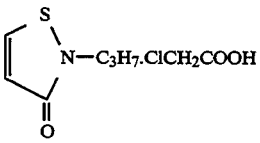

-continued

Exemplary compounds

II-85

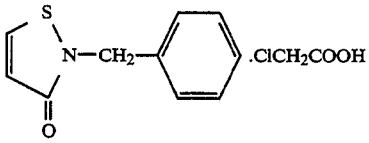

Examples of methods for the synthesis of these exemplary compounds are described in French Patent 1,555,416. Part of these compounds are commercially available from Rome & Hass, Japan.

Specific typical examples of the compound of the general formula (III) will be shown hereinafter, but the present invention should not be construed as being limited thereto.

Exemplary compounds

III-1

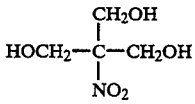

III-2

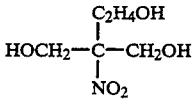

III-3

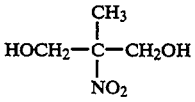

III-4

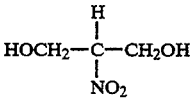

III-5

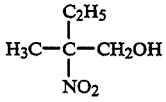

III-6

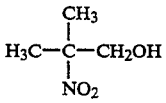

III-7

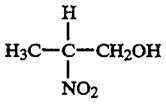

III-8

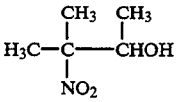

III-9

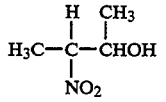

III-10

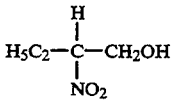

-continued

Exemplary compounds

III-11

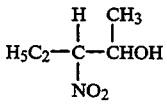

III-12

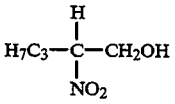

III-13

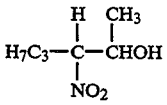

III-14

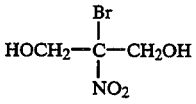

III-15

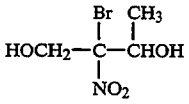

These compounds can be synthesized in accordance with the processes described in E. Schmidt, R. Wiikendorf, "Berichte der Deutschen Chemischen Geselshaft", 52, 392 (1919), B. M. Vanderbiit, H. B. Haas, "Ind. Eng. Chem.", 32, 34 (1940), I. M. Gorsky, S. P. Makarow, "Berichte der Deutchen Chemischen Geselschaft", 67, 996 (1934).

Specific typical examples of the compound of the general formula (IV) are described hereinafter, but the present invention should not be construed as being limited thereto.

Exemplary compounds

IV-1

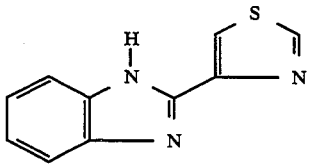

IV-2

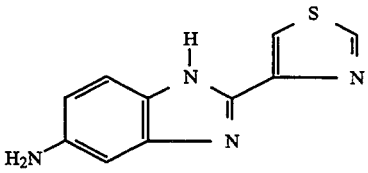

IV-3

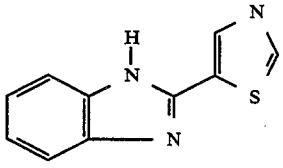

IV-4

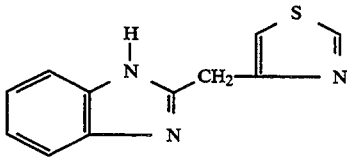

-continued

Exemplary compounds

IV-5

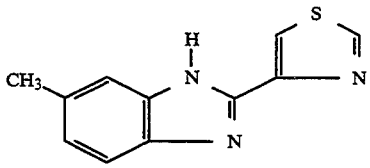

IV-6

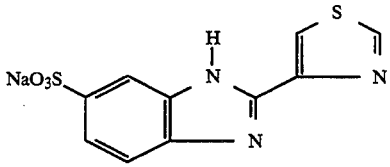

IV-7

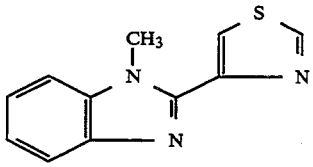

IV-8

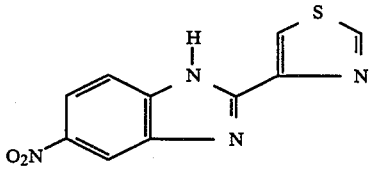

IV-9

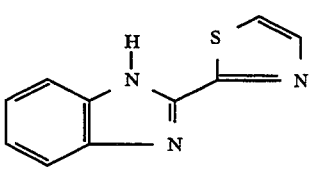

IV-10

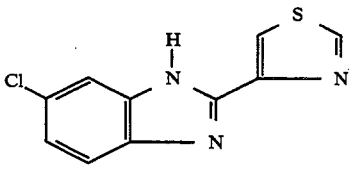

IV-11

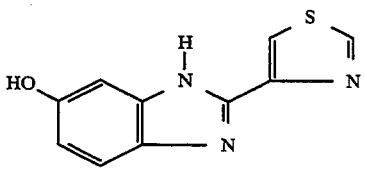

These exemplary compounds are commonly known. Part of these compounds are commercially available from Hokko Kagaku Kogyo K.K., Sanai Sekiyu K.K., and Shinto Toryo K.K.

Specific typical examples of the compound of the general formula (V) will be shown hereinafter, the present invention should not be construed as being limited thereto.

Exemplary compounds
V-1
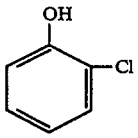
V-2
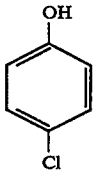
V-3
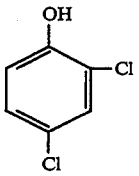
V-4
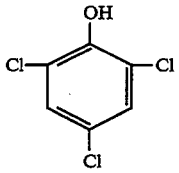
V-5
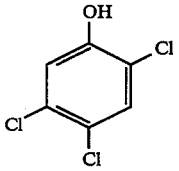
V-6
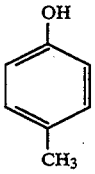
V-7
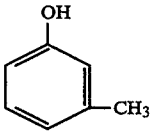
V-8
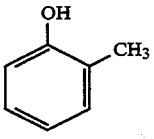
V-9
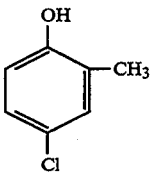
-continued
Exemplary compounds
V-10
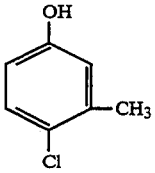
V-11
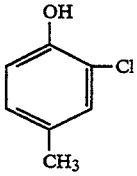
V-12
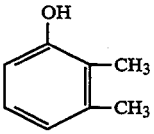
V-13
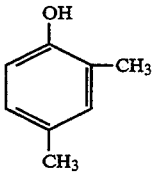
V-14
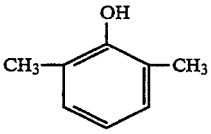
V-15
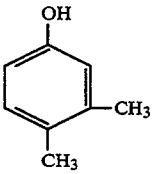
V-16
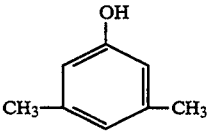
V-17
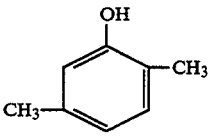
V-18
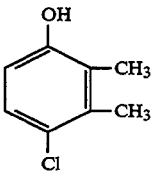

-continued
Exemplary compounds
V-19
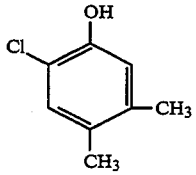
V-20
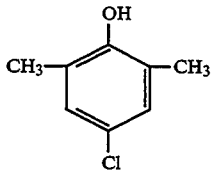
V-21
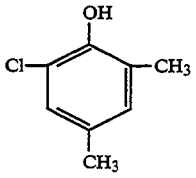
V-22
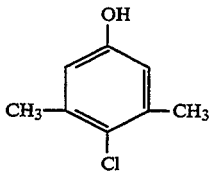
V-23
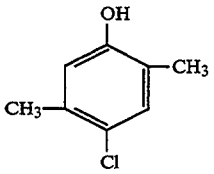
V-24
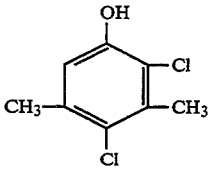
V-25
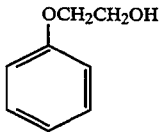
V-26
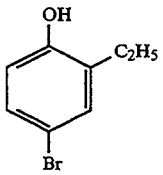
V-27
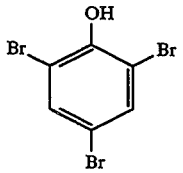
-continued
Exemplary compounds
V-28
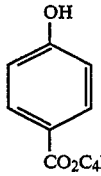
V-29
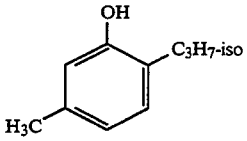
V-30
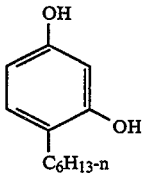
V-31
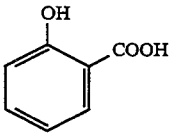
V-32
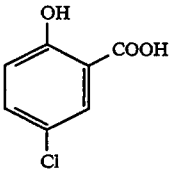
V-33
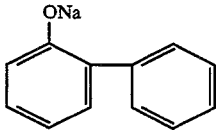
V-34
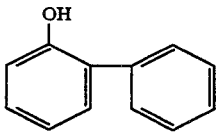
V-35
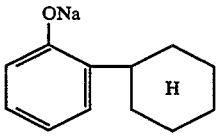
V-36
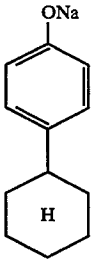

-continued

Exemplary compounds

V-37

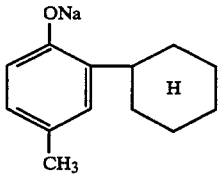

V-38

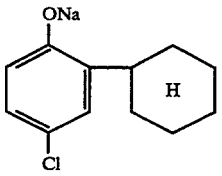

V-39

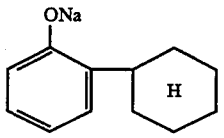

V-40

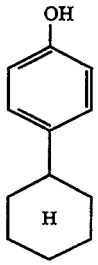

V-41

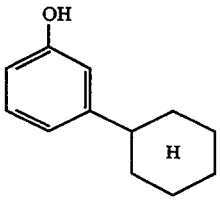

V-42

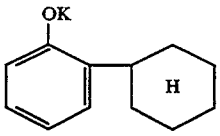

V-43

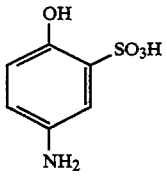

V-44

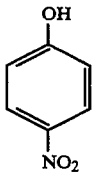

These exemplary compounds are commercially available.

In the present invention, among the compounds of the general formulas (I), (II), (III), (IV) and (V), even more preferred compounds are I-1, II-1, II-40, II-45, II-47, II-48, III-1, III-3, III-14, III-15, IV-1, IV-5, V-2, V-4, V-22, V-25, V-28, V-33, and V-35. Particularly preferred among these compounds are I-1, II-45, III-14, IV-1, V-25, V-33, and V-35.

In the present invention, the compounds of the general formulas (I), (II), (III), (IV) and (V) may be applied to any of the various layers constituting the light-sensitive material comprising a hydrophilic colloid such as silver halide emulsion layer, underlayer, interlayer, filter layer, antihalation layer and protective layer.

In the production process, if these layers are prepared from a mixture of two or more solutions, these compounds may be incorporated in these solutions.

In the present invention, the compounds of the general formulas (I), (II), (III), (IV) and (V) may be used singly or in combination, and it is preferred that the compounds of the general formulas (I) and (V) be used in combination.

In the present invention, the amount of the compounds of the general formulas (I), (II), (III), (IV) and (V) to be incorporated is preferably in the range of 10 to 10,000 ppm, particularly 100 to 1,000 ppm based on the amount of hydrophilic colloid.

In the present invention, the compound of the general formula (I), (II), (III), (IV) or (V) may be incorporated in a hydrophilic colloid to be coated on a protective layer in the form of a solution in a solvent which doesn't adversely affect the photographic properties, e.g., water or organic solvents such as methanol, isopropanol, acetone and ethylene glycol, or may be emulsion dispersed in the presence of a surface active agent in the form of a solution in a high boiling solvent or low boiling solvent or a mixture thereof and then incorporated in a hydrophilic colloid-containing solution to be coated on a protective layer.

The supply amount of the color developing solution in the present invention (20 to 120 ml per 1 $m^2$ of silver halide light-sensitive material) will be further described hereinafter.

The reduction of the supply amount of the developing solution to 120 ml per 1 $m^2$ of light-sensitive material or less was infeasible in the prior art due to the above described difficulties and is made feasible by the present invention. The value of 120 ml/$m^2$ lies at the boundary between the range feasible only by the present invention and the range feasible by a combination of the conventional techniques. If the supply amount of the developing solution is 20 ml or less per 1 $m^2$ of light-sensitive material, the amount of the processing solution carried away by the light-sensitive material exceeds the supply amount. This reduces the amount of the processing solution in the tank, disabling the continuous processing. The value of 20 ml per 1 $m^2$ of light-sensitive material (this value varies depending on the light-sensitive material) is such that the amount of the processing solution carried by the light-sensitive material substantially equals the supply amount.

The color developing solution to be used in the present invention will be further described hereinafter.

The present invention is preferably implemented by the use of a developing solution substantially free of benzyl alcohol in the light of stability of photographic properties against processing and inhibition of generation of suspended matter. The term "developing solution substantially free of benzyl alcohol" as used herein means a developing solution containing benzyl alcohol in an amount of 2 ml/l or less, preferably 0.5 ml/l or less, particularly no benzyl alcohol.

The developing solution to be used in the present invention is preferably substantially free of sulfinic acid ions in the light of stability of photographic properties against processing. The term "developing solution substantially free of sulfinic acid ions" as used herein means a developing solution containing sulfinic acid ions in an amount of preferably $5.0\times10^{-3}$ mol/l or less, particularly no sulfinic acid ions. However, in the present invention, this doesn't apply to a slight amount of sulfinic acid ions to be used for inhibition of oxidation of a processing agent kit comprising a concentrated developing agent before preparation.

The developing solution to be used in the present invention is preferably substantially free of hydroxylamine in the light of stability of photographic properties against processing. The term "developing solution substantially free of hydroxylamine" as used herein means a developing solution containing hydroxylamine in an amount of $1.0\times10^{-2}$ mol/l or less, particularly no hydroxylamine.

The developing solution to be used in the present invention may preferably contain an organic preservative instead of the above described hydroxylamine or sulfinic acid ions in the light of stability of photographic properties against processing and inhibition of deterioration of developing agent.

Such an organic preservative is an organic compound which can be added to a processing solution for a color photographic light-sensitive material to reduce the speed of deterioration in an aromatic primary amine color developing agent. In particular, an organic compound which serves to inhibit oxidation of a color developing agent by air. Particularly useful examples of such organic preservatives include substituted hydroxylamines (i.e., except unsubstituted hydroxylamine), hydroxamic acids, hydrazines, hydrazides, phenols, α-hydroxyketones, α-aminoketones, saccharides, monoamines, diamines, polyamines, quaternary ammonium salts, nitroxy radicals, alcohols, oxims, diamide compounds, and condensed ring amines. These compounds are disclosed in Japanese Patent Application Nos. 61-147823, 61-173595, 61-165621, 61-188619, 61-197760, 61-186561, 61-198987, 61-201861, 61-186559, 61-170756, 61-188742, and 61-188741, U.S. Pat. Nos. 3,615,503, and 2,494,903, JP-A-52-143020, and JP-B-48-30496 (the term "JP-B" as used herein means an "examined Japanese patent publication").

The general formula and specific examples of the above described preferred organic preservatives will be described hereinafter, but the present invention should not be construed as being limited thereto.

The amount of such a compound to be incorporated in the color developing solution is in the range of 0.005 to 0.5 mol/l, preferably 0.03 to 0.1 mol/l.

As substituted hydroxy/amine there may be preferably used the following compounds:

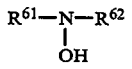

wherein $R^{61}$ and $R^{62}$ each represents a hydrogen atom, a substituted or unsubstituted alkyl group, a substituted or unsubstituted alkenyl group, a substituted or unsubstituted aryl group or a heteroaromatic group. $R^{61}$ and $R^{62}$ do not represent a hydrogen atom at the same time. $R^{61}$ and $R^{62}$ may be connected to each other to form a heterocyclic ring with the nitrogen atom of the formula.

Such a heterocyclic group may be a 5- or 6-membered ring. Such a heterocyclic group may be formed of carbon, hydrogen, halogen, nitrogen and other atoms. Such a heterocyclic group may be saturated or unsaturated.

$R^{61}$ and $R^{62}$ each may be, e.g., an alkyl or alkenyl group. Such an alkyl or alkenyl group may preferably contain 1 to 10 carbon atoms, particularly 1 to 5 carbon atoms. Examples of the nitrogen-containing heterocyclic groups formed by the connected $R^{61}$ and $R^{62}$ include piperidyl group, pyrrolidyl group, N-alkylpiperadyl group, morpholyl group, indolynyl group, and benztriazole group.

Examples of preferred substituents for $R^{61}$ and $R^{62}$ include a hydroxy group, an alkoxy group, an alkyl or arylsulfonyl group, an amide group, a carboxyl group, a cyano group, a sulfo group, a nitro group, and an amino group.

Examples of suitable hydroxy/amine are given below.

Exemplary compounds

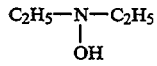
VI-1

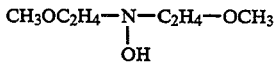
VI-2

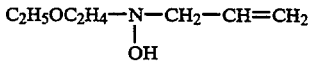
VI-3

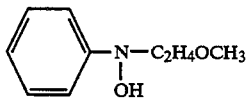
VI-4

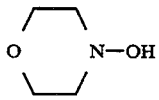
VI-5

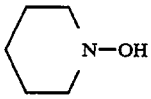
VI-6

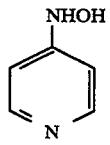
VI-7

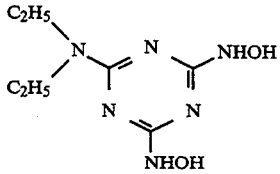
VI-8

As hydroxams there may be preferably used the following compounds:

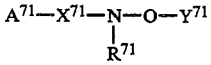
(VII)

wherein $A^{71}$ represents a hydrogen atom, a substituted or unsubstituted alkyl group, a substituted or unsubstituted aryl group, a substituted or unsubstituted amino group, a substituted or unsubstituted heterocyclic group, a substituted or unsubstituted alkoxy group, a substituted or unsubstituted aryloxy group, a substituted or unsubstituted carbamoyl group, a substituted or unsubstituted sulfamoyl group, an acyl group, a carboxy group, a hydroxyamino group or a hydroxyaminocarbonyl group. Examples of substituents for these groups include a halogen atom, an aryl group, an alkyl group and an alkoxy group.

Preferred among the groups represented by $A^{71}$ are substituted or unsubstituted alkyl, aryl, amino, alkoxy and aryloxy groups. Particularly preferred among these groups are substituted or unsubstituted amino, alkoxy and aryloxy groups. The number of carbon atoms contained in these groups is preferably 1 to 10.

$X^{71}$ represents $$-\underset{\underset{O}{\|}}{C}-,\quad -\underset{\underset{S}{\|}}{C}-,\quad SO_2-\quad \text{or}\quad -SO-,$$

preferably $$-\underset{\underset{O}{\|}}{C}-.$$

$R^{71}$ represents a hydrogen atom, a substituted or unsubstituted alkyl group or a substituted or unsubstituted aryl group. $A^{71}$ and $R^{71}$ may be connected to each other to form a cyclic structure. As substituents for $R^{71}$ there may be used those described with reference to $A^{71}$. $R^{71}$ preferably is a hydrogen atom.

$Y^{71}$ represents a hydrogen atom or a group which can be a hydrogen atom upon hydrolysis reaction.

Examples of suitable hydroxams are given below.

Exemplary compounds

VII-1

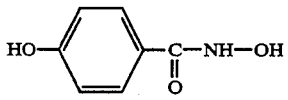

VII-2

$$CH_3-\underset{\underset{O}{\|}}{C}-NH-OH$$

VII-3

$$C_4H_9O-\underset{\underset{O}{\|}}{C}-NH-OH$$

VII-4

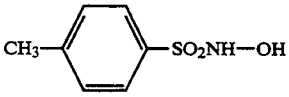

VII-5

$$CH_3-\underset{\underset{S}{\|}}{C}-\overset{\overset{CH_3}{|}}{N}-OH$$

VII-6

$$H_2N-\underset{\underset{O}{\|}}{C}-NH-OH$$

As hydrazines and hydrazides there may be preferably used the following compounds:

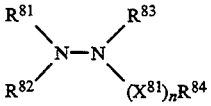

(VIII)

wherein $R^{81}$, $R^{82}$ and $R^{83}$ each independently represents a hydrogen atom, an alkyl group, an aryl group or a heterocyclic group; $R^{84}$ represents a hydrogen atom, a hydroxy group, a hydrazine group, an alkyl group, an aryl group, a heterocyclic group, an alkoxy group, an aryloxy group, a carbamoyl group or an amino group; $X^{81}$ represents a divalent group; and n represents an integer 0 or 1, with the proviso that when n is 0, $R^{84}$ represents an alkyl group, an aryl group or a heterocyclic group. $R^{83}$ and $R^{84}$ may together form a heterocyclic group.

The compound of the general formula (VIII) to be used in the present invention, i.e., analogous hydrazine compounds comprising hydrazines or hydrazides, will be further described hereinafter.

$R^{81}$, $R^{82}$ and $R^{83}$ each independently represents a hydrogen atom, a substituted or unsubstituted alkyl group (preferably an alkyl group having 1 to 20 carbon atoms, e.g., methyl, ethyl, sulfopropyl, carboxybutyl, hydroxyethyl, cyclohexyl, benzyl, phenethyl), a substituted or unsubstituted aryl group (preferably an aryl group having 6 to 20 carbon atoms, e.g., phenyl, 2,5-dimethoxyphenyl, 4-hydroxyphenyl, 2-carboxyphenyl), or a substituted or unsubstituted heterocyclic group (preferably a 5- or 6-membered heterocyclic group containing 1 to 20 carbon atoms and as a hetero atom at least one of oxygen, nitrogen and sulfur, e.g., pyridine-4-yl, N-acetylpiperidine-4-yl).

$R^{84}$ represents a hydrogen atom, a hydroxy group, a substituted or unsubstituted hydrazino group (e.g., hydrazino, methylhydrazino, phenylhydrazino), a substituted or unsubstituted alkyl group (preferably an alkyl group having 1 to 20 carbon atoms, e.g., methyl, ethyl, sulfopropyl, carboxybutyl, hydroxyethyl, cyclohexyl, benzyl, t-butyl, n-octyl), a substituted or unsubstituted aryl group (preferably an aryl group having 6 to 20 carbon atoms, e.g., phenyl, 2,5-dimethoxyphenyl, 4-hydroxyphenyl, 2-carboxyphenyl, 4-sulfophenyl), a substituted or unsubstituted heterocyclic group (preferably a 5- or 6-membered ring containing 1 to 20 carbon atoms and as a hetero atom at least one of oxygen, nitrogen and sulfur, e.g., pyridine-4-yl, imidazolyl), a substituted or unsubstituted alkoxy group (preferably an alkoxy group having 1 to 20 carbon atoms, e.g., methoxy, ethoxy, methoxyethoxy, benzyloxy, cyclohexyloxy, octyloxy), a substituted or unsubstituted aryloxy group (preferably an aryloxy group having 6 to 20 carbon atoms, e.g., phenoxy, p-methoxyphenoxy, p-carboxyphenyl, p-sulfophenoxy), a substituted or unsubstituted carbamoyl group (preferably a carbamoyl group having 1 to 20 carbon atoms, e.g., unsubstituted carbamoyl, N,N-diethylcarbamoyl, phenylcarbamoyl) or a substituted or unsubstituted amino group (preferably an amino group having up to 20 carbon atoms, e.g., amino, hydroxy/amine, methylamino, hexylamino, methoxyethylamino, carboxyethylamino, sulfoethylamino, N-phenylamino, p-sulfophenylamino).

As further substituents to be contained in $R^{81}$, $R^{82}$, $R^{83}$ and $R^{84}$ there may be preferably used a halogen atom (e.g., chlorine, bromine), a hydroxy group, a carboxy group, a sulfo group, an amino group, an alkoxy group, an amide group, a sulfonamide group, a carbamoyl group, a sulfamoyl group, an alkyl group, an aryl group, an aryloxy group, an alkylthio group, an arylthio group, a nitro group, a cyano group, a sulfonyl group, and a sulfinyl group. These groups may be further substituted.

$X^{81}$ preferably represents a divalent organic residual group. Specific examples of such a divalent organic residual group include —CO—, —$SO_2$— and $$-\overset{\overset{\displaystyle NH}{\|}}{C}-.$$

The suffix n represents 0 or 1. When n is 0, $R^{84}$ represents a group selected from a substituted or unsubstituted alkyl group, an aryl group and a heterocyclic group. $R^{81}$ and $R^{82}$, and $R^{83}$ and $R^{84}$ may together form a heterocyclic group.

When n is 0, at least one of $R^{81}$ to $R^{84}$ is preferably a substituted or unsubstituted alkyl group. In particular, $R^{81}$, $R^{82}$, $R^{83}$ and $R^{84}$ each is preferably a hydrogen atom or a substituted or unsubstituted alkyl group. However, $R^{81}$, $R^{82}$, $R^{83}$, and $R^{84}$ do not all represent a hydrogen atom at the same time. Particularly, $R^{81}$, $R^{82}$ and $R^{83}$ each is preferably a hydrogen atom and $R^{84}$ is preferably a substituted or unsubstituted alkyl group. Alternatively, $R^{81}$ and $R^{83}$ each is preferably a hydrogen atom and $R^{82}$ and $R^{84}$ each is preferably a substituted or unsubstituted alkyl group. Alternatively, $R^{81}$ and $R^{82}$ each is preferably a hydrogen atom and $R^{82}$ and $R^{84}$ each is preferably a substituted or unsubstituted alkyl group (wherein $R^{83}$ and $R^{84}$ may together form a heterocyclic group). When n is 1, $X^{81}$ preferably represents —CO—, $R^{84}$ preferably represents a substituted or unsubstituted amino group, and $R^{81}$ to $R^{83}$ each preferably represents a hydrogen atom or a substituted or unsubstituted alkyl group.

The alkyl group represented by $R^{81}$ to $R^{84}$ preferably contains 1 to 10 carbon atoms, particularly 1 to 7 carbon atoms. Preferred examples of substituents to be contained in such an alkyl group include a hydroxyl group, a carboxylic acid group, a sulfo group, and a phosphonic acid group. If the alkyl group contains two or more substituents, they may be the same or different.

The compound of the general formula (VIII) may form a bis compound, tris compound or polymer connected by any of $R^{81}$, $R^{82}$, $R^{83}$ and $R^{84}$.

Specific examples of the compound of the general formula (VIII) will be shown hereinafter, but the present invention should not be construed as being limited thereto.

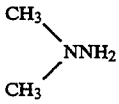
(VIII-1)

$CH_3NHNHCH_3$ (VIII-2)

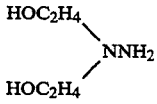
(VIII-3)

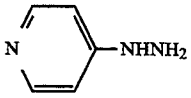
(VIII-4)

-continued

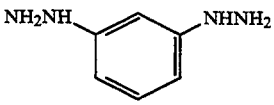
(VIII-5)

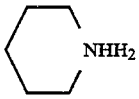
(VIII-6)

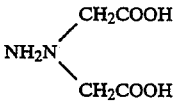
(VIII-7)

$HOOCCH_2NHNHCH_2COOH$ (VIII-8)

$NH_2NH(CH_2)_3NHNH_2$ (VIII-9)

$NH_2NHCH_2CH_2OH$ (VIII-10)

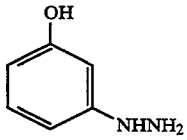
(VIII-11)

$NH_2NH—(CH_2)_3—SO_3H$ (VIII-12)

$NH_2NH—(CH_2)_4—SO_3H$ (VIII-13)

$NH_2NH—(CH_2)_3—COOH$ (VIII-14)

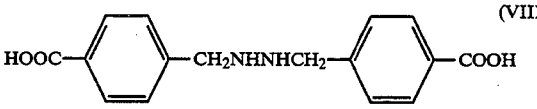
(VIII-15)

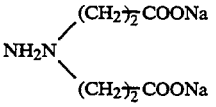
(VIII-16)

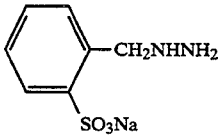
(VIII-17)

$NaOOCCH(CH_3)NHNHCH(CH_3)COONa$ (VIII-18)

$NH_2NHCH_2CH_2COONa$ (VIII-19)

$NH_2NHCH_2COONa$ (VIII-20)

$H_2NNHCH_2CH_2SO_3Na$ (VIII-21)

$H_2NNH(C_4H_9(n))CHCOOH$ (VIII-22)

$H_2NNH(C_6H_{13}(n))CHCOOH$ (VIII-23)

$H_2NN(C_4H_9(n))(CHCOOH)_2$ (VIII-24)

$H_2NN(CH_2CH_2SO_3Na)_2$ (VIII-25)

-continued $H_2NN(CH_2CH_2CH_2SO_3Na)_2$ (VIII-26)

$H_2NN(CH(C_2H_5)COOH)_2$ (VIII-27)

$H_2NNHCH(CH_3)COOH$ (VIII-28)

$H_2NN(CH_2CH_2OH)(CH_2COOH)$ (VIII-29)

$H_2NNHCH_2CH_2N(CH_3)_2$ (VIII-30)

$H_2NN(CH_2CH_2N(CH_3)_2)_2$ (VIII-31)

$(CH_2-N(NH_2)-CH_2CH_2)_n$ (VIII-32)

(Average molecular weight: approx. 4,000)

$(CH_2-CH)_x$ $(CH_2-CH(COOH))_y$ (VIII-33)

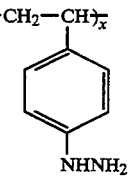

x:y = 60:40

(Average molecular weight: approx. 20,000)

$NH_2NHCONH_2$ (VIII-34)

$NH_2NHC(=NH)NH_2$ (VIII-35)

$NH_2NHCONHNH_2$ (VIII-36)

$NH_2NHSO_3H$ (VIII-37)

$NH_2NHSO_2NHNH_2$ (VIII-38)

$CH_3NHNHSO_2NHNHCH_3$ (VIII-39)

$NH_2NHCONH-(CH_2)_3-NHCONHNH_2$ (VIII-40)

(VIII-41)

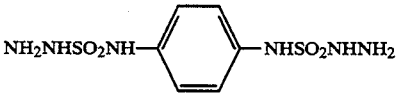

$NH_2NHCOCONHNH_2$ (VIII-42)

(VIII-43)

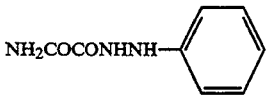

(VIII-44)

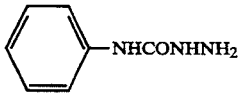

-continued (VIII-45)

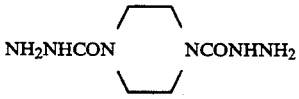

$NH_2COCONHNH_2$ (VIII-46)

(VIII-47)

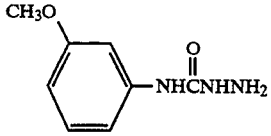

(VIII-48)

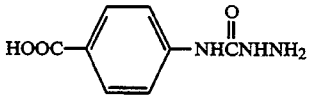

(VIII-49)

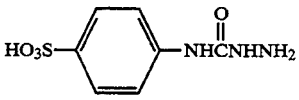

(VIII-50)

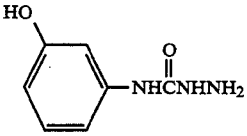

(VIII-51)

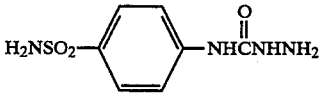

(VIII-52)

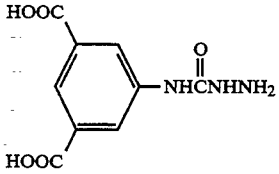

(VIII-53)

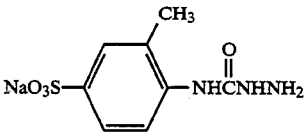

(VIII-54)

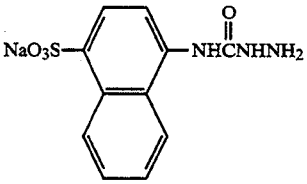

(VIII-55)

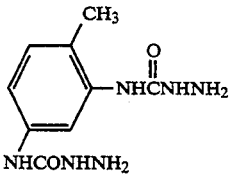

(VIII-56)

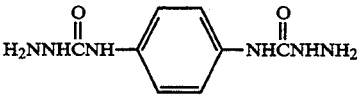

-continued

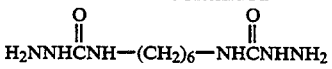
(VIII-57)

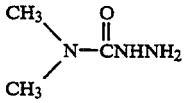
(VIII-58)

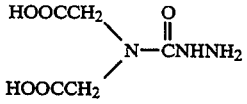
(VIII-59)

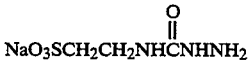
(VIII-60)

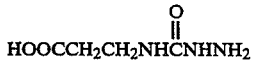
(VIII-61)

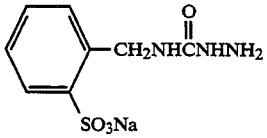
(VIII-62)

$NH_2NHCOOC_2H_5$ (VIII-63)

$NH_2NHCOCH_3$ (VIII-64)

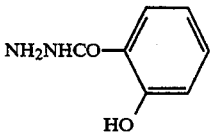
(VIII-65)

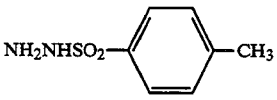
(VIII-66)

$NH_2NHCH_2PO_3H_2$ (VIII-67)

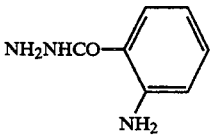
(VIII-68)

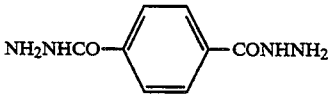
(VIII-69)

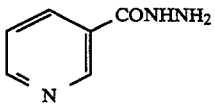
(VIII-70)

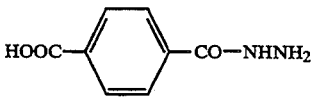
(VIII-71)

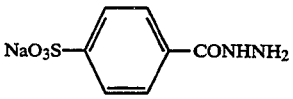
(VIII-72)

-continued $(CH_3)_3CCONHNH_2$ (VIII-73)

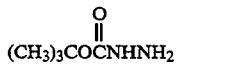
(VIII-74)

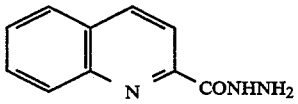
(VIII-75)

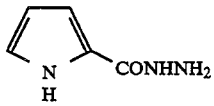
(VIII-76)

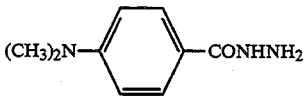
(VIII-77)

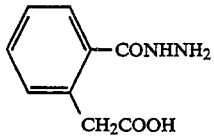
(VIII-78)

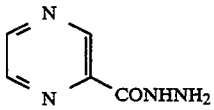
(VIII-79)

$HOCH_2CH_2SO_2NHNH_2$ (VIII-80)

$NaO_3SCH_2CH_2CONHNH_2$ (VIII-81)

$H_2NCONHCH_2CH_2SO_2NHNH_2$ (VIII-82)

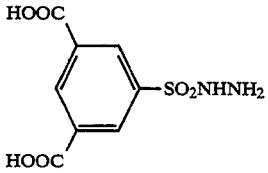
(VIII-83)

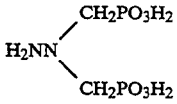
(VIII-84)

$H_2NNHCH_2CH_2PO_3H_2$ (VIII-85)

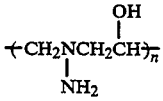
(VIII-86)

(Average molecular weight: approx. 1,000)

Other specific examples include compounds as described in Japanese Patent Application Nos. 61-170756 (p. 11 to 24), 61-171682 (p. 12 to 22), and 61-173468 (p. 9 to 19).

Most of the compounds represented by the general formula (VIII) are commercially available. The synthesis of these compounds can be accomplished by an ordinary synthesis process as described in "Organic Syntheses", Coll. Vol. 2, pp 208 to 213; "Jour. Amer. Chem. Soc.", 36, 1747 (1914); "Oil Chemistry", 24, 31 (1975); "Jour. Org. Chem.", 25, 44 (1960); "Yakugaku Zasshi", 91, 1127 (1971); "Organic Syntheses", Coll. Vol. 1, p 450; "Shin Jikken Kagaku Koza", Vol. 14, III, pp 1621 to 1628 (Maruzen); Beil., 2, 559; Beil., 3, 117; E. B. Mohr et al., "Inorg. Syn.", 4, 32 (1953); F. J. Wilson, E. C. Pickering "J. Chem. Soc.", 123, 394 (1923); N. J. Leonard, J. H. Boyer, "J. Org. Chem.", 15, 42 (1950); "Organic Syntheses", Coll. Vol. 5, p 1055; P. A. S. Smith, "Derivatives of hydrazine and other hydronitrogens having N-N-bonds", pp 120 to 124, pp 130 to 131 THE BENJAMIN/CUMMINGS COMPANY, (1983); Staniey R. Sandier Waif Karo, "Organic Functional group Preparation", Vol. 1, Second Edition, p 457.

Hydrazines or hydrazides represented by the general formula (VIII) may be incorporated in the color developing solution in an amount of preferably 0.01 to 50 g, more preferably 0.1 to 30 g, particularly 0.5 to 10 g per 1 l of color developing solution.

As phenols there may be preferably used the following compounds:

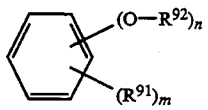

(IX)

wherein $R^{91}$ represents a halogen atom, an alkyl group, an aryl group, an alkoxy group, an aryloxy group, a carboxyl group, a sulfo group, a carbamoyl group, a sulfamoyl group, an amide group, a sulfonamide group, a ureido group, an alkylthio group, an arylthio group, a nitro group, a cyano group, an amino group, a formyl group, an acyl group, a sulfonyl group, an alkoxycarbonyl group, an aryloxycarbonyl group, an alkoxysulfonyl group or an aryloxysulfonyl group. If $R^{91}$ is further substituted, examples of such a substituent include a halogen atom, an alkyl group, an aryl group, a hydroxyl group, and an alkoxy group. If there are contained two or more $R^{91}$'s, they may be the same or different. If $R^{91}$'s are adjacent to each other, they may be connected to each other to form a ring. Such a ring may be a 5- or 6-membered saturated or unsaturated ring formed of carbon, hydrogen, halogen, oxygen, nitrogen, sulfur and other atoms.

$R^{92}$ represents a hydrogen atom or a hydrolyzable group. The suffix m and n each represents an integer 1 to 5.

$R^{91}$ and $R^{92}$ are not hydrogen atoms at the same time.

In the general formula (IX), $R^{91}$ preferably represents an alkyl group, a halogen group, an alkoxy group, an alkylthio group, a carboxyl group, a sulfo group, a carbamoyl group, a sulfamoyl group, an amino group, an amide group, a sulfonamide group, a nitro group or a cyano-group, particularly an alkoxy group, an alkylthio group, an amino group or a nitro group. These groups may be bonded to the ortho or para position of ($OR^{92}$) group. The number of carbon atoms contained in $R^{91}$ is preferably 1 to 10, particularly 1 to 6.

$R^{92}$ preferably represents a hydrogen atom or a hydrolyzable group having 1 to 5 carbon atoms. If there are contained two or more ($OR^{92}$) groups, they may be preferably oriented in the ortho or para position of each other.

Exemplary compounds

IX-1

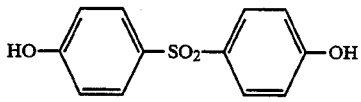

IX-2

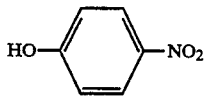

IX-3

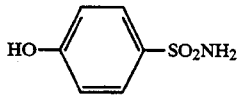

IX-4

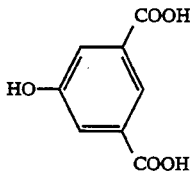

IX-5

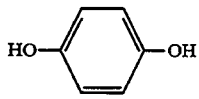

IX-6

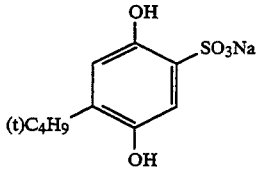

IX-7

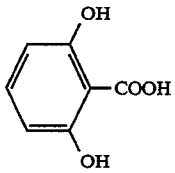

IX-8

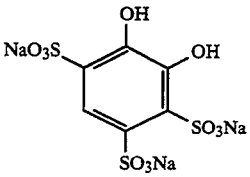

IX-9

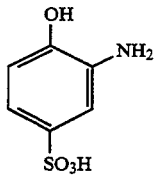

IX-10

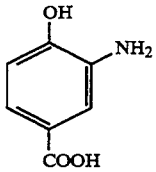

As α-hydroxyketones or α-aminoketones there may be preferably used the following compounds:

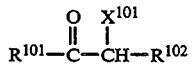

(X)

wherein $R^{101}$ represents a hydrogen atom, or a substituted or unsubstituted alkyl, aryl, alkoxy, aryloxy or amino group; and $R^{102}$ represents a hydrogen atom or a substituted or unsubstituted alkyl or aryl group. $R^{101}$ and $R^{102}$ may together form a carbon ring or a heterocyclic group. $X^{101}$ represents a hydroxyl group or a substituted or unsubstituted amino group.

In the general formula (X), $R^{101}$ preferably represents a hydrogen atom, an alkyl group, an aryl group or an alkoxy group, and $R^{102}$ preferably represents a hydrogen atom or an alkyl group.

Exemplary compounds

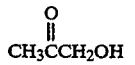

X-1

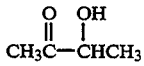

X-2

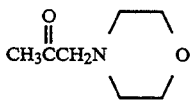

X-3

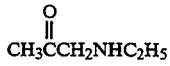

X-4

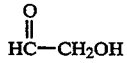

X-5

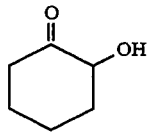

X-6

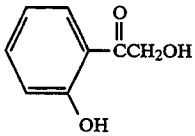

X-7

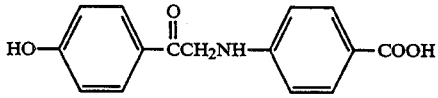

X-8

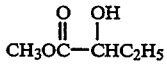

X-9

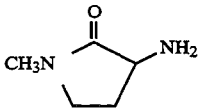

X-10

Monoaccharide are other preferred examples of organic preservatives.

Saccharides (also known as "carbohydrate") include monosaccharide and polysaccharide. Most saccharides have the general formula $C_nH_{2n}O_n$. Saccharide is a general term for aldehyde or ketone of polyvalent alcohol (i.e., aldose and ketonse, respectively), reduced derivatives, oxidized derivatives and dehydrated derivatives thereof, and other derivatives of wide range such as amino sugar and thio sugar. Polysaccharide is a general term for products of dehydration and condensation of two or more of these monosaccharides.

Further preferred among these saccharides are aldose containing reducing aldehyde group and derivatives thereof. Particularly preferred are the following monosaccharides:

XI-1: D-xylose
XI-2: L-arabinose
XI-3: D-ribose
XI-4: D-deoxyribose
XI-5: D-glucose
XI-6: D-galactose
XI-7: D-mannose
XI-8: Glucosamine
XI-9: L-sorbose
XI-10: D-sorbitol As monoamines there may be used the following compounds:

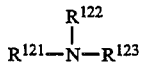

(XII)

wherein $R^{121}$, $R^{122}$ and $R^{123}$ each represents a hydrogen atom, an alkyl group, an alkenyl group, an aryl group, an aralkyl group or a heterocyclic group. $R^{121}$ and $R^{122}$, $R^{121}$ and $R^{123}$, or $R^{122}$ and $R^{123}$ may be connected to each other to form a nitrogen-containing heterocyclic group.

$R^{121}$, $R^{122}$ and $R^{123}$ may contain substituents. $R^{121}$, $R^{122}$ and $R^{123}$ each is preferably a hydrogen atom or an alkyl group. Examples of substituents which may be contained in $R^{121}$, $R^{122}$ and $R^{123}$ include a hydroxyl group, a sulfo group, a carboxyl group, a halogen atom, a nitro group, and an amino group.

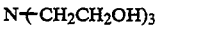

XII-1

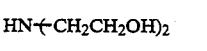

XII-2

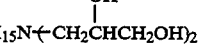

XII-3

XII-4

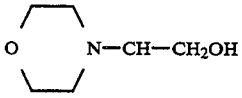

XII-5

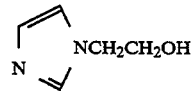

XII-6

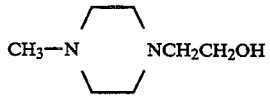

XII-7

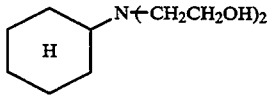

XII-8

-continued

XII-9

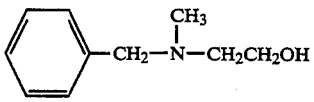

XII-10

$(HOCH_2CH_2)_2NCH_2CH_2SO_2CH_3$

XII-11

$HN(CH_2COOH)_2$

XII-12

$HOOCCH_2CH_2CH(NH_2)COOH$

XII-13

$H_2NCH_2CH_2SO_2NH_2$

XII-14

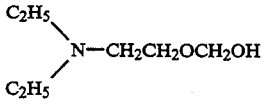

XII-15

$H_2N-C(H)(CH_2OH)_2$

XII-16

$HOCH_2CH(NH_2)COOH$

XII-17

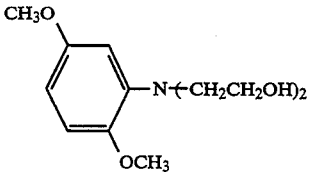

XII-18

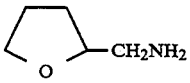

XII-19

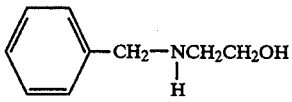

XII-20

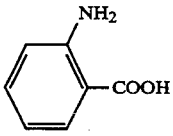

As diamides there may be preferably used the following compounds:

(XIII)

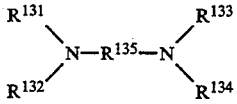

wherein $R^{131}$, $R^{132}$, $R^{133}$ and $R^{134}$ each represents a hydrogen atom, an alkyl group, an alkenyl group, an aryl group, an aralkyl group or a heterocyclic group.

$R^{135}$ represents a divalent organic group such as an alkylene, arylene, aralkylene, alkenylene or heterocyclic group.

$R^{131}$, $R^{132}$, $R^{133}$ and $R^{134}$ each is preferably a hydrogen atom or an alkyl group. $R^{135}$ is preferably an alkylene group.

XIII-1

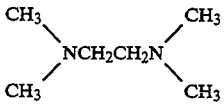

XIII-2

$(HOCH_2CH_2)_2NCH_2CH_2N(CH_2CH_2OH)_2$

XIII-3

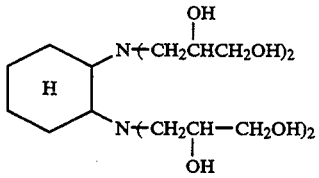

XIII-4

$H_2NCH_2CH_2N(CH_2CH_2OH)_2$

XIII-5

$H_2NCH_2CH(OH)CH_2NH_2$

XIII-6

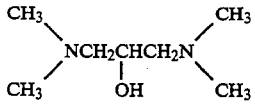

XIII-7

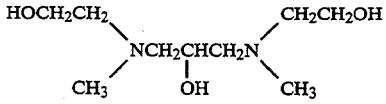

XIII-8

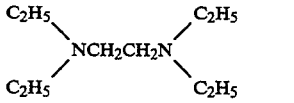

XIII-9

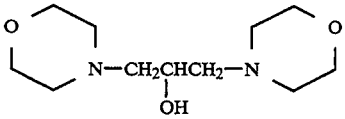

XIII-10

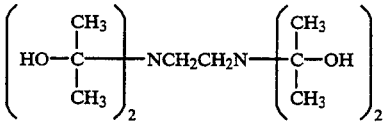

XIII-11

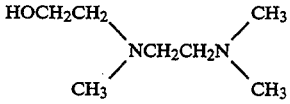

As polyamines there may be preferably used the following compounds:

(XIV)

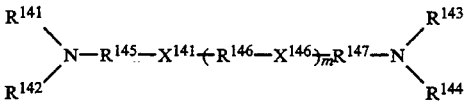

wherein $R^{141}$, $R^{142}$, $R^{143}$ and $R^{144}$ each represents a hydrogen atom, an alkyl group, an alkenyl group, an aryl group, an aralkyl group or a heterocyclic group.

$R^{145}$, $R^{146}$ and $R^{147}$ each represents a divalent organic group having the same meaning as $R^{135}$ in the general formula (XIII).

$X^{141}$ and $X^{142}$ each represents $$-\overset{\overset{\displaystyle R^{148}}{|}}{N}-,$$

—O—, —S—, —CO—, —$SO_2$—, —SO— or a connecting group formed of combination these connecting groups. $R^{148}$ has the same meaning as $R^{141}$, $R^{142}$, $R^{143}$ and $R^{144}$. The suffix m represents an integer 0 or more. (The upper limit of m is not specifically limited. The present compound may be a high molecular compound so far as it is water-soluble. However, m is preferably in the range of 1 to 3.)

XIV-1

$$H_2NCH_2CH_2\overset{\overset{\displaystyle CH_3}{|}}{N}CH_2CH_2NH_2$$

XIV-2

$$(HOCH_2CH_2)_2NCH_2CH_2OCH_2CH_2N(CH_2CH_2OH)_2$$

XIV-3

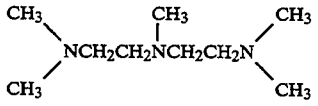

XIV-4

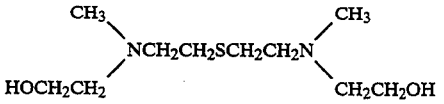

XIV-5

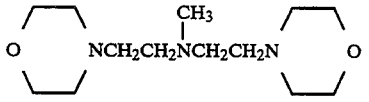

XIV-6

$$H_2N(CH_2CH_2NH)_nH$$

n = 500 to 20,000

XIV-7

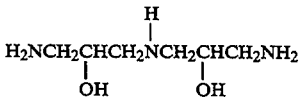

XIV-8

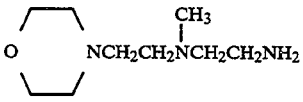

As quaternary ammonium salts there may be preferably used the following compounds:

(XV)

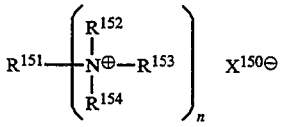

wherein $R^{151}$ represents an organic group having a valency of n; and $R^{152}$, $R^{153}$ and $R^{154}$ each represents a monovalent organic group. The term "organic group" as used herein means a group containing one or more carbon atoms such as an alkyl group, an aryl group and a heterocyclic group. At least two of $R^{152}$, $R^{153}$ and $R^{154}$ may be connected to each other to form a heterocyclic group containing quaternary ammonium atoms. The suffix n represents an integer 1 or more. $X^{150}\ominus$ represents a paired anion.

Particularly preferred among monovalent groups represented by $R^{152}$, $R^{153}$ and $R^{154}$ are substituted or unsubstituted alkyl groups. More particularly, at least one of $R^{152}$, $R^{153}$ and $R^{154}$ is preferably a hydroxyalkyl group, an alkoxyalkyl group or a carboxyalkyl group. The suffix n preferably represents an integer 1 to 3, particularly 1 or 2.

XV-1

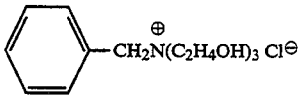

XV-2

$$C_2H_5-\overset{\oplus}{N}(C_2H_4OH)_3\ \tfrac{1}{2}SO_4^{2-}$$

XV-3

$$\overset{\oplus}{N}(C_2H_4OH)_4\ \ Br^-$$

XV-4

$$(C_2H_5)_2\overset{\oplus}{N}(C_2H_4OH)_2\ \ Cl^\ominus$$

XV-5

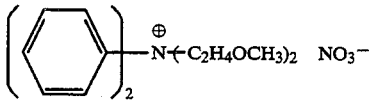

XV-6

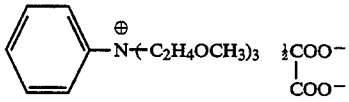

XV-7

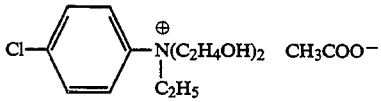

XV-8

$$(HOC_2H_4)_3\overset{\oplus}{N}-C_2H_4-\overset{\oplus}{N}(C_2H_4OH)_3\ \ SO_4^{2-}$$

XV-9

$$(HOC_2H_4)_2\overset{\oplus}{N}(CH_2)_3\overset{\oplus}{N}(C_2H_4OH)_2\ \ 2Cl^\ominus$$

$$\begin{matrix} & & \\ CH_3 & & CH_3 \end{matrix}$$

XV-10

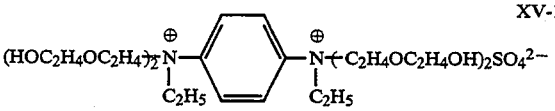

As nitroxy radicals there may be preferably used the following compounds:

(XVI)

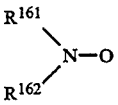

wherein $R^{161}$ and $R^{162}$ each represents a hydrogen atom, an alkyl group, an aryl group or a heterocyclic group. These alkyl, aryl or heterocyclic groups may contain substituents. Examples of such substituents include a hydroxy group, an oxo group, a carbamoyl group, an alkoxy group, a sulfamoyl group, a carboxy group and a sulfo group. Examples of heterocyclic group represented by $R^{161}$ or $R^{162}$ include pyridyl group and piperidyl group.

$R^{161}$ and $R^{162}$ each is preferably a substituted or unsubstituted aryl group or a tertiary alkyl group (e.g., t-butyl group).

Exemplary compounds

XVI-1

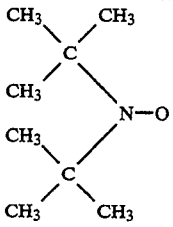

XVI-2

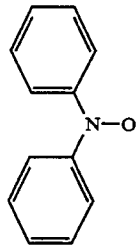

XVI-3

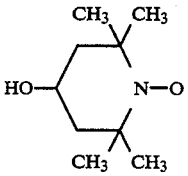

XVI-4

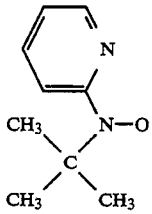

XVI-5

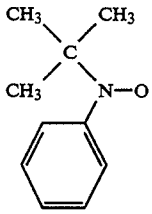

As alcohols there may be preferably used the following compounds:

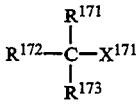

(XVII)

wherein $R^{171}$ represents a hydroxy-substituted alkyl group; $R^{172}$ represents an unsubstituted alkyl group or a group having the same meaning as $R^{171}$; $R^{173}$ represents a hydrogen atom or a group having the same meaning as $R^{172}$; and $X^{171}$ represents a hydroxy group, a carboxyl group, a sulfo group, a nitro group, an unsubstituted or hydroxy-substituted alkyl group, an unsubstituted or substituted amide group or a sulfonamide group.

In the general formula (XVII), $X^{171}$ is preferably a hydroxy group, a carboxyl group or a hydroxyalkyl group.

XVII-1

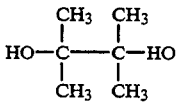

XVII-2

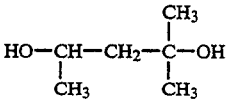

XVII-3

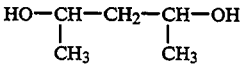

XVII-4 $HO-CH(CH_2OH)_2$

XVII-5 $(HO-CH_2)_3CCOOH$

XVII-6 $C(CH_2OH)_4$

XVII-7 $(HOCH_2)_3C-CH_3$

XVII-8 $(HOCH_2)_3C-NHCOCH_3$

XVII-9

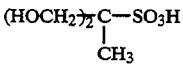

XVII-10

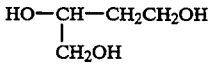

As polyols there may be preferably used the following compounds:

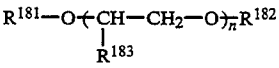

(XVIII)

wherein $R^{181}$, $R^{182}$ and $R^{183}$ each represents a hydrogen atom or an alkyl group; and n represents an integer 1 to 500.

The alkyl group represented by $R^{181}$, $R^{182}$ or $R^{183}$ preferably contains 5 or less, particularly 2 or less carbon atoms. $R^{181}$, $R^{182}$ and $R^{183}$ each preferably represents a hydrogen atom or methyl group, particularly a hydrogen atom.

The integer represented by n is preferably in the range of 3 to 100, particularly 3 to 30.

Exemplary compounds

XVIII-1 $HO(CH_2CH_2O)_4H$

XVIII-2 $CH_3O(CH_2CH_2O)_3H$

XVIII-3 $CH_3O(CH_2CH_2O)_3CH_3$

XVIII-4

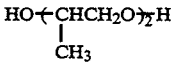

XVIII-5 $HOCH_2CH_2OCH_3$

XVIII-6 $C_2H_5O(CH_2CH_2O)_2H$

XVIII-7 $HO(CH_2CH_2O)_nH$ (Average molecular weight: approx. 300)

XVIII-8 $HO(CH_2CH_2O)_nH$ (Average molecular weight: approx. 800)

-continued

Exemplary compounds $HO\text{-}(CH_2CH_2O)_n\text{-}H$ XVIII-9

(Average molecular weight: approx. 3,000)

$HO\text{-}(CH_2CH_2O)_n\text{-}H$ XVIII-10

(Average molecular weight: approx. 8,000)

As oximes there may be preferably used the following compounds:

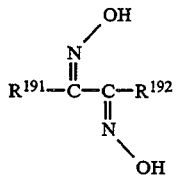

(XIX)

wherein $R^{191}$ and $R^{192}$ each represents a hydrogen atom, a substituted or unsubstituted alkyl group or a substituted or unsubstituted aryl group. $R^{191}$ and $R^{192}$ may be the same or different. $R^{191}$ and $R^{192}$ may be connected to each other.

In the general formula (XIX), $R^{191}$ and $R^{192}$ each is preferably a halogen group, a hydroxyl group, an alkoxy group, an amino group, a carboxyl group, a sulfo group, a phosphonic acid group or an unsubstituted alkyl group or a nitro-substituted alkyl group.

The number of carbon atoms contained in the general formula (XIX) is preferably 30 or less, particularly 20 or less.

Exemplary compounds

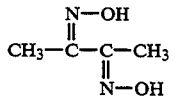

XIX-1

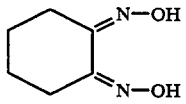

XIX-2

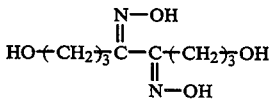

XIX-3

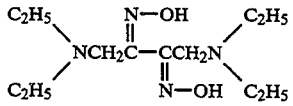

XIX-4

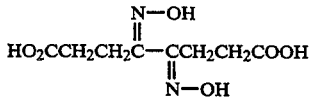

XIX-5

As polyamines there may be preferably used the following compounds:

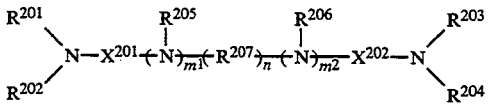

(XX)

wherein $X^{201}$ and $X^{202}$ each represents —CO— or —$SO_2$—; $R^{201}$, $R^{202}$, $R^{203}$, $R^{204}$, $R^{205}$, and $R^{206}$ each represents a hydrogen atom or a substituted or unsubstituted alkyl group; $R^{207}$ represents a substituted or unsubstituted alkylene, arylene or aralkylene group; and $m^1$, $m^2$ and n each represents 0 or 1.

Exemplary compounds

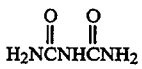

XX-1

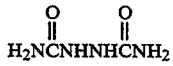

XX-2

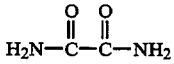

XX-3

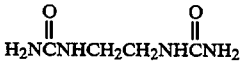

XX-4

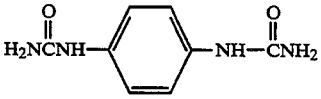

XX-5

$H_2NSO_2NHSO_2NH_2$ XX-6

As condensed amines there may be preferably used the following compounds:

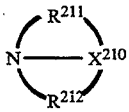

(XXI)

wherein $X^{210}$ represents a trivalent atomic group required to form the condensed ring; and $R^{211}$ and $R^{212}$ each represents an alkylene group, an arylene group, an alkenylene group or an aralkylene group.

$R^{211}$ and $R^{212}$ may be the same or different.

Particularly preferred among the compounds of the general formula (XXI) are those represented by the general formulas (XXI-a) and (XXI-b).

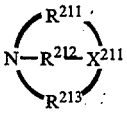

(XXI-a)

wherein $X^{211}$ represents

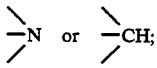

$R^{211}$ and $R^{212}$ are as defined above; and $R^{213}$ has the same meaning as $R^{211}$ and $R^{212}$ or represents

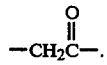

In the general formula (XXI-a), $X^{211}$ is preferably

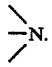

$R^{211}$, $R^{212}$ and $R^{213}$ each preferably contains 6 or less carbon atoms, more preferably 3 or less carbon atoms, particularly 2 or less carbon atoms.

$R^{211}$, $R^{212}$ and $R^{213}$ each is preferably an alkylene group or an arylene group, particularly an alkylene group.

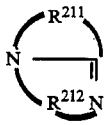

(XXI-b)

wherein $R^{211}$ and $R^{212}$ are as defined in the general formula (XXI).

In the general formula (XXI-b), $R^{211}$ and $R^{212}$ each preferably contains 6 or less carbon atoms. $R^{211}$ and $R^{212}$ each is preferably an alkylene group or an arylene group, particularly an alkylene group.

Particularly preferred among the compounds of the general formulas (XXI-a) and (XXI-b) are those represented by the general formula (XXI-a).

Exemplary compounds

XXI-1

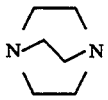

XXI-2

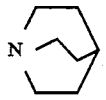

XXI-3

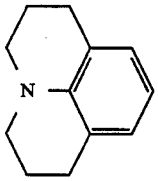

XXI-4

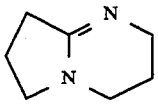

XXI-5

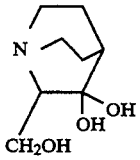

XXI-6

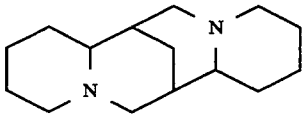

-continued

Exemplary compounds

XXI-7

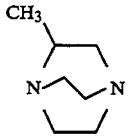

XXI-8

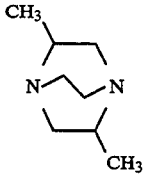

XXI-9

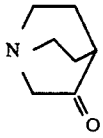

XXI-10

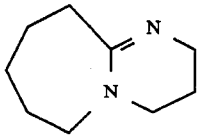

XXI-11

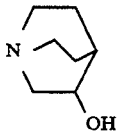

XXI-12

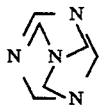

XXI-13

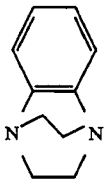

XXI-14

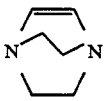

XXI-15

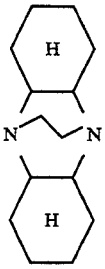

XXI-16

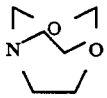

-continued

Exemplary compounds

XXI-17

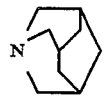

XXI-18

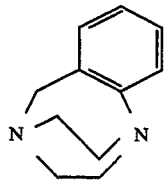

Most of the above described compounds are commercially available.

These organic preservatives may be used in combination. In particular, at least one of the compounds of the general formulas (VI) to (XI) and at least one of the compounds of the general formulas (XII) to (XXI) may be preferably used in combination.

More particularly, at least one of the compounds of the general formulas (VI) and (VIII) and at least one of the compounds of the general formulas (XI) and (XXI) may be used in combination.

The color developing solution to be used in the present invention will be described hereinafter.

The color developing solution to be used in the present invention may comprise a known aromatic primary amine color developing agent. Preferred example of such an aromatic primary amine color developing agent include p-phenylenediamine. Typical examples of such p-phenylenediamine will be described hereinafter but the present invention should not be construed as being limited thereto.

D-1: N,N-diethyl-p-phenylenediamine

D-2: 4-[N-ethyl-N-(β-hydroxyethyl)amino]aniline

D-3: 2-Methyl-4-[N-ethyl-N-(β-hydroxyethyl-)amino]aniline

D-4: 4-Amino-3-methyl-N-ethyl-N-(β-methanesulfonamideethyl)-aniline

In particular, D-4 may be preferably used for the purpose of improving the stability of photographic properties during processing and image preservability after processing.

These p-phenylenediamine derivatives may be used in the form of sulfate, hydrochloride, p-toluenesulfonate or other salts. The amount of said aromatic primary amine developing agent to be used is preferably in the range of about 0.1 g to about 20 g, particularly 0.5 g to about 10 g per 1 l of developing solution.

The color developing solution to be used in the present invention preferably has a pH value of 9 to 12, particularly 9 to 11.0. The color developing solution may comprise other components known as components of developing solution.

In order to maintain the above described pH range, various buffers may be preferably used. Examples of such buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The amount of such a buffer to be incorporated in the color developing solution is preferably in the range of 0.1 mol/l or more, particularly 0.1 to 0.4 mol/l.

Furthermore, the color developing solution may comprise various chelating agents as a calcium or magnesium suspension agent or for the purpose of improving the stability thereof.

Specific examples of such chelating agents will be described hereinafter, but the present invention should not be construed as being limited thereto.

Specific examples of such chelating agents include nitrilotriacetic acid, diethylenetriaminepentaacetic acid, ethylenediaminetetraacetic acid, triethylenetetraminehexaacetic acid, N,N,N-trimethylenephosphonic acid, ethylenediamine-N,N,N',N'-tetramethylenephosphonic acid, 1,3-diamino-2-propanoltetraacetic acid, transcyclohexadiaminetetraacetic acid, nitrilotripropionic acid, 1,2-diaminopropanetetraacetic acid, hydroxyethyliminodiacetic acid, glycoletherdiaminetetraacetic acid, hydroxyethylenediaminetriacetic acid, ethylenediamineorthohydroxyphenylacetic acid, 2-phosphonobutane-1, 2,4-tricarboxylic acid, 1-hydroxyethylidene-1, 1-diphosphonic acid, and N,N'-bis(2-hydroxybenzyl) ethylenediamine-N,N'-diacetic acid.

These chelating agents may be optionally used in combination.

The amount of such a chelating agent to be incorporated may be such that it sufficiently block metal ions in the color developing solution. For example, it may be in the range of 0.1 to 10 g per 1 l.

The color developing solution may optionally comprise any suitable development accelerators.

Examples of development accelerators which may be optionally incorporated include thioether compounds as described in JP-B-37-16088, JP-B-37-5987, JP-B-38-7826, JP-B-44-12380, and JP-B-45-9019, and U.S. Pat. No. 3,813,247, p-phenylenediamine compounds as described in JP-A-52-49829, and JP-A-50-15554, quaternary ammonium salts as described in JP-A-50-137726, JP-B-44-30074, JP-A-56-156826, and JP-A-52-43429, p-aminophenols as described in U.S. Pat. Nos. 2,610,122, and 4,119,462, amine compounds as described in U.S. Pat. Nos. 2,494,903, 3,128,182, 4,230,796, and 3,253,919, 2,482,546, 2,596,926, and 3,582,346, and JP-B-41-11431, polyalkylene oxide as described in JP-B-37-16088, JP-B-42-25201, JP-B-41-11431, and JP-B-42-23883, and U.S. Pat. Nos. 3,128,183, and 3,532,501, 1-phenyl-3-pyrazolidones, hydrazines, mesoionic compounds, ionic compounds, and imidazoles.

The color developing solution to be used in the present invention may optionally comprise any suitable fog inhibitors.

As such fog inhibitors there may be used halides of alkaline metal such as sodium chloride, potassium bromide or potassium iodide or organic fog inhibitors. Typical examples of such organic fog inhibitors include benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine, adenine, and other nitrogen-containing heterocyclic compounds.

If a high silver chloride content light-sensitive material having 80 mol % or more of a silver chloride based on the amount of silver halides used therein is processed, a developing solution having a chlorine ion concentration of $3.5\times10^{-2}$ to $1.5\times10^{-1}$ mol/l and a bromine ion concentration of $3.0\times10^{-5}$ to $1.0\times10^{-3}$ mol/l may be preferably used in the light of fog inhibition and inhibition of change in the photographic properties due to the continuous processing The color developing solution to be used in the present invention may preferably comprise a fluorescent brightening agent. As fluorescent brightening agent there may be preferably used 4,4'-diamino-2,2'-disulfostilbene compounds. The amount of such compounds to be incorporated is in the range of 0 to 5 g/l, preferably 0.1 to 4 g/l.

Furthermore, the color developing solution to be used in the present invention may optionally comprise various surface active agent such as alkylsulfonic acid, arylphosphonic acid, aliphatic carboxylic acid and aromatic carboxylic acid.

The processing temperature at which the present color developing solution is used is in the range of 20° to 50° C., preperably 30° to 40° C. The processing time is in the range of 20 seconds to 5 minutes, preferably 30 seconds to 2 minutes.

The supply amount of the present color developing solution is in the range of 20 to 120 m , preferably 30 to 100 m per 1 $m^2$ of light-sensitive material. The term "supply amount" as used herein means the amount of a replenisher of color developing solution to be supplied, which is in proportion to the processed area of light-sensitive material and is set up in accordance with the processing condition (e.g., a processed amount of light-sensitive material, a temperature of developing solution, a kind of developing solution used, etc.) or the environmental condition (e.g., humidity and temperature during the processings), and it is expressed in terms of volume (ml) of the supplied replenisher per unit area ($m^3$) of the processed light-sensitive material. The supply amount of the present invention does not include the amount of additives which is added depending on unexpected variation of the above condition, for example, increase in the environmental temperature, decrease in the environmental humidity, decrease in the processed amount of light-sensitive material, and so on. Such additives include water for diluting a concentrated solution, and preservatives of alkaline agents which may be added in the form of solution. further expedite the processing, a blix step may follow a bleaching step. Depending on the purpose, the blix bath may consist of two continuous baths, the fixing step may be conducted before the blix step, or the blix step may be followed by the bleaching step. As a suitable bleaching agent there may be used a compound of a polyvalent metal such as iron (III), cobalt (III), chromium (III) and copper (II), peroxides, quinones, or nitro compounds. Typical examples of bleaching agents which can be used in the present invention include ferricyanide, bichromate, organic complex salt of iron (III) or cobalt (III) such as complex salt of ethylenediaminetetraacetic acid, diethylenetriaminepentaacetic acid, cyclohexanediaminetetraacetic acid, methyliminodiacetic acid, 1,3-diaminopropanetetraacetic acid, glycoletherdiaminotetraacetic acid and other aminopolycarboxylic acids, citric acid, tartaric acid malic acid, persulfates, bromates, permanganates, or nitrobenzenes. Among these compounds, ferric aminopolycarboxylate complex salts such as ferric ethylenediaminetetraacetate complex salt and persulfates may be preferably used in the light of rapidity in processing and prevention of environmental pollution. Ferric aminopolycarboxylate complex salts may be preferably used in the bleaching bath and the blix bath. The pH value of the bleaching bath or blix bath comprising such a ferric aminopolycarboxylate complex salt is normally in the range of 5.5 to 8 but may be lower than this range in order to expedite the processing.

The present bleaching solution, blix solution, or prebath thereof may optionally contain a bleach accelerator. Specific examples of useful bleach accelerators include compounds containing a mercapto group or disulfide group as described in U.S. Pat. No. 3,893,858, West German Patent 1,290,812, JP-A-53-95630, and *Research Disclosure,* No. 17129 (July 1978), thiazolidine derivatives as described in JP-A-50-140129, thiourea derivatives as described in U.S. Pat. No. 3,706,561, iodides as described in JP-A-58-16235, polyoxyethylene compounds as described in West German Patent 2,748,430, polyamine compounds as described in JP-B-45-8836, and bromide ion. Among these compounds, compounds containing mercapto group or disulfide group may be preferably used because of their high accelerating effect. Particularly preferred are compounds as described in U.S. Pat. No. 3,893,858, West German Patent 1,290,812, and JP-A-53-95630. Futhermore, compounds as described in U.S. Pat. No. 4,552,834 may be preferably used. These bleach accelerators may be incorporated in the light-sensitive material to be processed. These bleach accelerators may be preferably used particularly when a photographing color light-sensitive material is subjected to blix.

Examples of a suitable fixing agent which can be used in the present invention include thiosulfates, thiocyanates, thioether compounds, thioureas, and iodides (in a large amount). Commonly used among these compounds are thiosulfates. Particularly, ammonium thiosulfate can be most widely used. As a suitable preservative for the blix solution there may be preferably used sulfite, bisulfite, sulfinic acid, or carbonyl-bisulfite addition product.

The present silver halide photographic material which has been subjected to desilvering is normally then subjected to rinse and/or stabilizing. The amount of water to be used in the rinsing step can be widely determined depending on the characteristics of the light-sensitive material to be processed (e.g., coupler), application, rinsing temperature, number of rinsing tanks (stages), supply system (i.e., countercurrent or forward process), and other various conditions. The relationship between the number of rinsing tanks and the amount of water to be used in the multistage countercurrent process can be determined by the process as described in "Journal of the Society of Motion Picture and Television Engineers", Vol. 64, pp. 248–253, May 1955.

In the multistage countercurrent process as described in the above cited reference, the amount of rinsing water to be used can be drastically reduced. However, the multistage countercurrent process is disadvantageous in that the time of water retention in the tanks is increased, causing proliferation of bacteria which produces suspended materials that will be attached to the light-sensitive material. In the process for the processing of a light-sensitive material, the approach as described in Japanese Patent Application No. 61-131632 which comprises reducing the calcium and magnesium ion concentration can be effectively used to overcome such a problem. Such a problem can also be solved by the use of a proper sterilizer such as isothiazolone compounds and thiabenzazoles as described in JP-A-57-8542, chlorine sterilizers (e.g., sodium chlorinated isocyante), and sterilizers as described in Hiroshi Horiguchi, "Chemistry of Anti-bacterial and Anti-fungal Agents", Eisei Gijutsukai, "Technique for Sterilization and Fungi-proofing of Microorganism", and Nihon Bokin Gakkai, "Dictionary of Anti-bacterial and Anti-fungal Agents".

The rinsing water to be used in the present processing has a pH value of 4 to 9, preferably 5 to 8. The rinsing temperature and rinsing time can be widely determined depending on the characteristics and application of the light-sensitive material to be processed but are normally in the range of 15° to 45° C. and 20 seconds to 10 minutes, preferably 25° to 40° C. and 30 seconds to 5 minutes, respectively. Furthermore, in the present process for the formation of color images, the above described rinse may be replaced by the stabilizing step. Such a stabilizing step can be accomplished by any known method as described in JP-A-57-8543, JP-A-58-14834, and JP-A-60-220345.

Alternatively, the above described rinsing step may be followed by the stabilizing step. Examples of such a process include a stabilizing bath containing formalin and a surface active agent to be used as final bath for a photographic color light-sensitive material.

The stabilization may be preferably effected without substantially effecting rinsing step in the light of water saving and image preservability after processing. Such a stabilizing bath, too, may comprise various chelating agents or anti-fungal agents.

The overlow liquid produced with the supply of the above described rinsing solution and/or stabilizing solution can be re-used in the other steps such as desilvering step.

The present silver halide color photographic material may comprise a color developing agent for the purpose of simplifying and expediting the processing. To this end, such a color developing agent can be incorporated in the light-sensitive material in the form of various precursors thereof. Examples of such precursors of color developing agent include indoaniline compounds as described in U.S. Pat. No. 3,342,597, Schiff base compounds as described in U.S. Pat. No. 3,342,599, and *Research Disclosure,* Nos. 14850, and 15159, aldol compounds as described in *Research Disclosure,* No. 13924, metal complexes as described in U.S. Pat. No. 3,719,492, and urethane compounds as described in JP-A-53-135628.

The present silver halide color photographic material may optionally comprise various 1-phenyl-3-pyrazolidones for the purpose of accelerating color development. Typical examples of such compounds are described in JP-A-56-64339, JP-A-57-144547, and JP-A-58-115438.

The various processing solutions to be used in the present invention may be used at a temperature of 20° to 50° C. The standard temperature range is normally between 33° C. and 38° C. However, a higher temperature can be used to accelerate and shorten the processing. On the contrary, a lower temperature range can be used to improve the picture quality or the stability of the processing solution. For the purpose of reducing the amount of silver to be incorporated in the light-sensitive material, a processing using cobalt intensification or hydrogen peroxide intensification as described in West German Patent 2,226,770, and U.S. Pat. No. 3,674,499 may be effected.

The present process can also be applied to the processing of color paper, color reversal paper, color direct positive paper and the like.

The silver halide color photographic material to be used in the present invention will be described in detail hereinafter.

The halogen composition of the silver halide emulsion to be used in the present invention is preferably silver bromochloride containing 80 mol % or more of silver chloride and substantially free of silver iodide in the light of rapidity in processing and saving of supply liquid. The term "silver bromochloride substantially free of silver iodide" as used herein means silver bromochloride having a silver iodide content of 1.0 mol % or less, preferably 0.2 mol % or less. If the silver chloride content is less than 80 mol % or the silver iodide content exceeds the above described range, the development speed is low. Therefore, the silver chloride content is preferably high. The silver chloride content is more preferably in the range of 90 mol % or more, particularly 95 mol % or more. For the purpose of reducing the supply amount of the developing solution, the silver chloride content of the silver halide emulsion is preferably further raised. In this case, a substantially pure silver chloride emulsion having a silver chloride content of 98 to 99.9 mol % may be preferably used. However, a completely pure silver chloride emulsion is disadvantageous in that it hardly can provide a high sensitivity and it finds difficulty in inhibiting fog developed when a pressure is applied to the light-sensitive material.

In the present silver halide grains, the remainder in the composition is mostly silver bromide. In this case, silver bromide may be uniformly present in the silver halide grains (i.e., a grain is formed of a uniform solid solution of silver bromochloride). Alternatively, silver bromide may be present in such an arrangement that varoius phases having different silver bromide contents are formed. In the latter case, so-called grains may be formed wherein the core and one or more layers (shell) surrounding the core are different from each other in the halogen composition. Alternatively, a grain may be formed such that local phases having different silver bromide contents (preferably high silver bromide contents) are discontinuously formed on the surface thereof and/or in the interior thereof. These local layers having a high silver bromide content may be present in the interior of the grains or on the edge, corner or surface of the grains. One of preferred examples of such a case is such that local phases having a high silver bromide content are epitaxially connected to the corners of the grains.

The average particle size of silver halide grains contained in the silver halide emulsion to be used in the present invention is preferably in the range of 0.1 to 2 μm. (The average particle size is determined by number-averaging particles sizes obtained in terms of diameter of circles having the same area as the projected area of grains.)

The present silver halide emulsion may be preferably a so-called monodisperse emulsion having a particle size fluctuation coefficient of 20% or less, preferably 15% of less. For the purpose of obtaining a wide latitutde, such monodisperse emulsions may be preferably coated on the same layer in combination or one monodisperse emulsion may be preferably coated on a plurality of layers.

The silver halide grains to be incorporated in the present photographic emulsion may have a regular crystal structure such as cube, octahedron and tetradecahedron, an irregular crystal structure such as sphere and tablet, or a composite thereof. The present silver halide emulsion may comprise a composite of silver halide grains having these various crystal structures. The present silver halide emulsion may preferably comprise silver halide grains having the above described crystal structures in an amount of 50% or more, preferably 70% or more, particularly 90% or more.

Alternatively, an emulsion wherein tabular grains having an average aspect ratio (average particle diameter/thickness) of 5 or more, preferably 8 or more account for 50% or more of the total grains as determined in terms of projected area may be preferably used.

The preparation of the photographic emulsion to be used in the present invention can be accomplished by any suitable method as described in P. Glafkides, "Chimie et Physique Photographique", Paul Montel, 1967, G. F. Duffin, "Photographic Emulsion Chemistry, The Focal Press, 1966, V. L. Zelikman et al, "Making and Coating Photographic Emulsion", The Focal Press, and *Research Disclosure,* No. 17643, vol. 176, (I, II, III), (December 1978). Particularly, the preparation of the present silver halide photographic emulsion can be accomplished by any process such as acidic process, neutral process of ammonia process. The process for the reaction of the soluble silver salt with the soluble silver halide can be accomplished by separate mixing process, simultaneous mixing process or combination thereof. The process for the reaction of the soluble silver salt with the soluble silver halide can be accomplished by a process in which particles are formed in excess silver ions (so-called reversal mixing process). One form of the simultaneous mixing process is a so-called controlled double jet process in which the pAg of the liquid in which silver halide is formed is kept constant. This process can provide a silver halide emulsion having a regular crystal structure and a nearly uniform particle size.

Various polyvalent metallic ion impurities may be incorporated in the silver halide emulsion to be used in the present invention during the preparation or physical ripening thereof. Examples of compounds to be used as such impurities include salts of cadmium, zinc, lead, copper and thallium, and salts and complex salts of the group VIII elements such as iron, ruthenium, rhodium, palladium, osmium, iridium and platinum. Particularly, the group VIII elements may be preferably used. The amount of these impurities to be incorporated may widely range depending on the purpose of application but may be preferably in the range of $10^{-9}$ to $10^{-2}$ mol based on the amount of silver halide.

The silver halide emulsion to be used in the present invention is normally subjected to chemical sensitization and spectral sensitization.

For chemical sensitization, sulfur sensitization with an instable sulfur compound or the like, noble metal sensitization with gold or the like, or reduction sensitization may be used, singly or in combination. As compounds to be used in chemical sensitization there may be preferably used those described in JP-A-62-215272 (right bottom column on page 18 to right upper column on page 22).

The coated amount of the present silver halide emulsion is preferably in the range of 0.3 to 0.8 g/m$^2$, particularly 0.7 g/m$^2$ or less as calculated in terms of amount of silver in the light of rapidity in processing and stability in photographic properties against processing.

The present silver halide emulsion may be normally subjected to physical repening, chemical ripening, and spectral sensitization before use. Examples of additives to be used in such processes are described in *Research Disclosure,* No. 17643 and 18716. The places where such a description is found are summarized in the table shown below.

Examples of known photographic additives which can be used in the present invention are described in these citations. The table shown below also contains the places where such a description is found.

| Additives | RD 17643 | RD 18716 |
|---|---|---|
| 1. Chemical-sensitizer | Page 23 | Right column on page 648 |
| 2. Sensitivity improver | — | Right column on page 648 |
| 3. Spectral sensitizer and Supersensitizer | pp. 23–24 | Right column on page 648–right column on page 649 |
| 4. Brightening agent | Page 24 | — |
| 5. Fog inhibitor and Stabilizer | pp. 24–25 | Right column on page 649 |
| 6. Coupler | Page 25 | — |
| 7. Organic solvent | Page 25 | — |
| 8. Light absorber and Filter dye | pp. 25–26 | Right column on page 649–left column on page 650 |
| 9. Ultraviolet absorber | pp. 25–26 | Right column on page 649–left column on page 650 |
| 10. Stain inhibitor | Right column on page 25 | Left column to right column on page 650 |
| 11. Dye stabilizer | page 25 | — |
| 12. Film Hardener | Page 26 | Left column on page 651 |
| 13. Binder | Page 26 | Left column on page 651 |
| 14. Plasticizer and Lubricant | Page 27 | Right column on page 650 |
| 15. Coating aid and Surface active agent | pp. 26–27 | Right column on page 650 |
| 16. Antistatic agent | Page 27 | Right column on page 650 |

For the purpose of inhibiting fogging during the preparation, storage or photographic processing of the light-sensitive material or stabilizing the photographic properties of the light-sensitive material, the photographic emulsion to be used in the present invention may comprise various compounds. Examples of suitable such compounds which may be incorporated in the light-sensitive material include azoles (e.g., benzothiazolium salts), nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), mercaptopyrimidines, thioketo compounds (e.g., oxazolinethione), azaindenes (e.g., triazaindenes, tetraazaindenes (particularly 4-hydroxy-substituted (1,3,3a,7)tetraazaindenes)), benzenethiosulfonic acids, benzenesulfinic acids, benzenesulfonamide, and many other compounds known as fog inhibitors or stabilizers.

In particular, mercaptoazoles may be preferably incorporated in the coating solution of silver halide emulsion.

Specific examples of such mercaptoazoles will be shown hereinafter.

(a-1)

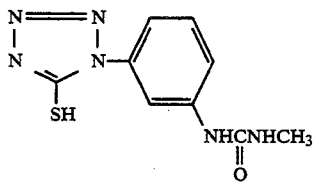

(a-2)

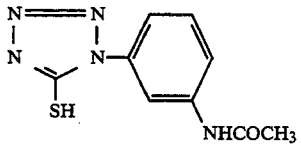

(b-1)

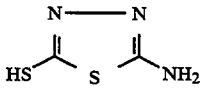

(b-2)

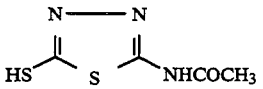

(c-1)

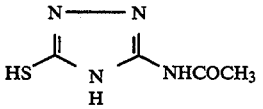

-continued (c-1)

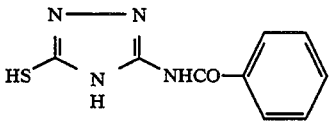

The amount of such mercaptoazoles to be incorporated is preferably in the range of $1\times10^{-5}$ to $5\times10^{-2}$ mol, particularly $1\times10^{-4}$ to $1\times10^{-2}$ mol, per 1 mol of silver halide.

Spectral sensitization is effected for the purpose of providing the emulsion in the various layers in the present light-sensitive material with a spectral sensitivity in a desired light wavelength range. In the present invention, the spectral sensitization may be preferably accomplished by incorporating a spectral sensitizing dye which absorbs light in the wavelength corresponding to the desired spectral sensitivity. Examples of such spectral sensitizing dyes include those described in F. H. Harmer, "Heterocyclic Compounds-Cyanine Dyes and Related Compounds", John Wiley & Sons [New York, London] (1964). Specific examples of such compounds which may be preferably used in the present invention include those described in JP-A-62-215272 (right upper column on page 22 to page 38).

Specific examples of particularly preferred such compounds will be shown hereinafter.

Dye-1

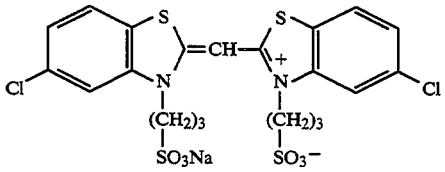

Dye-2

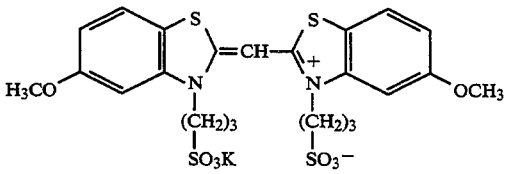

Dye-3

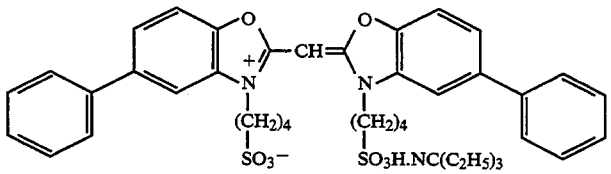

Dye-4

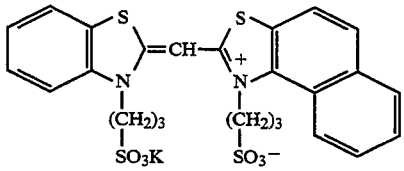

-continued
Dye-5
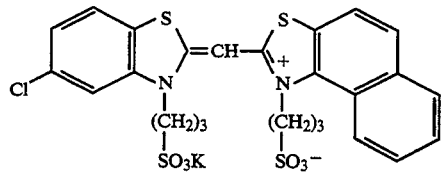
Dye-6
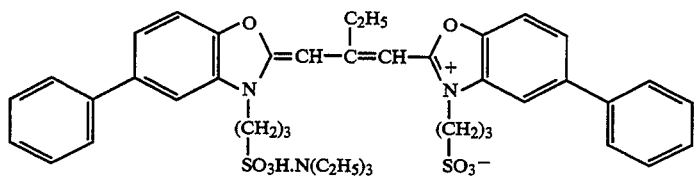
Dye-7
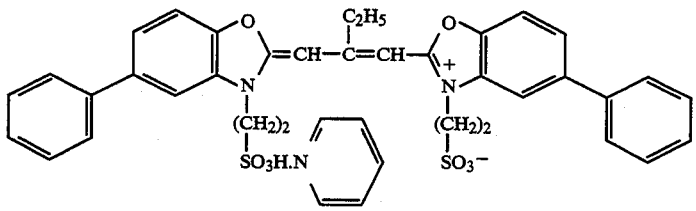
Dye-8
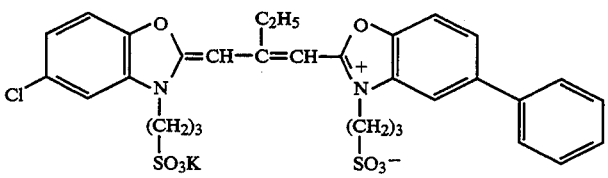
Dye-9
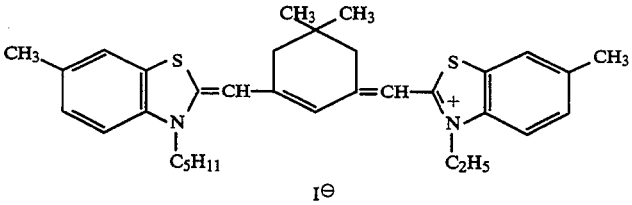
Dye-10
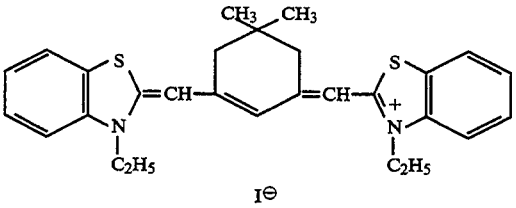
Dye-11
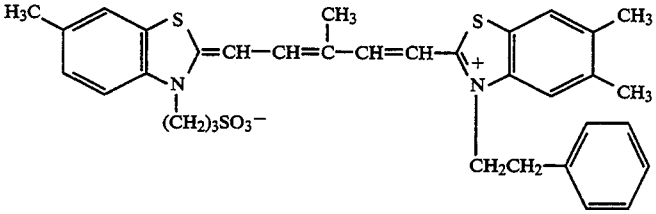
Dye-12
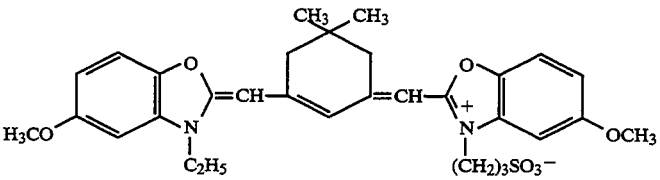

-continued

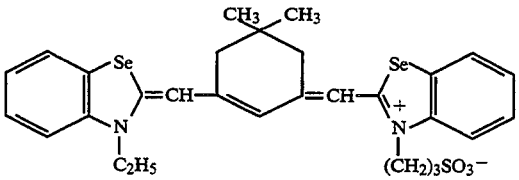

Dye-13

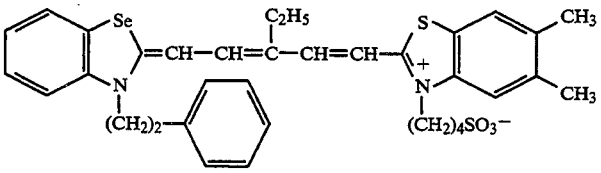

Dye-14

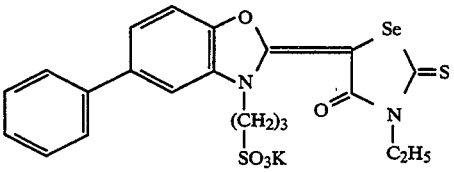

Dye-15

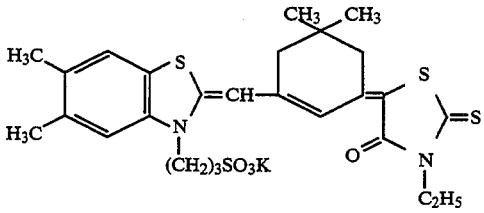

Dye-16

In the present invention, the hydrophilic colloid layer in the light-sensitive material may comprise a water-soluble dye as filter dye or for the purpose of inhibiting irradiation or like purposes. Examples of such a dye include oxonol dyes or hemioxonol dyes containing pyrazolone or barbituric acid nucleus as described in British Patents 506,385, 1,177,429, 1,311,884, 1,338,799, 1,385,371, 1,467,214, 1,433,102, and 1,553,516, JP-A-48-85130, JP-A-49-114420, JP-A-55-161233, and JP-A-59-111640, and Patents 3,247,127, 3,469,985 and 4,078,933, and cyan dyes, merocyanine dyes, styryl dyes and azo dyes as described in U.S. Pat. Nos. 2,843,486, and 3,294,539. Specific examples of preferred such dyes will be shown hereinafter.

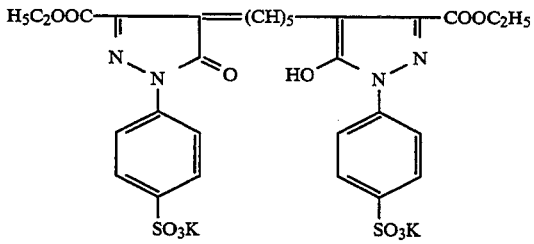

S-1

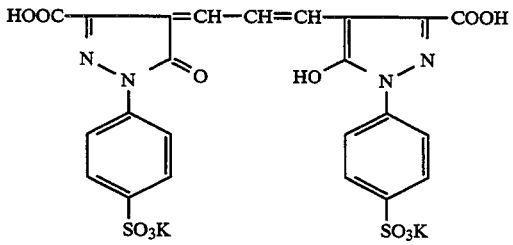

S-2

-continued

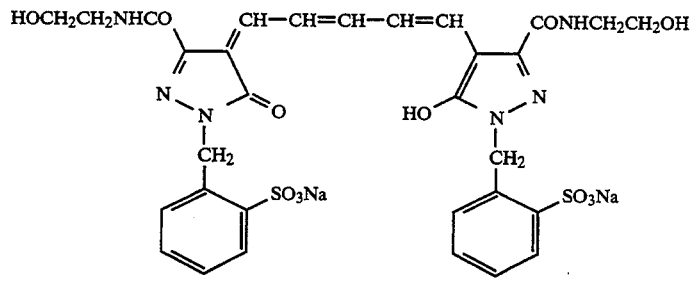

S-3

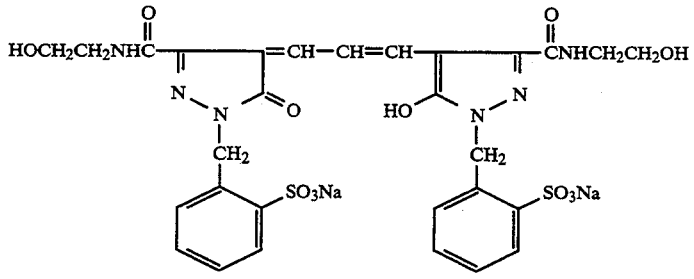

S-4

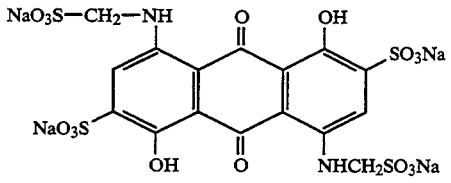

S-5

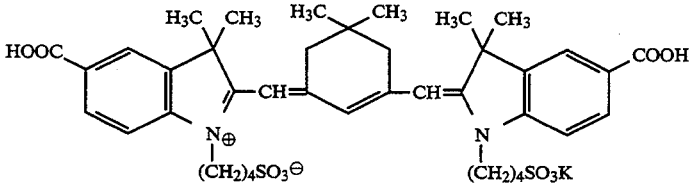

S-6

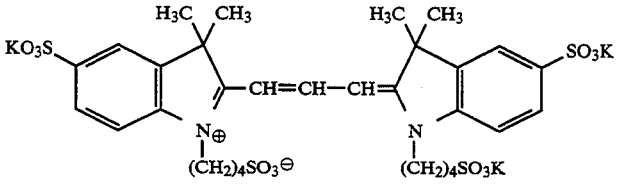

S-7

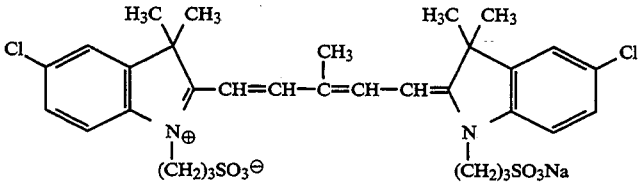

S-8

In the present invention, various color couplers may be used. The term "color coupler" as used herein means a compound which undergoes coupling reaction with an oxidation product of an aromatic primary amine developing agent to produce a dye. Typical examples of useful color couplers include naphthol or phenol compounds, pyrazolone or pyrazoloazole compounds, and open-chain or heterocyclic ketomethylene compounds. Specific examples of cyan, magenta and yellow couplers which may be used in the present invention are described in *Research Disclosure* Nos. 17,643 (VII-D, December 1978) and 18,717 (November 1979).

The color coupler to be incorporated in the light-sensitive material may preferably contain a ballast group or be polymerized to exhibit non-diffusivity. Two-equivalent couplers substituted by coupling-off group are more suitable than four-equivalent couplers which contain a hydrogen atom in the coupling active position. Couplers which develop a dye having a proper diffusivity, colorless couplers, DIR couplers which undergo coupling reaction to release a development inhibitor, or couplers which undergo coupling reaction to release a development accelerator may be used in the present invention.

Typical examples of yellow couplers which may be used in the present invention include oil protect type acylacetamide couplers. Specific examples of such oil protect type acylacetamide couplers are described in U.S. Pat. Nos. 2,407,210, 2,875,057, and 3,265,506. In the present invention, two-equivalent yellow couplers may be preferably used. Typical examples of such two-equivalent yellow couplers include oxygen atom-releasing type yellow couplers as described in U.S. Pat. Nos. 3,408,194, 3,447,928, 3,933,501, and 4,022,620, and nitrogen atom-releasing type yellow couplers as described in JP-B-55-10739, U.S. Pat. Nos. 4,401,752, and 4,326,024, *Research Disclosure* No. 18,053 (April 1979), British Patent 1,425,020, and West German Patent Application (OLS) Nos. 2,219,917, 2,261,361, 2,329,587, and 2,433,812. α-Pivaloylacetanilide couplers are excellent in fastness of developed dye, particularly to light. On the other hand, α-benzoylacetanilide couplers can provide a high color density.

As a suitable magenta coupler for the present invention there may be used an oil protect type indazolone or cyanoacetyl, preferably 5-pyrazolone coupler or pyrazoloazole coupler such as pyrazolotriazoles. As such a 5-pyrazolone coupler there may be preferably used a coupler which is substituted by an arylamino group or acylamino group in the 3-position in the light of hue of developed dye or color density. Typical examples of such a coupler are described in U.S. Pat. Nos. 2,311,082, 2,343,703, 2,600,788, 2,908,573, 3,062,653, 3,152,896, and 3,936,015. Particularly preferred examples of elimination groups for such a two-equivalent 5-pyrazolone coupler include nitrogen atom elimination groups as described in U.S. Pat. No. 4,310,619, and arylthio groups as described in U.S. Pat. No. 4,351,897. 5-Pyrazolone couplers containing ballast groups as described in European Patent 73,636 can provide a high color density.

As suitable pyrazoloazole couplers there may be used pyrazolobenzimidazoles as described in U.S. Pat. No. 3,369,879, preferably pyrazolo[5,1-c][1,2,4]triazoles as described in U.S. Pat. No. 3,725,067, pyrazolotetrazoles as described in *Research Disclosure* No. 24,220 (June 1984), or pyrazolopyrazoles as described in *Research Disclosure* No. 24,230 (June 1984).

Imidazo[1,2-b] pyrazoles as described in U.S. Pat. No. 4,500,630 may be preferably used because of their small subsidiary absorption of yellow light by developed dye and excellent fastness of developed dye to light. Pyrazolo[1,5-b] [1,2,4]triazole as described in U.S. Pat. No. 4,540,654 may particularly preferably be used in the present invention.

Other examples of preferred pyrazolotriazole couplers include pyrazolotriazole couplers comprising a branched alkyl group directly connected to the 2, 3 or 6-position of pyrazolotriazole ring as described in JP-A-61-65245, pyrazoloazole couplers containing a sulfonamide group in their molecules as described in JP-A-61-65246, pyrazoloazole couplers containing an alkoxyphenylsulfonamide ballast group as described in JP-A-61-147254, and pyrazolotriazole couplers containing an alkoxy group or an aryloxy group in the 6-position as described in EP-A-226,849.

A preferred pyrazoloazole coupler is represented by the following general formula (M):

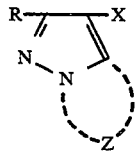

[M]

wherein R represents a hydrogen atom or a substituent; and Z represents a nonmetallic atom group required to form a 5-membered azole ring containing 2 to 4 nitrogen atoms. Such an azole ring may contain substituents (including condensed ring).

X represents a hydrogen atom or a group which undergoes coupling reaction with an oxidation product of a developing agent to be eliminated.

The details of substituents to be contained in R and such an azole ring are described in U.S. Pat. No. 4,540,654.

Specific examples of the compound of the general formula (M) will be shown hereinafter, but the present invention should not be construed as being limited thereto.

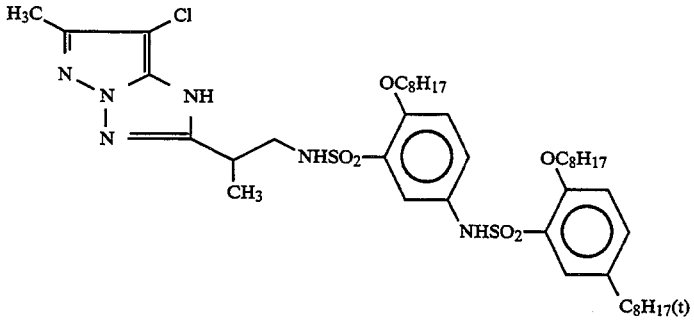

(M-1)

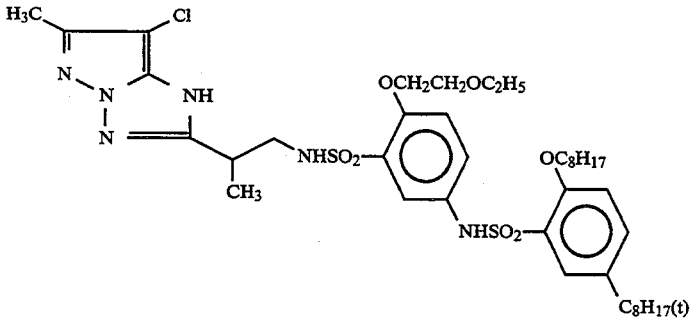

(M-2)

-continued
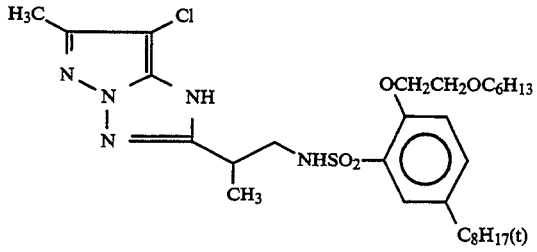
(M-3)
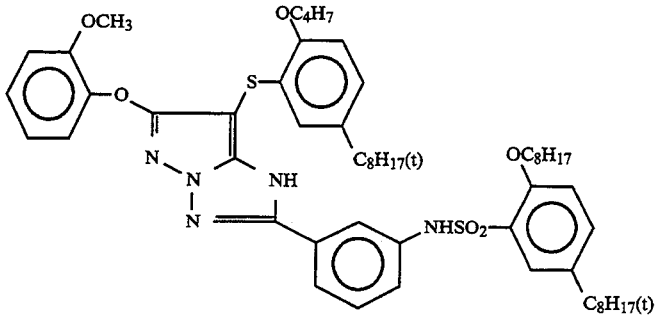
(M-4)
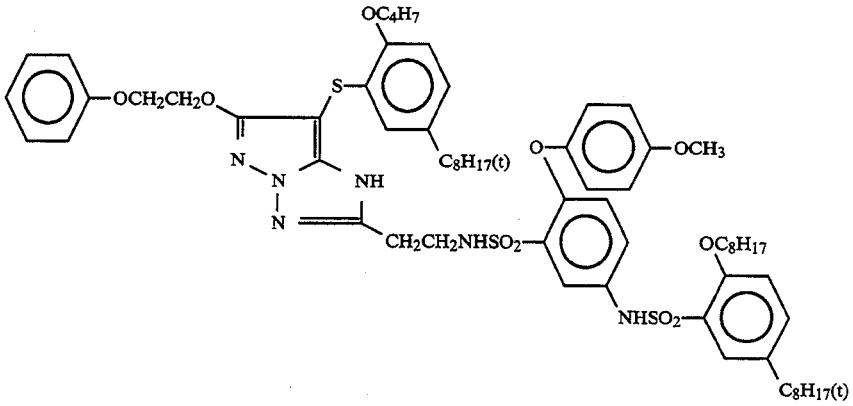
(M-5)
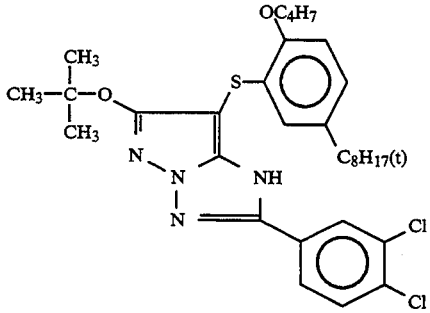
(M-6)
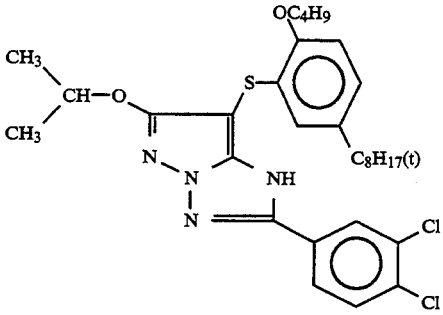
(M-7)

-continued

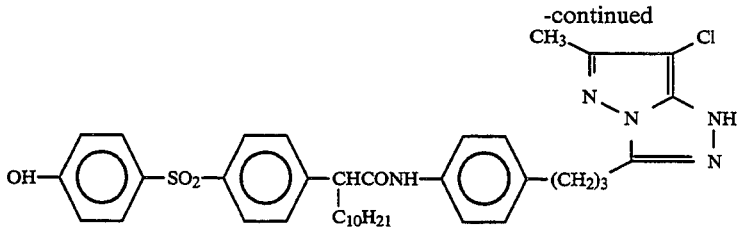

(M-8)

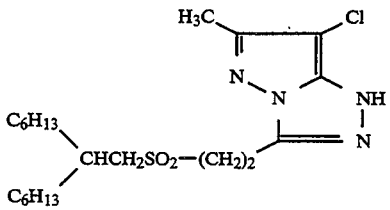

(M-9)

As a suitable cyan coupler for the present invention there may be used an oil protect type naphthol or phenol coupler. Typical examples of such a coupler include naphthol couplers as described in U.S. Pat. No. 2,474,293. Preferred examples of such a coupler include oxygen atom-releasing type two-equivalent naphthol couplers as described in U.S. Pat. Nos. 4,052,212, 4,146,396, 4,228,233, and 4,296,200. Specific examples of such a phenol coupler are described in U.S. Pat. Nos. 2,369,929, 2,801,171, 2,772,162, and 2,895,826. Cyan couplers which are fast to heat and moisture may be preferably used in the present invention. Typical examples of such cyan couplers include phenol cyan couplers containing an ethyl group or higher group in the meta-position of phenol nucleus as described in U.S. Pat. No. 3,772,002, 2,5-diacylamino-substituted phenol couplers as described in U.S. Pat. Nos. 2,772,162, 3,758,308, 4,126,396, 4,334,011, and 4,327,173, West German Patent Application (OLS) No. 3,329,729, and JP-A-59-166956, and phenol couplers containing a phenylureide group in the 2-position and an acylamino group in the 5-position as described in U.S. Pat. Nos. 3,446,622, 4,333,999, 4,451,559, and 4,427,767.

The graininess of the light-sensitive material can be improved by using a coupler which develops a dye having a proper diffusivity. Specific examples of magenta couplers having a proper diffusivity are described in U.S. Pat. No. 4,366,237, and British Patent 2,125,570. Specific examples of yellow, magenta or cyan couplers having a proper diffusivity are described in European Patent 96,570, and West German Patent Application (OLS) No. 3,234,533.

Dye-forming couplers and the above described special couplers may form a dimer or higher polymer. Typical examples of polymerized dye-forming couplers are described in U.S. Pat. Nos. 3,451,820, and 4,080,211. Specific examples of polymerized magenta couplers are described in British Patent 2,102,173, U.S. Pat. No. 4,367,282.

Various couplers to be used in the present invention may be incorporated in combination in the same layer in the light-sensitive layer or one of these couplers may be incorporated in two or more different layers in order to satisfy the properties required for the light-sensitive material.

The incorporation of the present couplers in the light-sensitive material can be accomplished by various known dispersion methods. Examples of high boiling solvents which can be used in an oil-in-water dispersion process are described in U.S. Pat. No. 2,322,027. Specific examples of process and effects of latex dispersion method and latex for use in such dispersion method are described in U.S. Pat. No. 4,199,363, and West German Patent Application (OLS) Nos. 2,541,274, and 2,541,230.

The standard amount of the color coupler to be used is in the range of 0.001 to 1 mol, preferably 0.01 to 0.5 mol for yellow coupler, 0.003 to 0.3 mol for magenta coupler or 0.002 to 0.3 mol for cyan coupler per 1 mol of light-sensitive silver halide.

In the present invention, the above described couplers may be preferably used in combination with a compound as described hereinafter. Particularly, such a compound may be preferably used in combination with a pyrazoloazole coupler. Specifically, a compound (F) which undergoes chemical coupling with an aromatic amine developing agent left after color development to produce a chemically inert and substantially colorless compound and/or a compound (G) which undergoes chemical coupling with an oxidation product of an aromatic amine color developing agent left after color development to produce a chemically inert and substantially colorless compound may be preferably used singly or in combination to inhibit the generation of stain due to the production of color dyes by the reaction of a color developing agent or its oxidation product left in the film during the storage after processing or other side effects.

As a compound (F) there may be preferably used a compound which undergoes reaction with p-anisidine at a second-order reaction velocity constant k2 (in 80° C. trioctyl phosphate) of 1.0 l/mol·sec to $1\times10^{-5}$ l/mol·sec. The second-order reaction velocity constant can be determined in accordance with the method described in JP-A-63-158545.

If k2 exceeds the above described range, the compound becomes unstable itself and subject to reaction with gelatin or water which causes decomposition thereof. On the other hand, if k2 is less than the above described range, the compound reacts with an aromatic amine developing agent left at a lower rate, making it impossible to accomplish prevention of side effects of the aromatic amine developing agent left.

A further preferred example of the compound (F) can be represented by the general formula (FI) or (FII):

$$R_1-(A)_n-X \qquad \text{(FI)}$$

-continued $$R_2-\underset{\underset{B}{\|}}{C}=Y \quad \text{(FII)}$$

wherein $R_1$ and $R_2$ each represents an aliphatic, aromatic or heterocyclic group; n represents 0 or 1; A represents a group which undergoes reaction with an aromatic amine developing agent to form a chemical bond; X represents a group which undergoes reaction with an aromatic amine developing agent to be eliminated; B represents a hydrogen atom, an aliphatic group, an aromatic group, a heterocyclic group, an acyl group or a sulfonyl group; and Y represents a group which accelerates the addition of an aromatic amine developing agent to the compound of the general formula (FII). $R_1$ and X or Y and $R_2$ or B may be connected to each other to form a cyclic structure.

Typical examples of the process for chemical bonding to the aromatic amine developing agent left include a substitution reaction and addition reaction.

Specific preferred examples of compounds (FI) and (FII) include those described in JP-A-63-158545, and JP-A-62-283338, and Japanese Patent Application Nos. 62-158342, and 63-18439.

A further preferred example of the compound (G) which undergoes chemical coupling with an oxidation product of an aromatic amine developing agent left after color development to form a chemically inert and substantially colorless compound can be represented by the general formula (GI):

$$R-Z \quad \text{(GI)}$$

wherein R represents an aliphatic, aromatic or heterocyclic group; and Z represents a nucleophilic group or a group which undergoes decomposition in a light-sensitive material to release a nucleophilic group. A preferred example of the compound represented by the general formula (GI) is a compound wherein Z is a group having Pearson's nucleophilic $CH_3I$ value (R. G. Pearson, et al., "J. Am. Chem. Soc.", 90, 319 (1968)) of 5 or more or derivative thereof.

Specific preferred examples of the compound represented by the general formula (GI) include those described in EP-A-255,722, JP-A-62-143048, and JP-A-62-229145, and Japanese Patent Application Nos. 63-18439, 63-136724, 62-214681, and 62-158342.

Combinations of compounds (G) and compounds (F) are described in detail in Japanese Patent Application No. 63-18439.

In the present invention, the dried film thickness of the color photographic light-sensitive material is preferably in the range of 7 to 13 μm, particularly 8 to 12 μm in the light of rapidity in processing, reduction in the fluctuation of photographic properties in a processing with a less supply amount of processing solution, and image preservability after processing.

If the dried film thickness is less than 7 μm, the film strength is lowered. On the other hand, if the dried film thickness exceeds 13 μm, the above described effect cannot be attained.

In the present invention, the dried film thickness is preferably in the range of 7 to 13 μm, and the wetness of the film is preferably in the range of 100 to 300% in a color developing solution in order to obtain the above described effect.

The term "wetness" as used herein means the measure of equilibrium wet amount obtained when the present light-sensitive material is dipped in a color developing solution, i.e., color developing solution used in Example 1. The wetness is represented by the following equation:

$$\% \text{ Wetness} = 100 \times [(\text{total thickness of wet film/total thickness of dried film}) - 1]$$

In the present invention, the wetness is preferably in the range of 100 to 300%, particularly 150 to 250%.

In the present invention, the calcium atom content of the light-sensitive material is preferably in the range of 14 mg/m$^2$ or less, more preferably 12 mg/m$^2$ or less, particularly 11 mg/m$^2$ or less in order to reduce the fluctuation of photographic properties caused when a high silver chloride content color photographic material is processed with a color developing solution supplied in a less amount or to inhibit the generation of suspended matter or tar in the processing solution.

Gelatin to be incorporated as binder in a silver halide color photographic material normally contains a considerable amount of calcium salt from bone as raw material or the like (several thousands of ppm as calculated in terms of calcium atom unless otherwise specified hereinafter). Therefore, color photographic materials which have been put into practical use normally contain 15 mg/m$^2$ or more of calcium, although it depends on the coated amount thereof.

Examples of the process for the reduction of calcium content in the light-sensitive material include the followings:

(1) To use a raw gelatin having a small calcium content during the preparation of a light-sensitive material; and (2) To desalt gelatin-containing additives such as gelatin solution, emulsion and silver halide emulsion by noodle rinsing, rinsing with water or dialysis during the preparation of a light-sensitive material.

In the light of the stability of the light-sensitive material during the preparation, the process (1) may be preferably used. In order to obtain deionized gelatin (Ca content: 100 ppm or less) by reducing the calcium content in gelatin, gelatin may be subjected to processing with an $Na^+$ or $H^+$ type ion exchange resin or dialysis. Regardless of which process is used, any gelatin with a small calcium content may be preferably used in the present invention.

When a light-sensitive material is prepared, gelatin may be incorporated in the form of a gelatin solution as silver halide emulsion, emulsion containing coupler or the like or mere binder. Therefore, the present light-sensitive material can be prepared by incorporating gelatin with a small calcium content in the entire part or a part of these additives.

The photographic light-sensitie material to be used in the present invention may be coated on a commonly used support such as flexible support (e.g., plastic film such as cellulose nitrate, cellulose acetate, polyethylene terephthalate, and paper), or rigid support (e.g., glass). Examples of such supports and coating methods are described in detail in *Research Disclosure* No. 17,643 (XV, p. 27), XVII (p. 28), December 1978.

In the present invention, a reflective support may be preferably used. Such a reflective support is adapted to improve the reflectivity of the light-sensitive material so that dye images formed in the silver halide emulsion layer are made clear. As such a reflective support there may be preferably used a support material comprising a hydrophobic resin having a reflective material such as titanium oxide, zinc oxide, calcium carbonate or calcium sulfate dispersed therein coated on the surface thereof or a hydrophobic resin comprising a reflective material dispersed therein.

The present invention will be further described in the following examples, but the present invention should not be construed as being limited thereto. In the Examples, all percents, parts and ratios are by weight unless otherwise indicated.

EXAMPLE 1

A multilayer color photographic paper A was prepared by coating various layers of the following compositions on a paper support laminated with polyethylene on both sides thereof. The coating solutions used were prepared by mixing emulsions, various chemicals and emulsion dispersions of coupler. The preparation of these coating solutions will be described hereinafter.

Preparation of Coupler Emulsion 19.1 g of a yellow coupler (ExY) and 4.4 g of a dye stabilizer (Cpd-1) were dissolved in 27.2 cc of ethyl acetate and 7.7 cc of a solvent (Solv-1). The solution thus obtained was then emulsion-dispersed in 185 cc of a 10% aqueous solution of gelatin containing 8 cc of 10% sodium dodecylbenzenesulfonate.

Emulsions for magenta dye, cyan dye and the interlayer were similarly prepared. Compounds used in these emulsions will be shown hereinafter.

(ExY) Yellow coupler

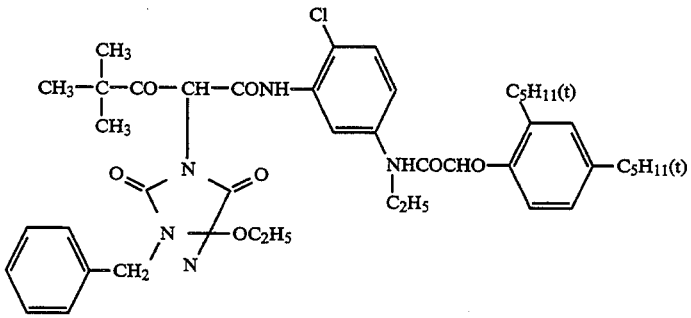

(ExM1) Magenta coupler

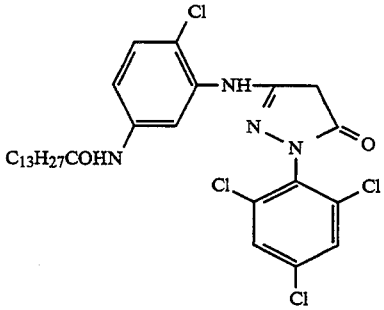

(ExC1)

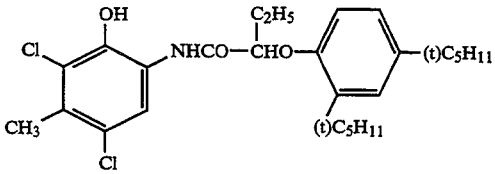

(ExC2)

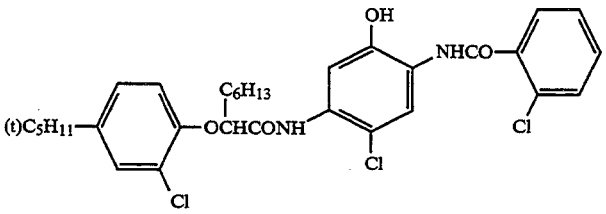

(Cpd-1) Dye stabilizer

-continued
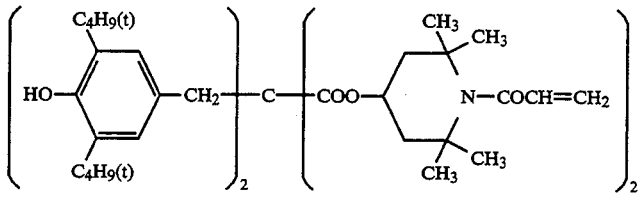
(Cpd-2) Color stain inhibitor
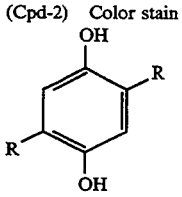
R = $C_8H_{17}$(sec)
(Cpd-3)
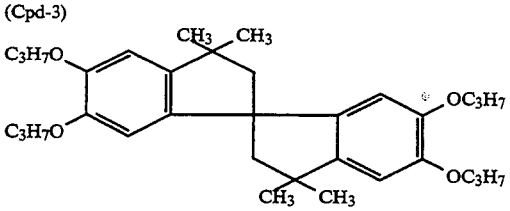
(Cpd-4)
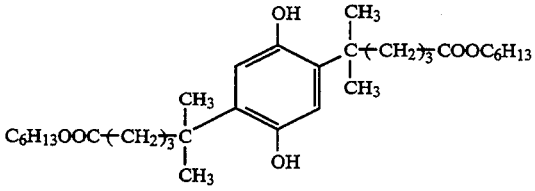
(Cpd-5) Color stain inhibitor
Same as Cpd-2, wherein R = $C_8H_{17}$(t)
(Cpd-6) Dye stabilizer
Mixture of 6a:6b:6c = 5:8:9
6a
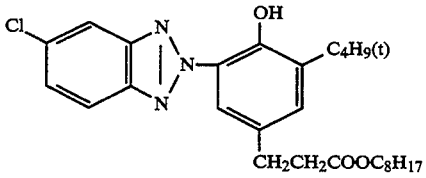
6b
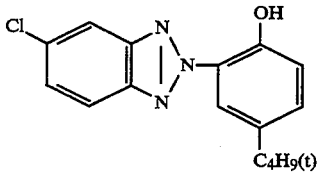
6c
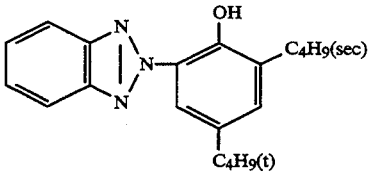
(Cpd-7) Polymer
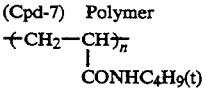
Average molecular weight: 80,000

-continued (UV-1) Ultraviolet absorber
Mixture of Cpd-6a:6b:6c = 2:9:8

(Solv-1) Solvent

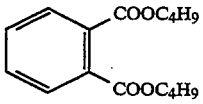

(Solv-2) Solvent
$O{=}P{-}(O{-}C_8H_{17}(iso))_3$ (Solv-3) Solvent
$O{=}P{-}(O{-}C_9H_{19}(iso))_3$ (Solv-4) Solvent

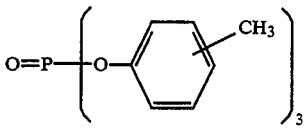

For the purpose of inhibiting irradiation, the following dyes were incorporated in the various emulsion layers.

Red-sensitive layer: Dye-R

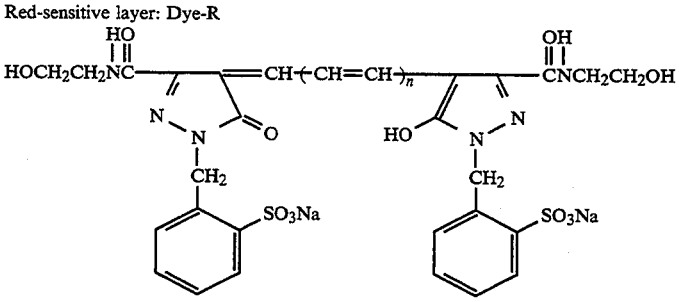

wherein n = 2
Green-sensitive layer: Same as to Dye-R (wherein n = 1)

The following compound was incorporated in the red-sensitive emulsion layer in an amount of $2.6\times10^{-3}$ mol per mol of silver halide.

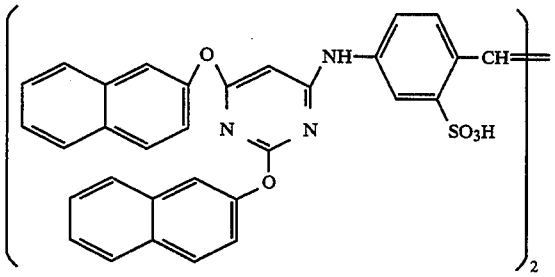

The emulsions used in the present example will be described hereinafter.

Blue-Sensitive Emulsion

A monodisperse emulsion of cubic silver chloride grains (containing $K_2IrCl_6$ and 1,3-dimethylimidazoline-2-thione) having an average particle size of 1.1 μm and a fluctuation coefficient of 0.10 (as determined by dividing the standard deviation of particle sizes by the average particle size; s/d) was prepared by a conventional method. 26 cc of a 0.6% solution of a spectral sensitizing dye for blue color (S-1) was added to 1.0 kg of the emulsion thus prepared. The emulsion was then ripened with an emulsion of finely divided grains of silver bromide having a particle size of 0.05 μm in an amount of 0.5 molt based on the amount of the host silver chloride emulsion. The emulsion was then subjected to optimum chemical sensitization with sodium thiosulfate. A stabilizer (Stb-1) was added to the emulsion in an amount of $10^{-4}$ mol/mol Ag to prepare the desired blue-sensitive emulsion.

Green-Sensitive Emulsion

Silver chloride grains containing $K_2IrCl_6$ and 1,3-dimethylimidazoline-2-thione were prepared by a conventional method. The emulsion was then ripened with sensitizing dye (S-2) in an amount of $4\times10^{-4}$ mol/mol Ag and KBr. The emulsion was then subjected to optimum chemical sensitization with sodium thiosulfate. A stabilizer (Stb-1) was added to the emulsion in an amount of $5\times10^{-4}$ mol/mol Ag to prepare a monodisperse emulsion of cubic silver chloride grains having an average particle size of 0.48 μm and a fluctuation coefficient of 0.10.

Red-Sensitive Emulsion

A red-sensitive emulsion was prepared in the same manner as in the green-sensitive emulsion except that S-2 was replaced by a sensitizing dye (S-3) in an amount of $1.5\times10^{-4}$ mol/mol Ag.

The compounds used will be shown hereinafter.

(S-1) Sensitizing dye

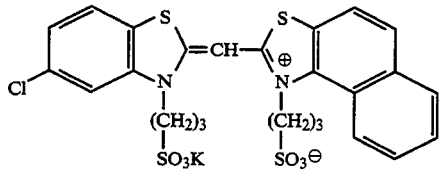

(S-2) Sensitizing dye

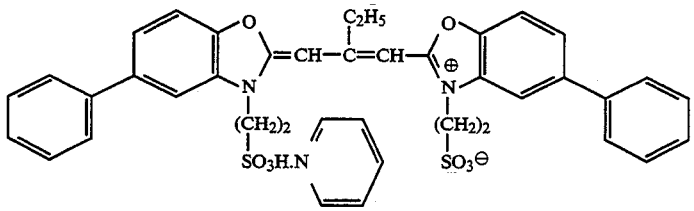

(S-3) Sensitizing dye

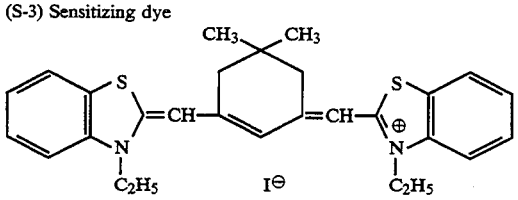

(Stb-1) Stabilizer

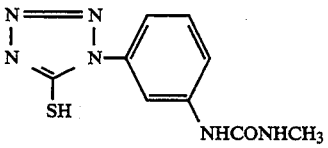

Layer Composition

The composition of the various layers will be described hereinafter. The figures indicate the coated amount of the components (g/m$^2$). The coated amount of silver halide emulsion is represented in terms of coated amount of silver.

| | |
|---|---|
| Support: | |
| Polyethylene-laminated paper [containing a white pigment ($TiO_2$) and a blue dye (ultramarine) in polyethylene on the 1st layer side] | |
| 1st layer: blue-sensitive layer | |
| Silver halide emulsion | 0.25 |
| Gelatin | 1.86 |
| Yellow coupler (ExY) | 0.82 |
| Dye stabilizer (Cpd-1) | 0.19 |
| Solvent (Solv-1) | 0.35 |
| 2nd layer: color stain inhibiting layer | |
| Gelatin | 0.99 |
| Color stain inhibitor (Cpd-2) | 0.08 |
| 3rd layer: green-sensitive layer | |
| Silver halide emulsion | 0.31 |
| Gelatin | 1.24 |
| Magenta coupler (ExM-1) | 0.31 |
| Dye stabilizer (Cpd-3) | 0.25 |
| Dye stabilizer (Cpd-4) | 0.12 |
| Solvent (Solv-2) | 0.42 |
| 4th layer: ultraviolet absorbing layer | |
| Gelatin | 1.58 |
| Ultraviolet absorber (UV-1) | 0.62 |
| Color stain inhibitor (Cpd-5) | 0.05 |
| Solvent (Solv-3) | 0.24 |
| 5th layer: red-sensitive layer | |
| Silver halide emulsion | 0.21 |
| Gelatin | 1.34 |

-continued

| | |
|---|---|
| Cyan coupler (1:1 mixture of ExC1 and C2) | 0.34 |
| Dye stabilizer (Cpd-6) | 0.17 |
| Polymer (Cpd-7) | 0.40 |
| Solvent (Solv-4) | 0.23 |
| 6th layer: ultraviolet absorbing layer | |
| Gelatin | 0.53 |
| Ultraviolet absorber (UV-1) | 0.21 |
| Solvent (Solv-3) | 0.08 |
| 7th layer: protective layer | |
| Gelatin | 1.33 |
| Acryl-modified copolymer of polyvinyl alcohol (modification degree: 17%) | 0.17 |
| Liquid paraffin | 0.03 |

Phenol was incorporated in gelatin in the various layers as a preservative in an amount of 0.05% based on the amount of gelatin. 1-Oxy-3,5-dichloro-S-triazine sodium was incorporated in the various layers as film hardener.

Specimens A to G were then prepared in the same manner as in Specimen A except that the gelatin preservative was altered as shown in Table 1.

TABLE 1

| Specimen | A | B | C | D | E | F | G |
|---|---|---|---|---|---|---|---|
| Preservative | Phenol | a-1 | a-2 | I-1 | II-45 | II-14 | IV-1 |
| Added amount | 0.05% based on | " | " | " | " | " | " |

TABLE 1-continued

| Specimen | A | B | C | D | E | F | G |
|---|---|---|---|---|---|---|---|
| | gelatin | | | | | | |

(a-1)

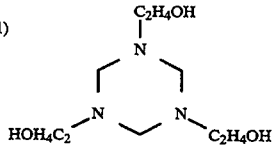

(described in JP-A-62-231955)

(a-2)

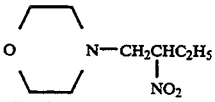

(described in JP-A-59-128537 and JP-A-62-231955)

These coated specimens were then subjected to the following experiment to determine their photographic properties.

These coated specimens were first subjected to gradient exposure for sensitometry by means of a sensitometer (Fuji Photo Film Co., Ltd.'s Type FWH sensitometer; color temperature of light source: 3,200° K.). The exposure was effected for 1/10 second so that the exposure reached 250 CMS.

These exposed coated specimens were then imagewise exposed to light. These coated specimens were continuously processed with the following processing solutions at the following processing steps until the color developing solution was supplied twice the volume of the tank (running test). The composition of the color developing solution was altered as shown in Table 2.

| Processing Step | Temperature | Time | Supply Amount | Tank Volume |
|---|---|---|---|---|
| Color development | 38° C. | 45 sec. | 100 ml | 8 l |
| Blix | 30–36° C. | 45 sec. | 161 ml | 8 l |
| Rinse 1 | 30–37° C. | 20 sec. | — | 4 l |
| Rinse 2 | 30–37° C. | 20 sec. | — | 4 l |
| Rinse 3 | 30–37° C. | 20 sec. | — | 4 l |
| Rinse 4 | 30–37° C. | 30 sec. | 200 ml | 4 l |
| Drying | 70–80° C. | 60 sec. | | |

(The supply amount is represented in terms of amount per 1 $m^2$ of light-sensitive material. The rinse was conducted in a countercurrent process in which the rinsing solution was passed from tank 4 to tank 1 through tanks 3 and 2.)

| | Tank Solution | Supply Liquid |
|---|---|---|
| Color developing solution | | |
| Water | 800 ml | 800 ml |
| Benzyl alcohol | Shown in TABLE 2 | |
| Ethylenediamine-N,N,N,N-tetramethylenephosphonic acid | 3.0 g | 6.0 g |
| Organic preservative A (VI-1) | 0.03 mol | 0.07 mol |
| Sodium chloride | 3.9 g | — |
| Potassium carbonate | 25 g | 25 g |
| N-ethyl-N-(β-methanesulfonamide-ethyl)-3-methyl-4-aminoaniline sulfate | 5.5 g | 12.0 g |
| Organic preservative B (XII-1) | 0.05 mol | 0.07 mol |
| Fluorescent brightening agent (4,4'-diaminostilbene series) | 2.0 g | 4.0 g |
| Water to make | 1,000 ml | 1,000 ml |
| pH (25° C.) | 10.05 | 10.85 |
| Blix-solution (the tank solution was used also as supply liquid) | | |
| Water | | 400 ml |
| Ammonium thiosulfate (70%) | | 100 ml |
| Sodium sulfite | | 17 g |
| Ferric ammonium ethylenediaminetetraacetate | | 55 g |
| Disodium ethylenediaminetetraacetate | | 5 g |
| Ammonium bromide | | 40 g |
| Glacial acetic acid | | 9 g |
| Water to make | | 1,000 ml |
| pH (25° C.) | | 5.40 |
| Rinsing solution (The tank solution was used also as supply liquid | | |
| Ion-exchanged water (calcium and magnesium concentration: 3 ppm or less each) | | |

When the running test began and ended, the sensitometry was processed. The maximum density (Dmax), sensitivity (log E indicating a density of 0.5) and gradation (density change at an exposure of +log E=0.3 with respect to the exposure indicating a density of 0.5) were measured by means of a Macbeth densitometer. Thus, the change in these values between before and after the running test was obtained. The results are shown in Table 2. In the sensitivity change, the mark + indicates an increase in the sensitivity while the mark − indicates a decrease in the sensitivity. When the running test ended, the density of the developing agent left in the color developing solution was measured by means of liquid chromatography. The results are shown in Table 2.

Furthermore, when the running test ended, the color developing solution was checked with the eye to confirm the presence of suspended matter. The results are shown in Table 2.

TABLE 2

| Processing step | | (1) | (2) | (3) | (4) | (5) | (6) | (7) | (8) | (9) |
|---|---|---|---|---|---|---|---|---|---|---|
| Light-sensitive material | | A | B | C | D | D | E | F | G | G |
| Benzyl alcohol (ml/l) | | | | | | | | | | |
| Tank solution | | — | 15.0 | — | 15.0 | — | — | — | — | 15.0 |
| Supply liquid | | — | 36.0 | — | 36.0 | — | — | — | — | 36.0 |
| Remarks | | Comparative example | Comparative example | Comparative example | Present invention | Present invention | Present invention | Present invention | Present invention | Present invention |
| BL | ΔDmax | −0.18 | −0.17 | −0.14 | −0.04 | −0.01 | ±0.0 | +0.01 | ±0.0 | −0.04 |
| | ΔSensitivity | −0.07 | −0.06 | −0.06 | −0.02 | ±0.0 | ±0.0 | ±0.0 | ±0.0 | −0.01 |
| | ΔGradation | −0.14 | −0.10 | −0.11 | −0.03 | ±0.0 | ±0.01 | ±0.0 | ±0.0 | −0.02 |
| GL | ΔDmax | −0.08 | −0.08 | −0.06 | −0.03 | ±0.0 | ±0.0 | ±0.0 | +0.01 | −0.02 |
| | ΔSensitivity | −0.04 | −0.03 | −0.03 | −0.02 | ±0.0 | ±0.0 | ±0.0 | ±0.0 | −0.01 |
| | ΔGradation | −0.03 | −0.03 | −0.03 | −0.01 | ±0.0 | ±0.0 | ±0.0 | ±0.0 | −0.01 |
| RL | ΔDmax | −0.08 | −0.09 | −0.06 | −0.03 | −0.01 | ±0.01 | +0.01 | ±0.0 | −0.02 |
| | ΔSensitivity | −0.02 | −0.02 | −0.02 | −0.01 | ±0.0 | ±0.0 | ±0.0 | ±0.0 | ±0.0 |
| | ΔGradation | −0.02 | −0.02 | −0.02 | ±0.0 | ±0.0 | ±0.0 | ±0.0 | ±0.0 | −0.01 |
| Developing agent density at end of | | 4.1 | 4.5 | 5.2 | 5.2 | 5.4 | 5.5 | 5.6 | 5.4 | 5.4 |

TABLE 2-continued

| | | | | | | | | | |
|---|---|---|---|---|---|---|---|---|---|
| running test (g/l) Suspended matter | xx | xx | x | Δ | ∘ | ∘ | ∘ | ∘ | Δ |

∘: none
Δ: slight
x: some
xx: large amount

REFERENCE EXAMPLE 1

In order to determine the sterilizing effect of the compounds of the general formulas (I) to (IV), these compounds were added to 100 ml of an aqueous solution of gelatin containing 7 g of gelatin in amounts shown in Table 3 to prepare specimens (Nos. 1 to 7) as shown in Table 3. A mixture of bacteria belonging to Pseudmonas was cultured with shaking in each specimen at a temperature of 37° C. for 36 hours after being brought into contact with the specimen. The number of bacteria in each specimen was then measured. The results are shown in Table 3.

TABLE 3

| Specimen No. | | Added amount of Compound (mg) | | | | | | | | | Number of bacteria per ml |
|---|---|---|---|---|---|---|---|---|---|---|---|
| | | | I-1 | I-5 | II-40 | II-45 | III-3 | III-14 | IV-1 | IV-5 | |
| 1 | Comparative Example | — | — | — | — | — | — | — | — | — | $9 \times 10^7$ |
| 2 | Comparative Example | 3.5 | — | — | — | — | — | — | — | — | $4 \times 10^4$ |
| 3 | Present invention | — | 3.5 | — | — | — | — | — | — | — | $4 \times 10$ |
| 4 | Present invention | — | — | 3.5 | — | — | — | — | — | — | $2 \times 10^3$ |
| 5 | Present invention | — | — | — | 3.5 | — | — | — | — | — | $4 \times 10^2$ |
| 6 | Present invention | — | — | — | — | 3.5 | — | — | — | — | $2 \times 10$ |
| 7 | Present invention | — | — | — | — | — | 3.5 | — | — | — | $2 \times 10^2$ |
| 8 | Present invention | — | — | — | — | — | — | 3.5 | — | — | $4 \times 10$ |
| 9 | Present invention | — | — | — | — | — | — | — | 3.5 | — | $3 \times 10$ |
| 10 | Present invention | — | — | — | — | — | — | — | — | 3.5 | $8 \times 10^2$ |
| 11 | Present invention | — | 2.0 | — | — | 2.0 | — | — | — | — | $1 \times 10$ |
| 12 | Present invention | — | — | — | — | — | — | 2.0 | 2.0 | — | $2 \times 10$ |
| 13 | Present invention | — | 2.0 | — | — | — | — | 2.0 | — | — | $3 \times 10$ |
| 14 | Present invention | — | — | — | — | 2.0 | — | — | 2.0 | — | $1 \times 10$ |
| 15 | Present invention | — | 1.0 | — | — | 1.0 | — | 1.0 | 1.0 | — | $1 \times 10$ |

Table 2 shows that the light-sensitive materials free of the compounds of the general formulas (I), (II), (III), (IV) and (V) exhibit a rather great fluctuation in the maximum density, sensitivity and gradation between before and after the running test as shown in the processing steps 1 to 3. Furthermore, it was observed that the color developing solution for the processing steps 1 to 3 after the running test exhibited a deterioration in the developing agent and a large amount of dye-like matter suspended thereon although its running test condition was the same as the processing steps 4 to 9.

The light-sensitive materials comprising the present compounds of the general formulas (I), (II), (III) and (IV) exhibited a less decrease in the change of photographic properties, little deterioration in the developing agent and little generation of suspended matter due to the running test as shown in the processing steps 4 to 9.

As shown in the processing steps 4 to 9, the present compounds may be preferably used in the light of the fluctuation in photographic properties and generation of suspended matter due to the running test in the case where the color developing solution is free of benzyl alcohol.

As can be seen in the results in Table 3, the specimens comprising the compounds of the general formulas (I), (II), (III) and (IV) can remarkably inhibit the proliferation of bacteria.

EXAMPLE 2

Specimens B to G were prepared in the same manner as in Specimen A in Example 1 except that the gelatin preservative was replaced by those shown in Table 4.

TABLE 4

| Specimen | A | B | C | D | E | F | G |
|---|---|---|---|---|---|---|---|
| Preservative | Phenol | a-1 | a-2 | V-35 | V-22 | V-25 | V-28 |
| Added amount | 0.05% based on | " | " | " | " | " | " |

TABLE 4-continued

| Specimen | A | B | C | D | E | F | G |
|---|---|---|---|---|---|---|---|
| | gelatin | | | | | | |

(a-1)

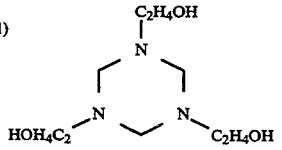

(Preservative described in JP-A-62-231955)

(a-2)

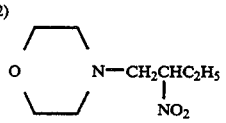

(Preservative described in JP-A-59-128537 and JP-A-62-231955)

In order to determine the photographic properties of these specimens, the following experiment was conducted.

These specimens were first subjected to gradient exposure for sensitometry by means of a sensitometer (Fuji Photo Film Co., Ltd.'s Type FWH sensitometer; color temperature of light source: 3,200° K.). The exposure was effected for 1/10 second so that the exposure reached 250 CMS.

These coated specimens were then imagewise exposed to light. These coat specimens were then continuously processed with the following processing solutions at the following processing steps until the processing solutions were supplied twice the volume of the color developing solution tank (running test). The composition of the color developing solution was altered as shown in Table 5.

-continued

| Processing Step | Temperature | Time | Supply Amount | Tank Volume |
|---|---|---|---|---|
| Drying | 70–80° C. | 60 sec. | | |

(The supply amount is represented in terms of amount per 1 $m^2$ of light-sensitive material. The rinsing step was effected in a countercurrent process in which the rinsing solution was passed from the tank 4 to the tank 1 through the tanks 3 and 2.)

The composition of the various processing solutions will be described hereinafter.

| | Tank Solution | Supply Liquid |
|---|---|---|
| Color developing solution | | |
| Water | 800 ml | 800 ml |
| Benzyl alcohol | Shown in TABLE 5 | |
| Ethylenediamine-N,N,N,N-tetramethylenephosphonic acid | 3.0 g | 6.0 g |
| Organic preservative A (VI-1) | 0.03 mol | 0.07 mol |
| Sodium chloride | 4.0 g | — |
| Potassium carbonate | 25 g | 25 g |
| N-ethyl-N-(β-methanesulfonamide ethyl)-3-methyl-4-aminoaniline sulfate | 5.5 g | 12.0 g |
| Organic preservative B (XII-1) | 0.05 mol | 0.07 mol |
| Fluorescent brightening agent (4,4'-diaminostilbene series) | 2.0 g | 4.0 g |
| Water to make | 1,000 ml | 1,000 ml |
| pH (25° C.) | 10.10 | 10.90 |

The preparation and composition of the blix solution and the rinsing solution are the same as in Example 1.

These specimens were evaluated in the same manner as in Example 1. The results are shown in Table 5.

TABLE 5

| Processing step | | (1) | (2) | (3) | (4) | (5) | (6) | (7) | (8) | (9) |
|---|---|---|---|---|---|---|---|---|---|---|
| Light-sensitive material | | A | B | C | D | D | E | F | G | G |
| Benzyl alcohol (ml/l) | | | | | | | | | | |
| Tank solution | | — | 15.0 | — | 15.0 | — | — | — | — | 15.0 |
| Supply liquid | | — | 36.0 | — | 36.0 | — | — | — | — | 36.0 |
| Remarks | | Comparative example | Comparative example | Comparative example | Present invention | Present invention | Present invention | Present invention | Present invention | Present invention |
| BL | ΔDmax | −0.20 | −0.17 | −0.15 | −0.05 | +0.00 | +0.03 | ±0.0 | −0.02 | −0.05 |
| | ΔSensitivity | −0.08 | −0.07 | −0.07 | −0.02 | ±0.0 | −0.02 | ±0.0 | −0.01 | −0.02 |
| | ΔGradation | −0.15 | −0.12 | −0.11 | −0.01 | ±0.0 | ±0.0 | ±0.0 | −0.01 | −0.02 |
| GL | ΔDmax | −0.09 | −0.09 | −0.07 | −0.03 | ±0.0 | −0.01 | ±0.0 | −0.02 | −0.03 |
| | ΔSensitivity | −0.05 | −0.03 | −0.03 | −0.01 | ±0.0 | −0.01 | ±0.0 | −0.01 | −0.01 |
| | ΔGradation | −0.03 | −0.03 | −0.02 | ±0.0 | ±0.0 | ±0.0 | ±0.0 | ±0.0 | −0.01 |
| RL | ΔDmax | −0.08 | −0.09 | −0.06 | −0.01 | ±0.0 | ±0.0 | ±0.0 | −0.01 | −0.01 |
| | ΔSensitivity | −0.02 | −0.02 | −0.03 | −0.01 | ±0.0 | −0.01 | ±0.0 | ±0.0 | ±0.0 |
| | ΔGradation | −0.03 | −0.02 | −0.02 | ±0.0 | ±0.0 | −0.01 | ±0.0 | ±0.0 | −0.01 |
| Developing agent density at end of running test (g/l) | | 3.9 | 4.4 | 5.3 | 5.2 | 5.5 | 5.6 | 5.4 | 5.5 | 5.3 |
| Suspended matter | | xx | xx | x | Δ | ∘ | ∘ | ∘ | ∘ | Δ |

∘: none
Δ: slight
x: some
xx: large amount

| Processing Step | Temperature | Time | Supply Amount | Tank Volume |
|---|---|---|---|---|
| Color development | 36° C. | 45 sec. | 97 ml | 8 l |
| Blix | 30–36° C. | 45 sec. | 161 ml | 8 l |
| Rinse 1 | 30–37° C. | 20 sec. | — | 4 l |
| Rinse 2 | 30–37° C. | 20 sec. | — | 4 l |
| Rinse 3 | 30–37° C. | 20 sec. | — | 4 l |
| Rinse 4 | 30–37° C. | 30 sec. | 200 ml | 4 l |

Table 5 shows that the light-sensitive materials free of the compounds of the general formulae (I), (II), (III), (IV) and (V) exhibit a rather great fluctuation in the maximum density, sensitivity and gradation between before and after the running test as shown in the processing steps 1 to 3.

Furthermore, it was observed that the color developing solution for the processing steps 1 to 3 after the running test exhibited a deterioration in the developing agent and had a large amount of dye-like matter suspended therein although its running test condition was the same as the processing steps 4 to 9.

The light-sensitive materials comprising the present compound of the general formula (V) exhibited less of a decrease in the change of photographic properties, little deterioration in the developing agent and little generation of suspended matter due to the running test as shown in the processing steps 4 to 9.

As shown in the processing steps 4 to 9, the present compound may be preferably used in the light of the fluctuation in photographic properties and generation of suspended matter due to the running test in the case where the color developing solution is free of benzyl alcohol.

REFERENCE EXAMPLE 2

In order to determine the sterilizing effect of the compound of the general formula (V), the compound of the present invention was added to 100 ml of an aqueous solution of gelatin containing 7 g of gelatin in amounts shown in Table 6 to prepare specimens (Nos. 1 to 7) as shown in Table 6. A mixture of bacterial belonging to Pseudmonas was cultured with shaking in each specimen at a temperature of 37° C. for 48 hours after being brought into contact with the specimen. The number of bacteria in each specimen was then measured. The results are shown in Table 6.

TABLE 6

| Specimen No. | | Added amount of Compound (mg) | | | | | | | | | Number of bacteria per ml |
|---|---|---|---|---|---|---|---|---|---|---|---|
| | | Phenol | V-2 | V-4 | V-22 | V-25 | V-28 | V-33 | V-35 | V-42 | |
| 1 | Comparative Example | — | — | — | — | — | — | — | — | — | $2 \times 10^8$ |
| 2 | Comparative Example | 3.5 | — | — | — | — | — | — | — | — | $5 \times 10^4$ |
| 3 | Present invention | — | 3.5 | — | — | — | — | — | — | — | $2 \times 10^2$ |
| 4 | Present invention | — | — | 3.5 | — | — | — | — | — | — | $6 \times 10^2$ |
| 5 | Present invention | — | — | — | 3.5 | — | — | — | — | — | $3 \times 10$ |
| 6 | Present invention | — | — | — | — | 3.5 | — | — | — | — | $1 \times 10$ |
| 7 | Present invention | — | — | — | — | — | 3.5 | — | — | — | $6 \times 10$ |
| 8 | Present invention | — | — | — | — | — | — | 3.5 | — | — | $1 \times 10^3$ |
| 9 | Present invention | — | — | — | — | — | — | — | 3.5 | — | $6 \times 10^2$ |
| 10 | Present invention | — | — | — | — | — | — | — | — | 3.5 | $1 \times 10^3$ |
| 11 | Present invention | — | — | — | 2.0 | 2.0 | — | — | — | — | $1 \times 10$ |
| 12 | Present invention | — | — | — | 2.0 | — | 2.0 | — | — | — | $1 \times 10$ |
| 13 | Present invention | — | — | — | — | 2.0 | 2.0 | — | — | — | $2 \times 10$ |
| 14 | Present invention | — | 2.0 | — | — | 2.0 | — | — | — | — | $5 \times 10$ |
| 15 | Present invention | — | — | 2.0 | — | — | 2.0 | — | — | — | $4 \times 10$ |

As can be seen in the results in Table 6, the specimens comprising the compound of the general formula (V) can remarkably inhibit the proliferation of bacteria.

EXAMPLE 3

The same experiment was conducted as in Example 1 except that the compound III-14 to be incorporated in the light-sensitive material specimen F at the processing step 7 was replaced by the compounds II-1, II-40, III-3, III-15, IV-3 and IV-5, respectively. Excellent results were obtained as in Example 1.

EXAMPLE 4

The same experiment was conducted as in Example 2 except that the compound V-25 to be incorporated in the light-sensitive material specimen F at the processing step 7 was replaced by the compounds V-4, V-16, V-20, V-26, V-33 and V-2, respectively. Excellent results were obtained as in Example 2.

EXAMPLE 5

The same experiment was conducted as in Example 1 except that the preservative VI-1 to be incorporated in the color developing solution at the processing step 6 was replaced by the compounds VI-2, VII-7, VIII-12, VIII-28, VIII-44, IX-4, X-1 and XI-5, respectively. Excellent results were obtained as in Example 1. Furthermore, the same experiment was conducted as in Example 1 except that the preservative XII-1 to be incorporated in the color developing solution was replaced by the compounds XIII-5, XIII-8, XIV-1, XIV-3, XV-1, XV-3, XVI-1, XVI-2, XVII-3, XVII-10, XVIII-8, XIX-1, XX-1, XX-6, and XXI-1, respectively. Excellent results were obtained as in Example 1.

EXAMPLE 6

The light-sensitive material specimens A to G prepared in Example 1 were imagewise exposed to light. These specimens were then continuously processed with the following processing solutions at the following processing steps until the color developing solution was supplied twice the volume of the tank (running test). The composition of the color developing solution was altered as shown in Table 7.

| Processing Step | Temperature | Time | Supply Amount | Tank Volume |
|---|---|---|---|---|
| Color development | 38° C. | 45 sec. | 80 ml | 8 l |
| Blix | 30–36° C. | 45 sec. | 161 ml | 8 l |
| Rinse 1 | 30–37° C. | 20 sec. | — | 4 l |
| Rinse 2 | 30–37° C. | 20 sec. | — | 4 l |
| Rinse 3 | 30–37° C. | 20 sec. | — | 4 l |
| Rinse 4 | 30–37° C. | 30 sec. | 200 ml | 4 l |
| Drying | 70–80° C. | 60 sec. | | |

(The supply amount is represented in terms of amount per 1 $m^2$ of light-sensitive material. The rinsing step was effected in a countercurrent process in which the rinsing solution was passed from the tank 4 to the tank 1 through the tanks 3 and 2.)

The composition of the various processing solutions will be described hereinafter.

| | Tank Solution | Supply Liquid |
|---|---|---|
| Color developing solution | | |
| Water | 800 ml | 800 ml |
| Ethylenediamine-N,N,N,N-tetramethylenephosphonic acid | 3.5 g | 7.0 g |
| Organic preservative A (shown in Table 7) | 0.04 mol | 0.08 mol |
| Sodium chloride | 4.5 g | — |
| Potassium carbonate | 25 g | 25 g |
| N-ethyl-N-(β-methanesulfonamidethyl)-3-methyl-4-aminoaniline sulfate | 5.5 g | 12.0 g |
| Organic preservative B (shown in Table 7) | 0.06 mol | 0.08 mol |
| Fluorescent brightening agent (4,4'-diaminostilbene series) | 2.0 g | 4.0 g |
| Sodium sulfite | Shown in Table 7 | |
| Water to make | 1,000 ml | 1,000 ml |
| pH (25° C.) | 10.20 | 10.95 |

When the running test began and ended, the sensitometry was processed. The maximum density (Dmax), sensitivity (log E indicating a density of 0.5) and gradation (density change at an exposure of +log E=0.3 with respect to the exposure indicating a density of 0.5) were measured by means of a Macbeth densitometer. Thus, the change in these values between before and after the running test was obtained. The results are shown in Table 7. In the sensitivity change, the mark + indicates an increase in the sensitivity while the mark − indicates a decrease in the sensitivity.

Furthermore, when the running test ended, the color developing solution was checked with the eye to confirm the presence of suspended matter therein. The results are shown in Table 7.

TABLE 7

| Processing step | (1) | (2) | (3) | (4) | (5) | (6) | (7) | (8) | (9) |
|---|---|---|---|---|---|---|---|---|---|
| Light-sensitive material | A | B | C | D | E | E | E | F | G |
| Sodium sulfite (g/l) | | | | | | | | | |
| Tank solution | — | — | 2.5 | — | — | 2.5 | — | — | — |
| Supply liquid | — | — | 5.0 | — | — | 5.0 | — | — | — |
| Organic preservative A | Hydroxylamine | VI-1 | VI-1 | VI-1 | Hydroxylamine | VI-1 | VI-1 | VIII-7 | VIII-48 |
| Organic preservative B | XII-1 | XII-1 | — | XII-1 | XII-1 | — | XII-1 | XXI-7 | XXI-7 |
| Remarks | Comparative example | Comparative example | Comparative example | Present invention | Present invention | Present invention | Present invention | Present invention | Present invention |
| BL ΔDmax | −0.28 | −0.26 | −0.29 | −0.01 | +0.09 | +0.10 | −0.01 | ±0.0 | +0.01 |
| ΔSensitivity | −0.10 | −0.09 | −0.10 | −0.01 | +0.03 | +0.03 | ±0.0 | ±0.0 | ±0.0 |
| ΔGradation | −0.16 | −0.17 | −0.17 | ±0.0 | +0.06 | +0.06 | ±0.0 | +0.01 | ±0.0 |
| Suspended matter | xx | xx | xx | ○ | ○ | ○ | ○ | ○ | ○ |

○: none
Δ: slight
x: some
xx: large amount

As can be seen in Table 7, the light-sensitive material specimens free of the compounds of the general formulas (I), (II), (III), (IV) and (V) as gelatin preservative exhibit a rather great fluctuation in the maximum density, sensitivity and gradation between before and after the running test as shown in the processing steps 1 to 3. When the running test ended, it was observed that a large amount of suspended matter had been produced in the color developing solution.

Furthermore, the light-sensitive material specimens comprising the present compounds of the general formulas (I), (II), (III) and (IV) exhibited a less fluctuation in the photographic properties and little generation of suspended matter due to the running test as shown in the processing steps 4 to 9.

As shown in the processing steps 4 to 9, the present specimens may be preferably free of sodium sulfite or hydroxylamine in the light of fluctuation in the photographic properties. It was also found that hydroxylamine or sodium sulfite may be preferably replaced by the compound VI-1, VIII-7, VIII-48, XII-1 or XXI-7 as preservative in the light of fluctuation in the photographic properties.

EXAMPLE 7

The light-sensitive material specimens A to G as used in Example 2 were imagewise exposed to light. These specimens were then continuously processed with the following processing solutions at the following processing steps until the color developing solution was supplied twice the tank volume (running test). The composition of the color developing solution was altered as shown in Table 8.

| Processing Step | Temperature | Time | Supply Amount | Tank Volume |
|---|---|---|---|---|
| Color development | 38° C. | 45 sec. | 80 ml | 8 l |
| Blix | 30–36° C. | 45 sec. | 161 ml | 8 l |
| Rinse 1 | 30–37° C. | 20 sec. | — | 4 l |
| Rinse 2 | 30–37° C. | 20 sec. | — | 4 l |
| Rinse 3 | 30–37° C. | 20 sec. | — | 4 l |
| Rinse 4 | 30–37° C. | 30 sec. | 200 ml | 4 l |

-continued

| Processing Step | Temperature | Time | Supply Amount | Tank Volume |
|---|---|---|---|---|
| Drying | 70–80° C. | 60 sec. | | |

(The supply amount is represented in terms of amount per 1 $m^2$ of light-sensitive material. The rinsing step was effected in a countercurrent process in which the rinsing solution was passed from the tank 4 to the tank 1 through the tanks 3 and 2.)

The composition of the various processing solutions will be described hereinafter.

| | Tank Solution | Supply Liquid |
|---|---|---|
| Color developing solution | | |
| Water | 800 ml | 800 ml |
| Ethylenediamine-N,N,N,N-tetramethylenephosphonic acid | 3.5 g | 7.0 g |
| Organic preservative A (shown in Table 8) | 0.04 mol | 0.08 mol |
| Sodium chloride | 5.0 g | — |
| Potassium carbonate | 25 g | 25 g |
| N-ethyl-N-(β-methanesulfonamidethyl)-3-methyl-4-aminoaniline sulfate | 5.0 g | 11.0 g |
| Organic preservative B (shown in Table 8) | 0.06 mol | 0.08 mol |
| Fluorescent brightening agent (4,4'-diaminostilbene series) | 2.0 g | 4.0 g |
| Sodium sulfite | Shown in Table 8 | |
| Water to make | 1,000 ml | 1,000 ml |
| pH (25° C.) | 10.25 | 11.00 |

When the running test began and ended, the sensitometry was processed in Example 1. The maximum density (Dmax), sensitivity (log E indicating a density of 0.5) and gradation (density change at an exposure of log E=0.3 with respect to the exposure indicating a density of 0.5) were measured by means of a Macbeth densitometer. Thus, the change in these values between before and after the running test was obtained. The results are shown in Table 8. In the sensitivity change, the mark + indicates an increase in the sensitivity while the mark − indicates a decrease n the sensitivity.

Furthermore, when the running test ended, the color developing solution was checked with the eye to confirm the presence of suspended matter therein. The results are shown in Table 8.

As can be seen in Table 8, the light-sensitive material specimens free of the compounds of the general formulae (I), (II), (III), (IV) and (V) as gelatin preservative exhibit a rather great fluctuation in the maximum density, sensitivity and gradation between before and after the running test as shown in the processing steps 1 to 3. When the running test ended, it was observed that a large amount of suspended matter was produced in the color developing solution.

The light-sensitive material specimens comprising the present compound of the general formula (V) exhibits less fluctuation in the photographic properties and little generation of suspended matter due to the running test as shown in the processing steps 4 to 9.

As shown in the processing steps 4 to 9, the present color developing solution may be preferably free of sodium sulfite or hydroxylamine in the light of fluctuation in the photographic properties. Hydroxylamine or sodium sulfite may be preferably replaced by the compound VI-1, VIII-7, VIII-28, XII-1 or XXI-7 as preservative in the light of fluctuation in the photographic properties.

EXAMPLE 8

The same experiment was effected as in Example 7 except that the compound VI-1 to be used in the processing step 7 was replaced by the compound VI-2, VII-7, VIII-12, VIII-28, VIII-44, IX-4, X-1, and XI-5, respectively. Excellent results were obtained as in Example 7. Furthermore, the same experiment was effected as in Example 7 except that the compound XII-1 to be used in the processing step 7 was replaced by the compound XIII-5,XIII-8, XIV-1, XIV-3, XV-1, XV-3, XVI-1, XVI-2, XVII-3, XVII-10, XVIII-8, XIX-1, XX-1, XX-6, and XXI-1, respectively. Excellent results were obtained as in Example 7.

EXAMPLE 9

Multilayer photographic paper specimens A to H were prepared by coating various layers of different gelatin preservative and silver compositions on a paper support laminated with polyethylene on both sides thereof. By way of example, the coating solution was prepared in the following manner:

Preparation of Coating Solution for 1st Layer 19.1 g of a yellow coupler (ExY-1) and 4.4 g of a dye stabilizer (Cpd-1) were dissolved in 27.2 cc of ethyl

TABLE 8

| Processing step | (1) | (2) | (3) | (4) | (5) | (6) | (7) | (8) | (9) |
|---|---|---|---|---|---|---|---|---|---|
| Light-sensitive material | A | B | C | D | E | E | E | F | G |
| Sodium sulfite (g/l) | | | | | | | | | |
| Tank solution | — | — | 2.5 | — | — | 2.5 | — | — | — |
| Supply liquid | — | — | 5.0 | — | — | 5.0 | — | — | — |
| Organic preservative A | Hydroxylamine | VI-1 | VI-1 | VI-1 | Hydroxylamine | VI-1 | VI-1 | VIII-7 | VIII-28 |
| Organic preservative B | XII-1 | XII-1 | — | XII-1 | XII-1 | — | XII-1 | XXI-7 | XXI-7 |
| Remarks | Comparative example | Comparative example | Comparative example | Present invention | Present invention | Present invention | Present invention | Present invention | Present invention |
| BL ΔDmax | −0.31 | −0.25 | −0.29 | −0.01 | +0.16 | +0.14 | −0.02 | ±0.0 | −0.02 |
| ΔSensitivity | −0.12 | −0.10 | −0.12 | ±0.0 | +0.04 | +0.03 | −0.01 | ±0.0 | −0.01 |
| ΔGradation | −0.19 | −0.18 | −0.20 | ±0.0 | +0.09 | +0.07 | −0.02 | −0.01 | −0.01 |
| Suspended matter | xx | xx | xx | ○ | Δ | ○ | ○ | ○ | ○ |

○: none
Δ: slight
x: some
xx: large amount acetate and 7.7 cc (8.0 g) of a high boiling solvent (Solv-1). The solution thus obtained was then emulsion-dispersed in 185 cc of a 10% aqueous solution of gelatin containing 8 cc of 10% sodium dodecylbenzene-sulfonate. The emulsion dispersion was mixed with Emulsion EM7 and Emulsion EM8. The gelatin concentration was adjusted so that the coating solution for the 1st layer having the undermentioned composition was prepared. The coating solutions for the 2nd layer to the 7th layer were prepared in a similar manner. As gelatin hardener for each layer there was used 1-oxy-3,5-dichloro-s-triazine sodium salt.

As a thickening agent there was used Cpd-2.

Layer Concentration

The composition of the various layers will be described hereinafter. The figures indicate the coated amount of each component (g/m$^2$). The coated amount of silver halide emulsion is represented in terms of coated amount of silver.

| | |
|---|---|
| Support: | |
| Polyethylene-laminated paper [containing a white pigment ($TiO_2$) and a blue dye in polyethylene on the 1st layer side] | |
| 1st layer: blue-sensitive layer | |
| Monodisperse silver bromochloride emulsion (EM7) spectrally sensitized with sensitizing dye (ExS-1) | 0.15 |
| Monodisperse silver bromochloride emulsion (EM8) spectrally sensitized with sensitizing dye (ExS-1) | 0.15 |
| Gelatin | 1.86 |
| Yellow coupler (ExY-1) | 0.82 |
| Dye stabilizer (Cpd-2) | 0.19 |
| Solvent (Solv-1) | 0.35 |
| 2nd layer: color stain inhibiting layer | |
| Gelatin | 0.99 |
| Color stain inhibitor (Cpd-3) | 0.08 |
| 3rd layer: green-sensitive layer | |
| Monodisperse silver bromochloride emulsion (EM9) spectrally sensitized with sensitizing dyes (ExS-2, 3) | 0.12 |
| Monodisperse silver bromochloride emulsion (EM10) spectrally sensitized with sensitizing dyes (ExS-2, 3) | 0.24 |
| Gelatin | 1.24 |
| Magenta coupler (ExM-1) | 0.39 |
| Dye stabilizer (Cpd-4) | 0.25 |
| Dye stabilizer (Cpd-5) | 0.12 |
| Solvent (Solv-2) | 0.25 |
| 4th layer: ultraviolet absorbing layer | |
| Gelatin | 1.60 |
| Ultraviolet absorber (3:2:6 mixture of Cpd-6, Cpd-7, and Cpd-8) | 0.70 |

-continued

| | |
|---|---|
| Color stain inhibitor (Cpd-9) | 0.05 |
| Solvent (Solv-3) | 0.42 |
| 5th layer: red-sensitive layer | |
| Monodisperse silver bromochloride emulsion (EM11) spectrally sensitized with sensitizing dyes (ExS-4,5) | 0.07 |
| Monodisperse silver bromochloride emulsion (EM12) spectrally sensitized with sensitizing dyes (ExS-4, 5) | 0.16 |
| Gelatin | 0.92 |
| Cyan coupler (ExC-1) | 1.46 |
| Cyan coupler (ExC-2) | 1.84 |
| Dye stabilizer (3:4:2 mixture of Cpd-7, Cpd-8 and Cpd-10) | 0.17 |
| Dispersing polymer (Cpd-11) | 0.14 |
| Solvent (Solv-1) | 0.20 |
| 6th layer: ultraviolet absorbing layer | |
| Gelatin | 0.54 |
| Ultraviolet absorber (1:5:3 mixture of Cpd-6, Cpd-8 and Cpd-10) | 0.21 |
| Solvent (Solv-4) | 0.08 |
| 7th layer: protective layer | |
| Gelatin | 1.33 |
| Acryl-modified copolymer of polyvinyl alcohol (modification degree: 17%) | 0.17 |
| Liquid paraffin | 0.03 |

As antiirradiation dyes there were used Cpd-12 and Cpd-13.

Alkanol XC (DuPont), sodium alkylbenzenesulfonate, ester succinate and Magefacx F-120 (Dainippon Ink and Chemicals, Incorporated) were incorporated in each layer as emulsion dispersant and coating aid. As silver halide stabilizers there were used Cpd-14 and Cpd-15.

The details of the emulsions used will be described hereinafter.

| Emulsion Name | Crystal Structure | Particle Diameter (μm) | Br Content (mol %) | Fluctuation Coefficient* |
|---|---|---|---|---|
| EM7 | Cube | 1.1 | 1.0 | 0.10 |
| EM8 | Cube | 0.8 | 1.0 | 0.10 |
| EM9 | Cube | 0.45 | 1.5 | 0.09 |
| EM10 | Cube | 0.34 | 1.5 | 0.09 |
| EM11 | Cube | 0.45 | 1.5 | 0.09 |
| EM12 | Cube | 0.34 | 1.6 | 0.10 |

*The coefficient of fluctuation indicates the distribution of grains $$\left(= \frac{\text{Standard deviation}}{\text{Average size}}\right)$$

The structural formula of the compounds used will be shown hereinafter.

ExY-1

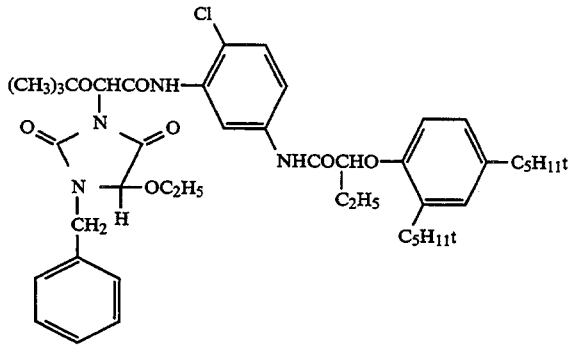

-continued
ExM-1
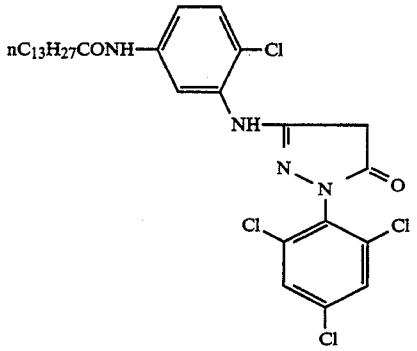
ExC-1
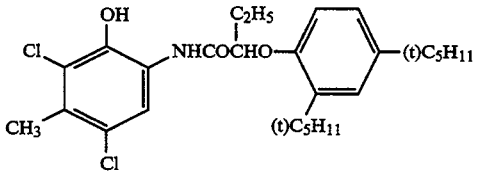
ExC-2
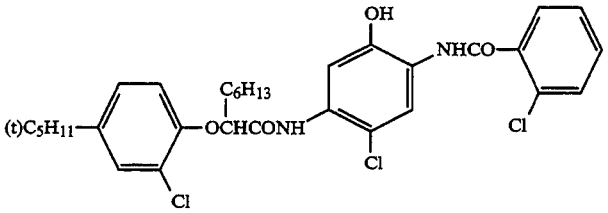
ExS-1
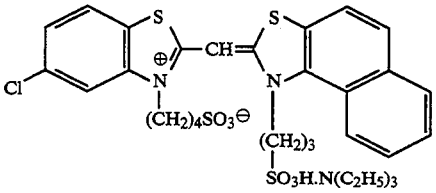
ExS-2
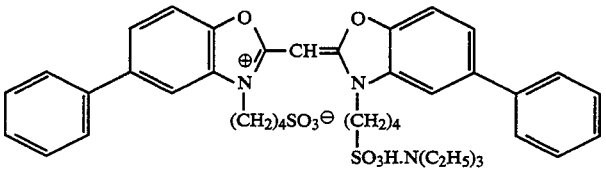
ExS-3
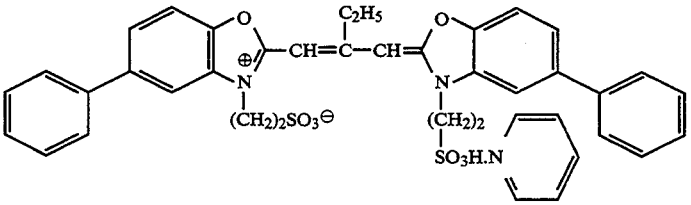
ExS-4
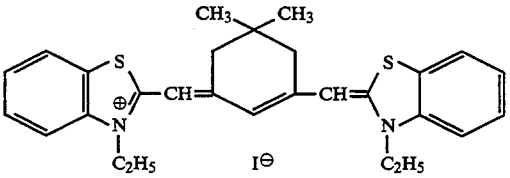

-continued
ExS-5
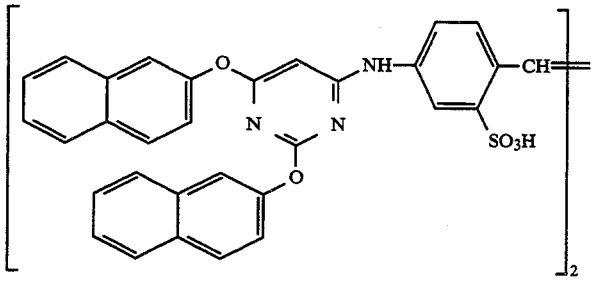
Cpd-1
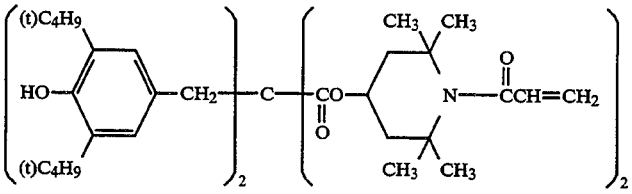
Cpd-2
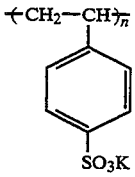
(Average molecular weight: 80,000)
Cpd-3
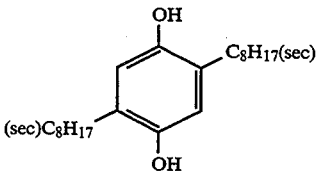
Cpd-4
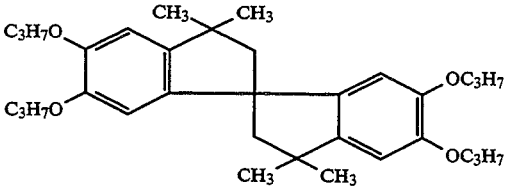
Cpd-5
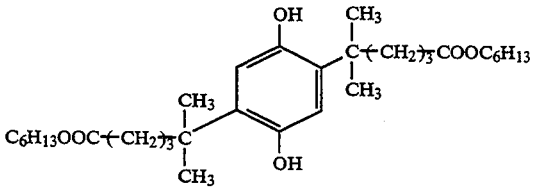
Cpd-6
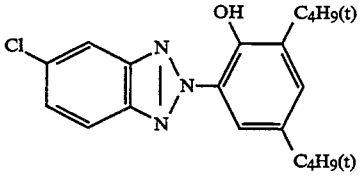
Cpd-7
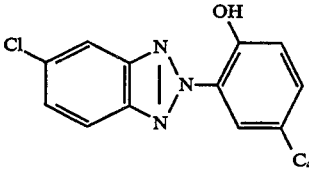

-continued
Cpd-8
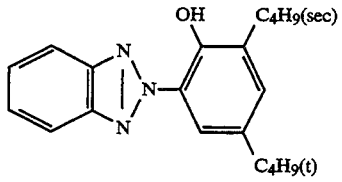
Cpd-9
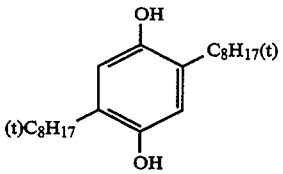
Cpd-10
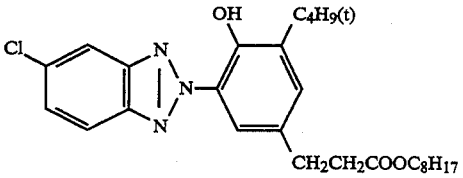
Cpd-11
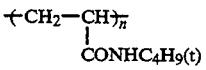
(n = 100 ~ 1000)
Cpd-12
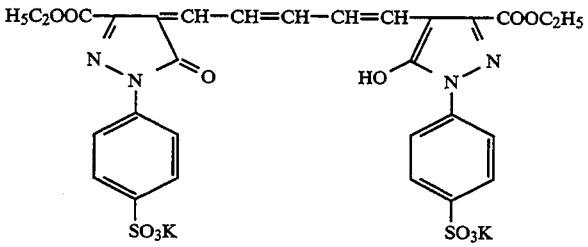
Cpd-13
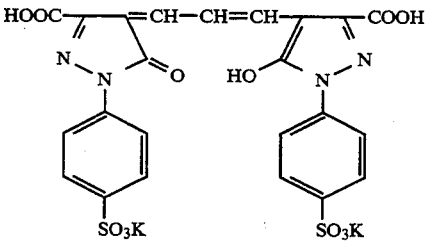
Cpd-14
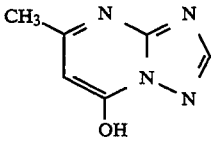
Cpd-15
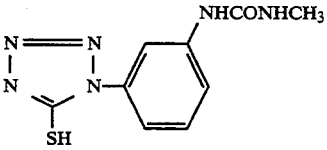
Solv-1: Dibutyl phthalate
Solv-2: Trioctyl phosphate
Solv-3: Trinonyl phosphate
Solv-4: Tricresyl phosphate

TABLE 9

| Specimen | A | B | C | D | E | F | G | H |
|---|---|---|---|---|---|---|---|---|
| Added amount of gelatin preservative based on gelatin | Phenol 0.05% | Phenol 0.05% | Phenol 0.05% | Phenol 0.05% | I-1 0.05% | I-1 0.05% | I-1 0.05% | I-1 0.05% |
| Coated amount of silver | | | | | | | | |
| 1st layer EM7 | 0.18 | 0.15 | 0.12 | 0.11 | 0.18 | 0.15 | 0.12 | 0.11 |
| 1st layer EM8 | 0.18 | 0.15 | 0.12 | 0.11 | 0.18 | 0.15 | 0.12 | 0.11 |
| 3rd layer EM9 | 0.12 | 0.12 | 0.12 | 0.11 | 0.12 | 0.12 | 0.12 | 0.11 |
| 3rd layer EM10 | 0.24 | 0.24 | 0.20 | 0.19 | 0.24 | 0.24 | 0.20 | 0.19 |
| 5th layer EM11 | 0.09 | 0.07 | 0.07 | 0.05 | 0.09 | 0.07 | 0.07 | 0.05 |
| 5th layer EM12 | 0.16 | 0.16 | 0.16 | 0.12 | 0.16 | 0.16 | 0.16 | 0.12 |
| Total | 0.97 | 0.89 | 0.79 | 0.69 | 0.97 | 0.89 | 0.79 | 0.69 |

The light-sensitive material specimens A to H thus prepared were imagewise exposed to light. These specimens were then continuously processed by means of a paper processing machine at the following processing steps until the color developing solution was supplied twice the tank volume (running test).

| Processing Step | Temperature | Time | Supply Amount | Tank Volume |
|---|---|---|---|---|
| Color development | 39° C. | 60 sec. | 28 ml | 4 l |
| Blix | 30–36° C. | 45 sec. | 215 ml | 4 l |
| Stabilization 1 | 30–37° C. | 20 sec. | — | 2 l |
| Stabilization 2 | 30–37° C. | 20 sec. | — | 2 l |
| Stabilization 3 | 30–37° C. | 20 sec. | — | 2 l |
| Stabilization 4 | 30–37° C. | 30 sec. | 250 ml | 2 l |
| Drying | 70–85° C. | 60 sec. | | |

(The supply amount is represented in terms of amount per 1 $m^2$ of light-sensitive material. The stabilization process was effected in a countercurrent process in which the stabilizing solution was passed from the tank 4 to the tank 1 through the tanks 3 and 2.)

The composition of the various processing solutions will be described hereinafter.

| | Tank Solution | Supply Liquid |
|---|---|---|
| Color developing solution | | |
| Water | 800 ml | 800 ml |
| Ethylenediaminetetraacetate | 5.0 g | 5.0 g |
| 5,6-Dihydroxybenzene-1,2,4-trisulfonic acid | 0.3 g | 0.3 g |
| Triethanol amine | 9.0 g | 9.0 g |
| Sodium chloride | 8.0 g | — |
| Potassium carbonate | 27 g | 27 g |
| N-ethyl-N-(β-methanesulfonamidethyl)-3-methyl-4-aminoaniline sulfate | 6.0 g | 17.0 g |
| Diethylhydroxyl amine | 5.0 g | 11.0 g |
| Fluorescent brightening agent 4,4'-diaminostilbene series) | 2 g | 5 g |
| Water to make | 1,000 ml | 1,000 ml |

-continued

| | Tank Solution | Supply Liquid |
|---|---|---|
| pH (25° C.) | 10.30 | 11.20 |
| Blix-solution (the tank solution was used also as the supply liquid) | | |
| Water | | 400 ml |
| Ammonium thiosulfate (70%) | | 100 ml |
| Sodium sulfite | | 17 g |
| Ferric ammonium ethylenediaminetetraacetate | | 55 g |
| Disodium ethylenediaminetetraacetate | | 5 g |
| Glacial acetic acid | | 9 g |
| Water to make | | 1,000 ml |
| pH (25° C.) | | 5.40 |
| Stabilizing solution (The tank solution was used as the supply liquid | | |
| 1-Hydroxyethylidene-1,1-diphosphonic acid | | 1.0 g |
| Bismuth chloride | | 0.5 g |
| 5-Chloro-2-methyl-4-isothiazoline-3-one | | 0.02 g |
| 2-Methyl-4-isothiazoline-3-one | | 0.01 g |
| Copper sulfate | | 0.005 g |
| Aqueous ammonia (28%) | | 2.0 ml |
| Water to make | | 1,000 ml |
| pH (25° C.) | | 4.0 |

The same experiment was conducted as in Example 1 to determine the change in the maximum density, sensitivity and gradation of blue layer due to the running test and confirm the presence of suspended matter caused by the running test. The results are shown in Table 10.

TABLE 10

| Processing step | (1) | (2) | (3) | (4) | (5) | (6) | (7) | (8) |
|---|---|---|---|---|---|---|---|---|
| Light-sensitive material | A | B | C | D | E | F | G | H |
| Remarks | Comparative example | Comparative example | Comparative example | Comparative example | Present invention | Present invention | Present invention | Present invention |
| BL ΔDmax | −0.62 | −0.59 | −0.55 | −0.54 | −0.08 | −0.07 | −0.03 | −0.03 |
| ΔSensitivity | −0.22 | −0.19 | −0.19 | −0.18 | −0.04 | −0.04 | −0.01 | −0.02 |
| ΔGradation | −0.30 | −0.28 | −0.25 | −0.26 | −0.04 | −0.04 | −0.02 | −0.01 |
| Suspended matter | xx | xx | xx | xx | ∘ | ∘ | ∘ | ∘ |

∘: none
Δ: slight
x: some
xx: large amount

As can be seen in Table 10, the light-sensitive material specimens comprising phenol as preservative exhibit a rather great fluctuation in the photographic properties and a large amount of matter suspended in the color developing solution due to the running test as shown in the processing steps 1 to 4.

It was also found that the specimens comprising the present compound I-1 exhibit less fluctuation in the photographic properties and little generation of suspended matter in the color developing solution due to the running test as shown in the processing steps 5 to 8.

As shown in the processing steps 5 to 8, the present light-sensitive material may preferably comprise 0.8 g/m$^2$ or less of silver as calculated in terms of coated amount in the light of fluctuation in the photographic properties.

EXAMPLE 10

Light-sensitive material specimens A to H were prepared in the same manner as in Example 9 except that the gelatin preservative and the coated amount of silver (per 1 m$^2$) were altered as shown in Table 11.

TABLE 11

| Specimen | A | B | C | D | E | F | G | H |
|---|---|---|---|---|---|---|---|---|
| Added amount of gelatin preservative based on gelatin | Phenol 0.05% | Phenol 0.05% | Phenol 0.05% | Phenol 0.05% | V-25 0.05% | V-25 0.05% | V-25 0.05% | V-25 0.05% |
| Coated amount of silver | | | | | | | | |
| 1st layer EM7 | 0.18 | 0.15 | 0.12 | 0.11 | 0.18 | 0.15 | 0.12 | 0.11 |
| 1st layer EM8 | 0.18 | 0.15 | 0.12 | 0.11 | 0.18 | 0.15 | 0.12 | 0.11 |
| 3rd layer EM9 | 0.12 | 0.12 | 0.12 | 0.11 | 0.12 | 0.12 | 0.12 | 0.11 |
| 3rd layer EM10 | 0.24 | 0.24 | 0.20 | 0.19 | 0.24 | 0.24 | 0.20 | 0.19 |
| 5th layer EM11 | 0.09 | 0.07 | 0.07 | 0.05 | 0.09 | 0.07 | 0.07 | 0.05 |
| 5th layer EM12 | 0.16 | 0.16 | 0.16 | 0.12 | 0.16 | 0.16 | 0.16 | 0.12 |
| Total | 0.97 | 0.89 | 0.79 | 0.69 | 0.97 | 0.89 | 0.79 | 0.69 |

The light-sensitive material specimens A to H thus prepared were imagewise exposed to light. These specimens were then continuously processed by means of a paper processing machine at the following processing steps until the color developing solution was supplied twice the tank volume (running test).

| Processing Step | Temperature | Time | Supply Amount | Tank Volume |
|---|---|---|---|---|
| Color development | 38° C. | 60 sec. | 30 ml | 4 l |
| Blix | 30–36° C. | 45 sec. | 215 ml | 4 l |
| Stabilization 1 | 30–37° C. | 20 sec. | — | 2 l |
| Stabilization 2 | 30–37° C. | 20 sec. | — | 2 l |
| Stabilization 3 | 30–37° C. | 20 sec. | — | 2 l |
| Stabilization 4 | 30–37° C. | 30 sec. | 250 ml | 2 l |
| Drying | 70–85° C. | 60 sec. | | |

(The supply amount is represented in terms of amount per 1 m$^2$ of light-sensitive material. The stabilization process was effected in a countercurrent process in which the stabilizing solution was passed from the tank 4 to the tank 1 through the tanks 3 and 2.)

The composition of the various processing solutions will be described hereinafter.

| | Tank Solution | Supply Liquid |
|---|---|---|
| Color developing solution | | |
| Water | 800 ml | 800 ml |

-continued

| | Tank Solution | Supply Liquid |
|---|---|---|
| Ethylenediaminetetraacetic acid | 5.0 g | 5.0 g |
| 5,6-Dihydroxybenzene-1,2,4-trisulfonic acid | 0.3 g | 0.3 g |
| Triethanol amine | 9.0 g | 9.0 g |
| Sodium chloride | 7.5 g | — |
| Potassium carbonate | 25 g | 25 g |
| N-ethyl-N-(β-methanesulfonamidethyl)-3-methyl-4-aminoaniline sulfate | 5.0 g | 15.0 g |
| Diethylhydroxyl amine | 4.5 g | 10.0 g |
| Fluorescent brightening agent 4,4'-diaminostilbene series) | 2.0 g | 5.0 g |
| Water to make | 1,000 ml | 1,000 ml |
| pH (25° C.) | 10.25 | 11.10 |
| Blix-solution (the tank solution was used also as the supply liquid) | | |
| Water | | 400 ml |
| Ammonium thiosulfate (70%) | | 100 ml |
| Sodium sulfite | | 17 g |
| Ferric ammonium ethylenediaminetetraacetate | | 55 g |
| Disodium ethylenediaminetetraacetate | | 5 g |
| Glacial acetic acid | | 9 g |
| Water to make | | 1,000 ml |
| pH (25° C.) | | 5.40 |
| Stabilizing solution (The tank solution was used also as supply liquid | | |
| Formalin (37%) | | 0.1 g |
| Fomalin-sulfinic acid addition product | | 0.7 g |
| 5-Chloro-2-methyl-4-idothiazoline-3-one | | 0.02 g |
| 2-Methyl-4-isothiazoline-3-one | | 0.01 g |
| Copper sulfate | | 0.005 g |
| Aqueous ammonia (28%) | | 2.0 ml |
| Water to make | | 1,000 ml |
| pH (25° C.) | | 4.0 |

These specimens were subjected to the same experiment as in Example 9 to determine the change in the maximum density, sensitivity and gradation in the blue-sensitive layer and confirm the presence of suspended matter in the color developing solution due to the running test. The results are shown in Table 12.

TABLE 12

| Processing step | (1) | (2) | (3) | (4) | (5) | (6) | (7) | (8) |
|---|---|---|---|---|---|---|---|---|
| Light-sensitive material | A | B | C | D | E | F | G | H |
| Remarks | Comparative example | Comparative example | Comparative example | Comparative example | Present invention | Present invention | Present invention | Present invention |
| BL ΔDmax | −0.58 | −0.55 | −0.54 | −0.55 | −0.05 | −0.04 | −0.02 | −0.02 |
| ΔSensitivity | −0.20 | −0.18 | −0.18 | −0.17 | −0.03 | −0.03 | −0.01 | −0.01 |
| ΔGradation | −0.28 | −0.26 | −0.25 | −0.25 | −0.03 | −0.03 | −0.01 | ±0.0 |
| Suspended matter | xx | xx | xx | xx | ○ | ○ | ○ | ○ |

○: none
Δ: slight
x: some
xx: large amount

As can be seen in Table 12, the light-sensitive material specimens comprising phenol as preservative exhibit a rather great fluctuation in the photographic properties and a large amount of suspended matter in the color developing solution due to the running test as shown in the processing steps 1 to 4.

It was also found that the light-sensitive material specimens comprising the present compound V-25 as preservative exhibit a rather small fluctuation in the photographic properties and little generation of suspended matter in the color developing solution due to the running test as shown in the processing steps 5 to 8.

As shown in the processing steps 5 to 8, the present light-sensitive material specimens may preferably comprise silver in an amount of 0.8 g/m$^2$ calculated in terms of coated amount in the light of fluctuation in the photographic properties.

EXAMPLE 11

The same experiment was conducted as in the processing steps 5 to 8 of Example 9 except that the preservative I-1 to be incorporated in Specimens E to H was replaced by the compounds II-1, II-45, III-3, III-14, IV-1, IV-5, V-2, V-22, V-28 and V-33, respectively. Similar results were obtained as in Example 9.

EXAMPLE 12

A multilayer color photographic paper specimen was prepared by coating various layers of the following compositions on a paper support laminated with polyethylene on both sides thereof. The coating solutions for the various layers were prepared as follows:

Preparation of Coating Solution for 1st Layer 19.1 g of a yellow coupler (ExY), 4.4 g of a dye stabilizer (Cpd-1) and 0.7 g of a dye stabilizer (Cpd-7) were dissolved in 27.2 cc of ethyl acetate and 8.2 g of a solvent (Solv-3). The solution thus prepared was then emulsion-dispersed in 18.5 cc of a 10% aqueous solution of gelatin containing 8 cc of 10% sodium dodecylbenzenesulfonate. On the other hand, a blue-sensitive sensitizing dye of the undermentioned general formula was added to a silver bromochloride emulsion (cubic grains having an average particle size of 0.88 μm and a particle size fluctuation coefficient of 0.08; comprising 0.2 mol % of silver bromide on the surface thereof) in an amount of $2.0\times10^{-4}$ mol per 1 mol of silver. The emulsion was then subjected to sulfur sensitization. The emulsion thus prepared and the emulsion dispersion prepared earlier were mixed with each other in such a proportion that the 1st layer coating solution having the undermentioned composition was obtained. The coating solutions for the 2nd layer to the 7th layer were similarly prepared. As a gelatin hardener for each layer there was used 1-oxy-3,5-dichloro-s-triazine sodium salt.

The spectral sensitizers incorporated in the various layers will be shown hereinafter.

Blue-sensitive emulsion layer

-continued

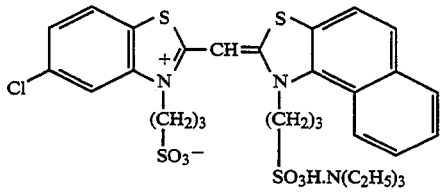

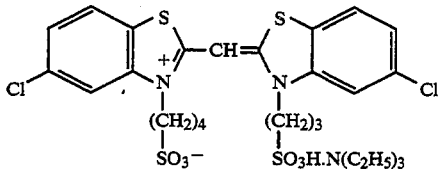

($2.0\times10^{-4}$ mol per mol of silver halide, respectively)

Green-sensitive emulsion layer

Same as (S-2) used in Example 1 ($4.0\times10^{-4}$ mol per mol of silver halide) and

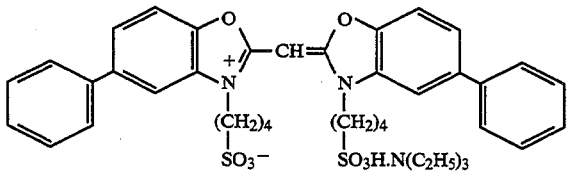

($7.0\times10^{-5}$ mol per mol of silver halide)

Red-sensitive emulsion layer

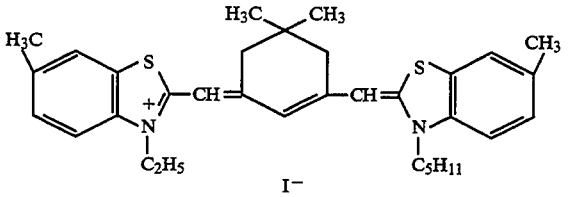

($0.9\times10^{-4}$ mol per mol of silver halide)

A compound of the undermentioned general formula was incorporated in the red-sensitive emulsion layer in an amount of $2.6\times10^{-3}$ mol per mol of silver halide.

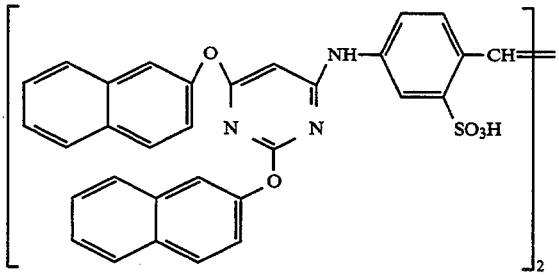

Furthermore, 1-(5-methylureidophenyl)-5-mercaptotetrazole was incorporated in the blue-sensitive emulsion layer, the green-sensitive emulsion layer and the red-sensitive emulsion layer in amounts of $8.5\times10^{-5}$ mol, $7.7\times10^{-4}$ mol and $2.5\times10^{-4}$ mol per mol of silver halide, respectively.

For the purpose of inhibiting irradiation, the following dyes were incorporated in the emulsion layers.

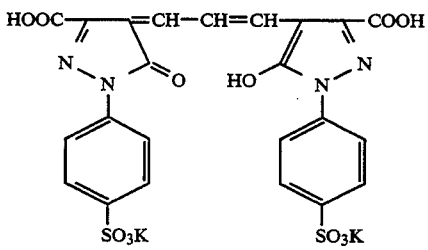

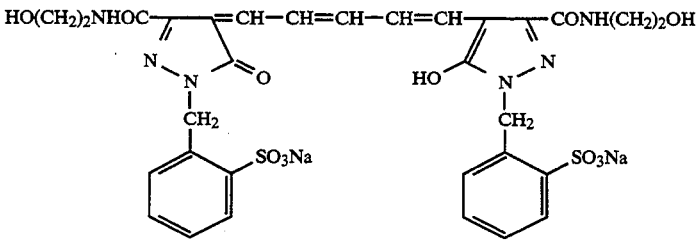

Layer Constitution

The composition of the various layers will be described hereinafter. The figures indicate the coated amount of various components (g/m$^2$). The coated amount of silver halide emulsion is represented in terms of coated amount of silver.

| | |
|---|---|
| Support | |
| Polyethylene-laminated paper [containing a white pigment ($TiO_2$) and a blue dye (ultramarine) in polyethylene on the 1st layer side] | |
| 1st layer: blue-sensitive layer | |
| Silver bromochloride emulsion | 0.30 |
| Gelatin | 1.86 |
| Yellow coupler (ExY) | 0.82 |
| Dye stabilizer (Cpd-1) | 0.19 |
| Solvent (Solv-3) | 0.35 |
| Dye stabilizer (Cpd-7) | 0.06 |
| 2nd layer: color stain inhibiting layer | |
| Gelatin | 0.99 |
| Color stain inhibitor (Cpd-5) | 0.08 |
| Solvent (Solv-1) | 0.16 |
| Solvent (Soly-4) | 0.08 |
| 3rd layer: green-sensitive layer | |
| Silver bromochloride emulsion (1:3 mixture (Ag mol) of emulsion comprising cubic grains having an average particle size of 0.55 μm and 0.39 μm; particle size fluctuation coefficient: 0.10 and 0.08; 0.8 mol % of AgBr locally present on the surface of grains) | 0.12 |
| Gelatin | 1.24 |
| Magenta coupler (ExM) | 0.27 |
| Dye stabilizer (Cpd-3) | 0.15 |
| Dye stabilizer (Cpd-8) | 0.02 |
| Dye stabilizer (Cpd-9) | 0.03 |
| Solvent (Solv-2) | 0.54 |
| 4th layer: ultraviolet absorbing layer | |
| Gelatin | 1.58 |
| Ultraviolet absorber (UV-1) | 0.47 |
| Color stain inhibitor (Cpd-5) | 0.05 |
| Solvent (Solv-5) | 0.24 |
| 5th layer: red-sensitive layer | |
| Silver bromochloride emulsion (1:4 mixture (Ag mol) of emulsion comprising cubic grains having an average particle size of 0.58 μm and 0.45 μm; particle size fluctuation coefficient: 0.09 and 0.11; 0.6 mol % of AgBr locally present on the surface of grains) | 0.23 |
| Gelatin | 1.34 |
| Cyan coupler (ExC) | 0.32 |
| Dye stabilizer (Cpd-6) | 0.17 |
| Dye stabilizer (Cpd-10) | 0.04 |
| Dye stabilizer (Cpd-7) | 0.40 |
| Solvent (Solv-6) | 0.15 |
| 6th layer: ultraviolet absorbing layer | |
| Gelatin | 0.53 |
| Ultraviolet absorber (UV-1) | 0.16 |
| Color stain inhibitor (Cpd-5) | 0.02 |
| Solvent (Solv-5) | 0.08 |
| 7th layer: protective layer | |
| Gelatin | 1.33 |

-continued
| | |
|---|---|
| Acryl-modified copolymer of polyvinyl alcohol (modification degree: 17%) | 0.17 |
| Liquid paraffin | 0.03 |
Yellow coupler (ExY)
Same as (ExY) in Example 1
Magenta coupler (ExM)
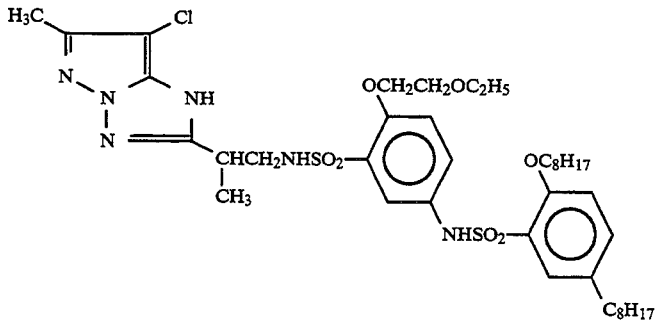
Cyan coupler (ExC)
2:4:4 mixture of
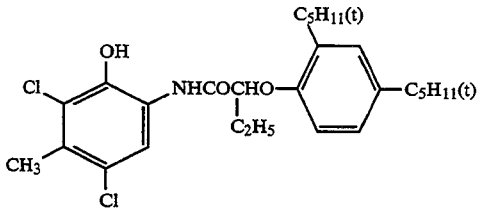
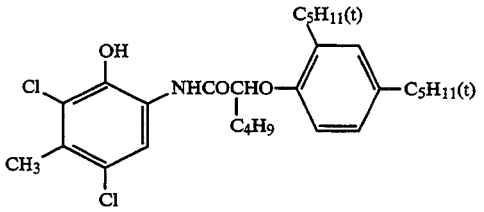
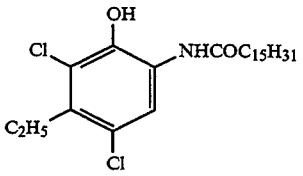
Dye stabilizer (Cpd-1)
Same as (Cpd-1) in Example 1
Dye stabilizer (Cpd-3)
Same as (Cpd-3) in Example 1
Color stain inhibitor (Cpd-5)
Same as (Cpd-5) in Example 1
Dye stabilizer (Cpd-6)
2:4:4 mixture of
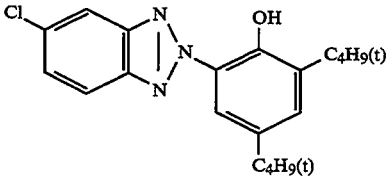

-continued
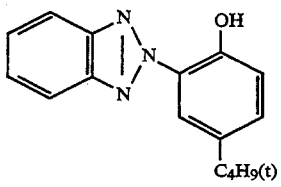
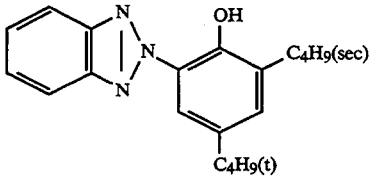
Dye stabilizer (Cpd-7)
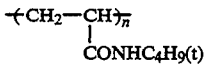
(Average molecular weight: 60,000)
Dye stabilizer (Cpd-8)
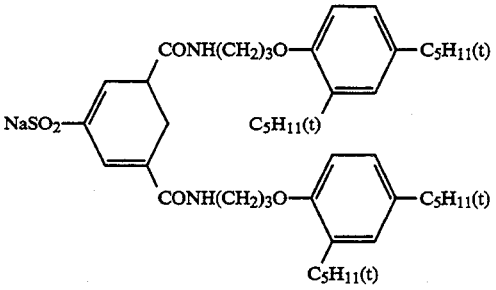
Dye stabilizer (Cpd-9)
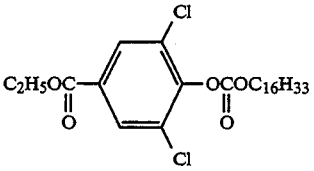
Dye stabilizer (Cpd-10)
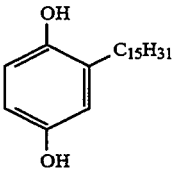
Ultraviolet absorber (UV-1)
4:2:4 mixture of
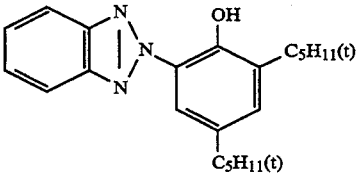

-continued

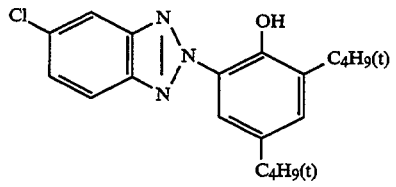

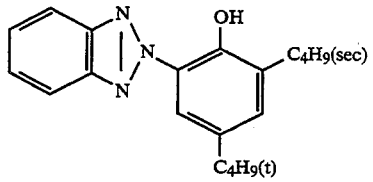

Solvent (Solv-1)
Same as (Solv-1) in Example 1
Solvent (Solv-2)
2:1 mixture (volume) of

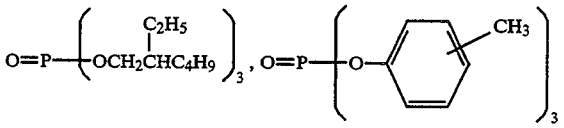

Solvent (Solv-3)
$O{=}P{-}(O{-}C_9H_{19}(iso))_3$
Solvent (Solv-4)

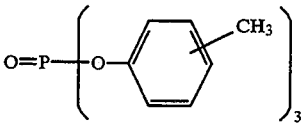

Solvent (Solv-5)

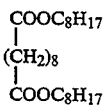

Solvent (Solv-6)

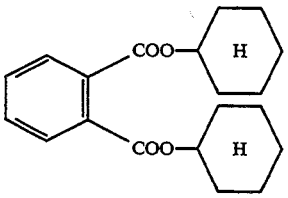

Preservatives I-1, II-1, II-45, III-3, III-14, IV-1, IV-5, V-2, V-22, V-25, V-28, and V-33 were incorporated in gelatin in the various layers in an amount of 0.05% based on the weight of gelatin to prepare Specimens A to L, respectively.

These specimens were then continuously processed with the same processing solutions at the same processing steps as in Example 10 until the color developing solution was supplied twice the tank volume (running test). Excellent results were obtained as in Example 10.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material with a color developing solution containing at least one aromatic primary amine color developing agent, wherein said silver halide color photographic material, comprising at least one emulsion layer of silver halide containing 98–99.9 mol % of silver chloride, contains silver halide in an amount of from 0.3 to 0.8 g/m$^2$ as silver, contains at least one anti-bacterial agent represented by general formulae (I), (II), (V-C) or (V-D) and a hydrophilic colloid, wherein the anti-bacterial agent is present in an amount of from 10 to 10,000 ppm based on the amount of the hydrophilic colloid:

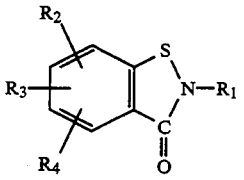

(I)

wherein $R_1$ represents a hydrogen atom, an alkyl group or an alkoxy group; and $R_2$, $R_3$ and $R_4$ each represents a hydrogen atom, a halogen atom, an alkyl group, an alkoxy group, a cyano group or a nitro group,

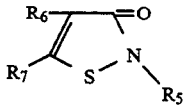

(II)

wherein $R_5$ represents a hydrogen atom, an alkyl group, a cyclic alkyl group, an alkenyl group, an aralkyl group, an aryl group, a —CONHR$_8$ group (in which $R_8$ represents an alkyl, aryl, alkylthio, arylthio, alkylsulfonyl, arylsulfonyl, alkylsulfinyl or arylsulfinyl group) or a heterocyclic group; and $R_6$ and $R_7$ each represents a hydrogen atom, a halogen atom, an alkyl group, a cyclic alkyl group, an aryl group, a heterocyclic group, a cyano group, an alkylthio group, an arylthio group, an alkylsulfoxide group, an alkylsulfinyl group or an alkylsulfonyl group,

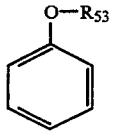

(V-C)

wherein $R_{53}$ represents a hydroxy-substituted alkyl group,

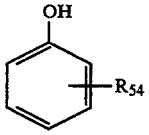

(V-D)

wherein $R_{54}$ represents a cycloalkyl group, wherein said color developing solution contains 0.005 to 0.5 mol/l of at least one organic preservative represented by the formula

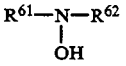

wherein $R^{61}$ and $R^{62}$ each represents a substituted or unsubstituted alkyl group; and wherein $R^{61}$ and $R^{62}$ may be connected to each other to form a heterocyclic ring with a nitrogen atom, wherein the color developing solution does not contain more than 2 ml/l of benzyl alcohol and the color developing solution is supplied in an amount of from 30 to 100 ml per m$^2$ of said silver halide color photographic material.

2. A process as claimed in claim 1, wherein said color developing solution contains 0.5 ml/l or less of benzyl alcohol.

3. A process as claimed in claim 1, wherein said color developing solution contains $5.0\times10^{-3}$ ml/l or less of sulfinic acid ions.

4. A process as claimed in claim 1, wherein said color developing solution contains $1\times10^{-2}$ ml/l or less of unsubstituted hydroxylamine.

5. A process as claimed in claim 1, wherein said antibacterial agent is present in an amount of from 100 to 1,000 ppm based on the amount of the hydrophilic colloid.

6. A process as claimed in claim 2, wherein said color developing solution contains no benzyl alcohol.

7. The process as claimed in claim 3, wherein said color developing solution contains no sulfinic acid ions.

8. The process as claimed in claim 4, wherein said color developing solution contains no substituted hydroxylamine.

9. A process as claimed in claim 1, wherein $R_{53}$ in formula (V-C) represents a hydroxy-substituted alkyl group having 1 to 3 carbon atoms.

10. A process as claimed in claim 1, wherein $R_{54}$ in formula (V-D) represents a cyclohexyl group.

11. A process as claimed in claim 1, wherein the hydrazines and hydrazides are represented by formula (VIII):

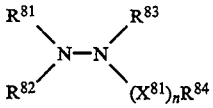

(VIII)

wherein $R^{81}$, $R^{82}$ and $R^{83}$ each independently represents a hydrogen atom, an alkyl group, an aryl group or a heterocyclic group; $R^{84}$ represents a hydrogen atom, a hydroxy group, a hydrazine group, an alkyl group, an aryl group, a heterocyclic group, an alkoxy group, an aryloxy group, a carbamoyl group or an amino group; $X^{81}$ represents a divalent group; and n represents an integer 0 to 1, with the proviso that when n is 0, $R^{84}$ represents an alkyl group, an aryl group or a heterocyclic group; and wherein $R^{83}$ and $R^{84}$ may together form a heterocyclic group.

12. A process as claimed in claim 1, wherein the monoamines are represented by formula (XII)

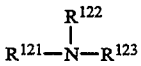

(XII)

wherein $R^{121}$, $R^{122}$ and $R^{123}$ each represents a hydrogen atom, an alkyl group, an alkenyl group, an aryl group, an aralkyl group or a heterocyclic group; and wherein $R^{121}$ and $R^{122}$, $R^{121}$ and $R^{123}$ or $R^{122}$ and $R^{123}$ may be connected to each other to form a nitrogen-containing heterocyclic group.

13. A process as claimed in claim 1, wherein the antibacterial agent is represented by formula (V-A).

14. 23. The method of claim 1, wherein the anti-bacterial agent is represented by formula (V-C).

15. The method of claim 1, wherein the substituted alkyl group comprises a hydroxy group, an alkoxyl group, an alkyl sulfonyl group, an arylsulfonyl group, an amide group, a carboxyl group, a cyano group, a sulfo group, a nitro group or an amino group.

16. The method of claim 1, wherein the substituted alkyl group comprises an alkoxy group, a carbonyl group and a sulfo group.

* * * * *